US005229241A

United States Patent [19]

Kato et al.

[11] Patent Number: 5,229,241

[45] Date of Patent: Jul. 20, 1993

[54] ELECTROPHOTOGRAPHIC LIGHT-SENSITIVE MATERIAL

[75] Inventors: Eiichi Kato; Seishi Kasai; Kazuo Ishii, all of Shizuoka, Japan

[73] Assignee: Fuji Photo Film Co., Ltd., Kanagawa, Japan

[21] Appl. No.: 704,560

[22] Filed: May 23, 1991

[30] Foreign Application Priority Data

May 23, 1990 [JP] Japan ..... 2-131158

[51] Int. Cl.[5] ..... G03G 5/087

[52] U.S. Cl. ..... 430/96; 430/49; 430/87

[58] Field of Search ..... 430/96, 49, 87

[56] References Cited

U.S. PATENT DOCUMENTS 5,030,534 7/1991 Kato et al. ..... 430/96
5,073,467 12/1991 Kato et al. ..... 430/87
5,104,759 4/1992 Kato ..... 430/96

FOREIGN PATENT DOCUMENTS 0361063 4/1990 European Pat. Off. .
0361514 4/1990 European Pat. Off. .
0363928 4/1990 European Pat. Off. .

*Primary Examiner*—Marion E. McCamish
*Assistant Examiner*—Rosemary Ashton
*Attorney, Agent, or Firm*—Sughrue, Mion, Zinn, Macpeak & Seas

[57] ABSTRACT

An electrophotographic light-sensitive material comprising a support having provided thereon a photoconductive layer containing at least an inorganic photoconductive substance, a spectral sensitizer and a binder resin, wherein the binder resin contains (1) at least one resin (Resin (A)) having a weight average molecular weight of from $1\times10^3$ to $1\times10^4$ which contains at least 30% by weight of a polymer component represented by the general formula (I) described below and from 0.1 to 10% by weight of a polymer component containing at least one acidic group selected from $-PO_3H_2$, $-SO_3H$, $-COOH$, (wherein R represents a hydrocarbon group or —OR′ (wherein R′ represents a hydrocarbon group), and a cyclic acid anhydride-containing group, and which has at least one acidic group selected from the above-described acidic groups at one terminal of the main chain of the copolymer;

(I)

wherein $a_1$ and $a_2$ each represents a hydrogen atom, a halogen atom, a cyano group or a hydrocarbon group; and $R_1$ represents a hydrocarbon group; and (2) at least one copolymer (Resin (B)) formed from at least a monofunctional macromonomer (MB) having a weight average molecular weight of not more than $2\times10^4$ and a monomer represented by the general formula (V) described below, the macromonomer (MB) comprising at least a polymer component corresponding to a repeating unit represented by the general formula (IVa) or (IVb) described below, and the macromonomer (MB) having a polymerizable double bond group represented by the general formula (III) described below bonded to only one terminal of the main chain thereof.

(III)

wherein $V_0$ represents —COO—, —OCO—, —$CH_2$OCO—, —$CH_2$COO—, —O—, —$SO_2$—, —CO—, —CONHCOO—, —CONHCONH—, —CONH$SO_2$—,

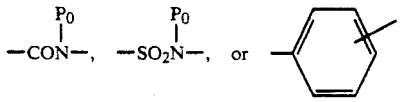

(wherein $P_0$ represents a hydrogen atom or a hydrocarbon group); and $c_1$ and $c_2$, which may be the same or different, each represents a hydrogen atom, a halogen atom, a cyano group, a hydrocarbon group, —COO—$Z_1$ or —COO—$Z_1$ bonded via a hydrocarbon group (wherein $Z_1$ represents a hydrocarbon group which may be substituted);

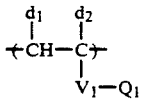

(IVa)

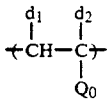

(IVb)

wherein $V_1$ has the same meaning as $V_0$ in the general formula (III); $Q_1$ represents an aliphatic group having from 1 to 18 carbon atoms or an aromatic group having from 6 to 12 carbon atoms; $d_1$ and $d_2$, which may be the same or different, each has the same meaning as $c_1$ or $c_2$ in the general formula (III); and $Q_0$ represents —CN, —$CONH_2$, or

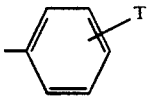

(wherein T represents a hydrogen atom, a halogen atom, a hydrocarbon an alkoxy group, group or —$COOZ_2$ (wherein $Z_2$ represents an alkyl group, an aralkyl group, or an aryl group));

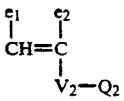

(V)

wherein $V_2$ has the same meaning as $V_1$ in the general formula (IVa); $Q_2$ has the same meaning as $Q_1$ in the general formula (IVa); and $e_1$ and $e_2$, which may be the same or different, each has the same meaning as $c_1$ or $c_2$ in the general formula (III).

19 Claims, No Drawings

ELECTROPHOTOGRAPHIC LIGHT-SENSITIVE MATERIAL

FIELD OF THE INVENTION

The present invention relates to an electrophotographic light-sensitive material, and more particularly to an electrophotography light-sensitive material which is excellent in electrostatic charging characteristics and pre-exposure fatigue resistance.

BACKGROUND OF THE INVENTION

An electrophotographic light-sensitive material may have various structures depending upon the characteristics required or an electrophotographic process being employed.

An electrophotographic system in which the light-sensitive material comprises a support having thereon at least one photoconductive layer and, if desired, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process of using an electrophotographic light-sensitive material as an offset master plate for direct plate making is widely practiced.

Binders which are used for forming the photoconductive layer of an electrophotographic light-sensitive material are required to be excellent in the film-forming property by themselves and the capability of dispersing a photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue due to pre-exposure and also have an excellent image forming properties, and the photo-conductive layer stably maintaining these electrostatic characteristics in spite of the variation of humidity at the time of image formation.

Binder resins which have been conventionally used include silicone resins (e.g., JP-B-34-6670) (the term "JP-B" as used herein means an "examined Japanese patent publication"), styrene-butadiene resins (e.g., JP-B-35-1960), alkyd resins, maleic acid resins, polyamides (e.g., JP-B-35-11219), vinyl acetate resins (e.g., JP-B-41-2425), vinyl acetate copolymers (e.g., JP-B-41-2426), acrylic resins (JP-B-35-11216), and acrylic acid ester copolymers (e.g., JP-B-35-11219, JP-B-36-8510, and JP-B-41-13946).

However, in the electrophotographic light-sensitive materials using these binder resins, there are various problems such as 1) the affinity of the binder resin with a photoconductive powder is poor thereby reducing the dispersibility of the coating composition containing them, 2) the charging property of the photoconductive layer containing the binder resin is low, 3) the quality (in particular, dot image reproducibility and resolving power) of the image portions of duplicated images is poor, 4) the image quality is liable to be influenced by the environmental conditions (e.g., high temperature and high humidity or low temperature and low humidity) at the time of the formation of the duplicated image, and 5) the photoconductive layer is insufficient in film strength and adhesion to the support, which causes, when the light-sensitive material is used for an offset master, peeling off of the photoconductive layer at offset printing, resulting in decrease in the number of prints.

In order to improve electrostatic characteristics of the photoconductive layer, various attempts have hitherto been made. For example, incorporation of a compound having an aromatic ring or a furan ring containing a carboxy group or a nitro group either alone or in combination with a dicarboxylic anhydride in a photoconductive layer is disclosed in JP-B-42-6878 and JP-B-45-3073. However, the thus improved electrophotographic light-sensitive materials are yet insufficient in electrostatic characteristics and, in particular, light-sensitive materials having excellent light decay characteristics have not yet been obtained. Thus, for compensating the insufficient sensitivity of these light-sensitive materials, an attempt has been made to incorporate a large amount of a sensitizing dye into the photoconductive layer. However, light-sensitive materials containing a large amount of a sensitizing dye undergo considerable deterioration of whiteness to reduce the quality as a recording medium, and sometimes causing deterioration in dark decay characteristics, whereby satisfactory reproduced images are not obtained.

On the other hand, JP-A-60-10254 (the term "JP-A" as used herein means an "unexamined published Japanese patent application") discloses a method of using a binder resin for a photoconductive layer by controlling an average molecular weight of the resin. More specifically, JP-A-60-10254 discloses a technique for improving the electrostatic characteristics (in particular, reproducibility at repeated use as a PPC light-sensitive material) and moisture resistance of the photoconductive layer by using an acrylic resin having an acid value of from 4 to 50 and an average molecular weight of from $1\times10^3$ to $1\times10^4$ and an acrylic resin having an acid value of from 4 to 50 and an average molecular weight of from $1\times10^4$ to $2\times10^5$ in combination.

Furthermore, extensive investigations on lithographic printing plate precursors using electrophotographic light-sensitive materials have been made and various binder resins for a photoconductive layer have been proposed as satisfying both the electrostatic characteristics as an electrophotographic light-sensitive material and the printing characteristics as a printing plate precursor. For example, JP-B-50-31011 discloses a combination of a resin having a molecular weight of from $1.8\times10^4$ to $10\times10^4$ and a glass transition point (Tg) of from 10° to 80° C. obtained by copolymerization of a (meth)acrylate monomer and other monomers in the presence of fumaric acid and a copolymer composed of a (meth)acrylate monomer and a copolymerizable monomer other than fumaric acid, JP-A-53-54027 discloses a terpolymer containing a (meth)acrylic acid ester unit with a substituent having a carboxylic acid group at least 7 atoms apart from the ester linkage, JPA-54-20735 and JP-A-57-202544 disclose a tetra- or pentapolymer containing an acrylic acid unit and a hydroxyethyl (meth)acrylate unit, and JP-A-58-68046 discloses a terpolymer containing a (meth)acrylic acid ester unit with an alkyl group having from 6 to 12 carbon atoms as a substituent and a vinyl monomer containing a carboxyl group as effective for improving oil-desensitizing property of the photoconductive layer.

However, when the above described resins effective for improving electrostatic characteristics, moisture resistance and durability are practically used, it is found that they have problems in electrostatic characteristics, particularly charging property, dark charge retention characteristic and photosensitivity, and smoothness of the photoconductive layer, and they are still insufficient.

Also, as the result of evaluations on the binder resins which have been developed for electrophotographic lithographic printing plate precursors, it has been found that they have problems in the above-described electrostatic characteristics and background stains of prints.

For solving these problems, JP-A-63-217354 discloses a resin having a weight average molecular weight of from $10^3$ to $10^4$ and containing from 0.05 to 10% by weight of a copolymerizable component having an acidic group in the side chain of the copolymer as a binder resin, JP-A-1-100554 discloses a binder resin further containing a curable group-containing copolymerizable component together with the above-described acidic group-containing copolymerizable component, JP-A-1-102573 discloses a binder resin using a crosslinking agent together with the above-described acidic group-containing resin, JP-A-63-220149, JP-A-63-220148, and JP-A-64-564 disclose a binder resin using a high molecular weight resin having a weight average molecular weight of at least $1\times10^4$ in combination with the above-described acidic group-containing resin, and JP-A-1-102573, JP-A-2-34860, JP-A-2-40660, JP-A-2-56558 disclose a binder resin using a heat- and/or photo-curable resin, a partially crosslinked polymer or a comb-like copolymer in combination with the above-described acidic group-containing resin.

On the other hand, as other binder resins for electrophotographic light-sensitive materials for solving the above-described problems, JP-A-1-70761 discloses a binder resin using a resin having a weight average molecular weight of from $1\times10^3$ to $1\times10^4$ having an acidic group at the terminal of the polymer main chain, JP-A-1-214865 discloses a binder resin using the above-described resin further containing a curable group-containing component as a copolymerizable component, JP-A-2-874 discloses a binder resin using a cross-linking agent together with the above-described resin, JP-A-1-280761, JP-A-1-116643, and JP-A-1-169455 disclose a binder resin using a high molecular weight resin having a weight average molecular weight of at least $1\times10^4$ in combination with the above-described resin, and JP-A-2-34859, JP-A-2-96766 and JP-A-2-103056 disclose a binder resin using a heat- and photo-curable resin, a partially crosslinked polymer or a comb-like copolymer in combination with the above-described resin.

However, it has been found that these resins still have problems in maintenance of the stable high performance when the electrophotographic light-sensitive materials are exposed to noticeably severe conditions.

More specifically, it has been found that, when a charging speed is increased in a charging step of the light-sensitive material, uneven charging occurs, which results in causing unevenness in the duplicated images, or, when a duplicating operation is carried out immediately after irradiating the surface of the electrophotographic light-sensitive material with light such as that of a fluorescent lamp, as a supplemental operation for a copying machine, the duplicated images obtained are deteriorated (in particular, decrease in image density, lowering of resolving power, and the occurrence of background fog) (so-called pre-exposure fatigue).

Furthermore, when the electrophotographic light-sensitive material described above is used as a lithographic printing plate precursor by an electrophotographic system, the resulting printing plate has the duplicated images of deteriorated image quality in the case of carrying out the duplication under the above-described condition, and, when printing is conducted using the plate, serious problems may occur such as degradation of image quality and the occurrence of background stains.

SUMMARY OF THE INVENTION

The present invention has been made for solving the above described problems of conventional electrophotographic light-sensitive materials.

An object of the present invention is, therefore, to provide a CPC electrophotographic light-sensitive material having improved electrostatic charging characteristics and pre-exposure fatigue resistance.

Another object of the present invention is to provide a lithographic printing plate precursor by an electrophotographic system capable of providing a number of prints having clear images.

Other objects of the present invention will become apparent from the following description and examples.

It has now been found that the above-described objects of the present invention are accomplished by an electrophotographic light-sensitive material comprising a support having provided thereon a photoconductive layer containing at least an inorganic photoconductive substance, a spectral sensitizer and a binder resin, wherein the binder resin contains (1) at least one resin (Resin (A)) having a weight average molecular weight of from $1\times10^3$ to $1\times10^4$ which contains at least 30% by weight of a polymer component represented by the general formula (I) described below and from 0.1 to 10% by weight of a polymer component containing at least one acidic group selected from $-PO_3H_2$, $-SO_3H$, $-COOH$,

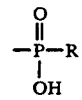

(wherein R represents a hydrocarbon group) or $-OR'$ (wherein R' represents a hydrocarbon group) and a cyclic acid anhydride-containing group, and which has at least one acidic group selected from the above-described acidic groups at one terminal of the main chain of the copolymer;

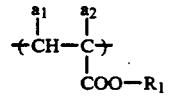

(I)

wherein $a_1$ and $a_2$ each represents a hydrogen atom, a halogen atom, a cyano group or a hydrocarbon group; and $R_1$ represents a hydrocarbon group; and (2) at least one copolymer (Resin (B)) formed from at least a monofunctional macromonomer (MB) having a weight average molecular weight of not more than $2\times10^4$ and a monomer represented by the general formula (V) described below, the macromonomer (MB) comprising at least a polymer component corresponding to a repeating unit represented by the general formula (IVa) or (IVb) described below, and the macromonomer (MB) having a polymerizable double bond group represented by the general formula (III) described below bonded to only one terminal of the main chain thereof;

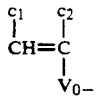

(III)

wherein $V_0$ represents —COO—, —OCO—, —$CH_2OCO$—, —$CH_2COO$—, —O—, —$SO_2$—, —CO—, —CONHCOO—, CONHCONH—, —$CONHSO_2$—,

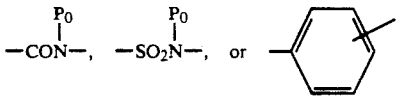

(wherein $P_0$ represents a hydrogen atom or a hydrocarbon group); and $c_1$ and $c_2$, which may be the same or different, each represents a hydrogen atom, a halogen atom, a cyano group, a hydrocarbon group, —COO—$Z_1$ or —COO—$Z_1$ bonded via a hydrocarbon group (wherein $Z_1$ represents a hydrocarbon group which may be substituted);

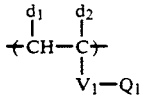

(IVa)

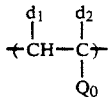

(IVb)

wherein $V_1$ has the same meaning as $V_0$ in the general formula (III); $Q_1$ represents an aliphatic group having from 1 to 18 carbon atoms or an aromatic group having from 6 to 12 carbon atoms; $d_1$ and $d_2$, which may be the same or different, each has the same meaning as $c_1$ or $c_2$ in the general formula (III); and $Q_0$ represents —CN, —$CONH_2$, or

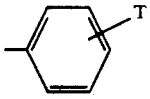

(wherein T represents a hydrogen atom, a halogen atom, a hydrocarbon group, an alkoxy group, or —$COOZ_2$ (wherein $Z_2$ represents an alkyl group, an aralkyl group, or an aryl group));

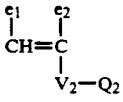

(V)

wherein $V_2$ has the same meaning as $V_1$ in the general formula (IVa); $Q_2$ has the same meaning as $Q_1$ in the general formula (IVa); and $e_1$ and $e_2$, which may be the same of different, each has the same meaning as $c_1$ or $c_2$ in the general formula (III).

DETAILED DESCRIPTION OF THE INVENTION

The binder resin which can be used in the present invention comprises at least (1) a low-molecular weight resin (hereinafter referred to as resin (A)) containing a polymer component having the specific repeating unit and a polymer component having the specific acidic group (hereinafter, the term "acidic group" used in the present invention includes a cyclic acid anhydride-containing group, unless otherwise indicated) and having an acidic group at one terminal of the polymer main chain and (2) a resin (hereinafter referred to as resin (B)) composed of a comb-like copolymer formed from at least a monofunctional macromonomer (MB) which comprises at least a polymer component corresponding to a repeating unit represented by the above described general formula (IVa) or (IVb) and has polymerizable double bond group bonded to only one terminal of the main chain thereof and a monomer represented by the general formula (V).

As described above, it is known that a resin containing an acidic group-containing polymerizable component and a resin having an acidic group at the terminal of the main chain thereof are known as a binder resin for an electrophotographic light-sensitive material, but, as described in the present invention, it has been surprisingly found that the above-described problems in conventional techniques can be first solved by using the resin having the acidic groups not only in the side chain of the polymer but also at the terminal of the polymer main chain.

According to a preferred embodiment of the present invention, the low-molecular weight resin (A) is a low molecular weight resin (hereinafter sometimes referred to as resin (A')) having the acidic group at the terminal and containing the acidic group-containing component and a methacrylate component having a specific substituent containing a benzene ring or a naphthalene ring represented by the following general formula (IIa) or (IIb): 0

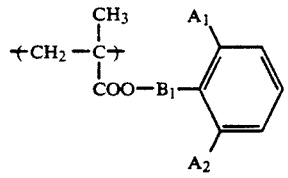

(IIa)

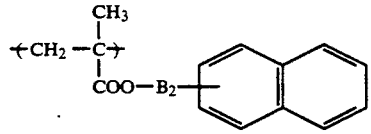

(IIb)

wherein $A_1$ and $A_2$ each represents a hydrogen atom, a hydrocarbon group having from 1 to 10 carbon atoms, a chlorine atom, a bromine atom, —$COD_1$ or —$COOD_2$, wherein $D_1$ and $D_2$ each represents a hydrocarbon group having from 1 to 10 carbon atoms; and $B_1$ and $B_2$ each represents a mere bond or a linking group containing from 1 to 4 linking atoms, which connects —COO— and the benzene ring.

In the present invention, it has been found that, in the dispersion system containing at least an inorganic photoconductive substance and a spectral sensitizer, the low-molecular weight resin (A) effectively adsorbs onto the stoichiometric defects of the photoconductive substance without hindering the adsorption of the spectral sensitizer onto the inorganic photoconductive substance, can adequately improve the coating property on the surface of the photoconductive substance, compensates the traps of the photoconductive substance, ensures the sensitivity increasing effect of the photoconductive substance with the spectral sensitizer, greatly improves the moisture resistance, and further sufficiently disperses the photoconductive substance to inhibit the occurrence of aggregation of the photoconductive substance.

Also, the resin (B) serves to sufficiently highten the mechanical strength of the photoconductive layer which may be insufficient in case of using the resin (A) alone, without damaging the excellent electrophotographic characteristics attained by the use of the resin (A). Further, the excellent image forming performance can be maintained even when the environmental conditions are greatly changed as described above or in the case of conducting a scanning exposure system using a laser beam of low power.

It is believed that, by specifying the weight average molecular weight of each of the resin (A) and the resin (B) and the contents and the positions of the acidic groups bonded in the resins as the binder resin for the inorganic photoconductive substance according to the present invention, the strength of the interaction of the inorganic photoconductive substance, spectral sensitizer and resins can be properly changed in the dispersed state of these components and the dispersion state can be stably maintained.

Thus, it is believed that, for the reasons described above, the electrostatic charging characteristics are improved, uneven charging does not occur, and the pre-exposure fatigue resistance is improved.

In case of using the resin (A'), the electrophotographic characteristics, particularly, $V_{10}$, DRR and $E_{1/10}$ of the electrophotographic material can be furthermore improved as compared with the use of the resin (A). While the reason for this fact is not fully clear, it is believed that the polymer molecular chain of the resin (A') is suitably arranged on the surface of inorganic photoconductive substance such as zinc oxide in the layer depending on the plane effect of the benzene ring or the naphthalene ring which is an ester component of the methacrylate whereby the above described improvement is achieved.

The monofunctional macromonomer (MB) of the resin (B) according to the present invention can be a macromonomer (hereinafter sometimes referred to as macromonomer (MBX)) which further contains at least one component containing at least one polar group selected from —COOH, $—PO_3H_2$, $—SO_3H$, —OH,

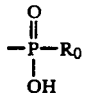

(wherein $R_0$ represents a hydrocarbon group or $—OR_0'$ (wherein $R_0'$ represents a hydrocarbon group)), —CHO and a cyclic acid anhydride-containing group, as a copolymer component, in addition to the copolymer component corresponding to the repeating unit represented by the general formula (IVa) or (IVb).

According to another preferred embodiment of the present invention, the resin (B) is a resin (hereinafter sometimes referred to as resin (B')) of a comb-like copolymer further having at least one polar group selected from $—PO_3H_2$, $—SO_3H$, —COOH, —OH, —SH,

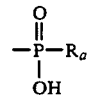

(wherein $R_a$ represents a hydrocarbon group or $—OR_a'$ (wherein $R_a'$ represents a hydrocarbon group)) bonded to the only one terminal of the main chain of the polymer.

When the resin (B') is employed, the electrostatic characteristics, particularly, DRR and $E_{1/10}$ of the electrophotographic material are further improved without damaging the excellent characteristics due to the resin (A), and these preferred characteristics are almost maintained in the case of greatly changing the environmental conditions from high temperature and high humidity to low temperature and low humidity. Moreover, the film strength is further improved and the printing durability is also increased.

Also, in the present invention, the smoothness of surface of the photoconductive layer can be improved. When an electrophotographic light-sensitive material having a photoconductive layer of rough surface is used as a lithographic printing plate precursor by an electrophotographic system, since the dispersion state of inorganic particles as a photoconductive substance and a binder resin is improper and the photoconductive layer is formed in a state containing aggregates thereof, whereby when the photoconductive layer is subjected to an oil-desensitizing treatment with an oil-desensitizing solution, the non-image areas are not uniformly and sufficiently rendered hydrophilic to cause attaching of printing ink at printing, which results in causing background stains at the non-image portions of the prints obtained.

In the case of using the binder resin according to the present invention, the interaction of the adsorption and coating of the inorganic photoconductive substance and the binder resin is adequately performed, and the film strength of the photoconductive layer is maintained.

Moreover, since the deterioration of the image quality and the formation of the background fog caused by uneven charging or pre-exposure fatigue do not occur, prints having remarkably excellent images can be obtained when the electrophotographic light-sensitive material of the present invention is used as a lithographic printing plate precursor.

Now, the resin (A) which can be used in the present invention will be explained in greater detail below.

In the resin (A), the weight average molecular weight is from $1\times10^3$ to $1\times10^4$, and preferably from $3\times10^3$ to $8\times10^3$, the content of the polymer component corresponding to the repeating unit represented by the general formula (I) is at least 30% by weight, and preferably from 50 to 97% by weight. The total content of the acidic groups in the acidic group-containing copolymer component and the acidic group bonded to the terminal of the main chain is preferably from 1 to 20% by weight. Furthermore, the content of the copolymer component containing the acidic group is preferably from 0.1 to 10% by weight, and more preferably from 0.5 to 8% by weight, and the content of the acidic group bonded to the terminal of the main chain is preferably from 0.5 to 15% by weight, and more preferably from 1 to 10% by weight.

Also, the content of the copolymer component of the methacrylate corresponding to the repeating unit represented by the general formula (IIa) and/or (IIb) in the resin (A') is at least 30% by weight, and preferably from 50 to 97% by weight, and the content of the copolymer component containing the acidic group is preferably from 0.1 to 10% by weight, and more preferably from 0.5 to 8% by weight. Also, the content of the acidic group bonded to the terminal of the polymer chain is preferably from 0.5 to 15% by weight, and more preferably from 1 to 10% by weight.

The glass transition point of the resin (A) is preferably from −20° C. to 110° C., and more preferably from −10° C. to 90° C.

If the molecular weight of the resin (A) is less than $1\times10^3$, the film-forming property thereof is reduced, and a sufficient film strength cannot be maintained. On the other hand, if the molecular weight of the resin (A) is higher than $1\times10^4$, the fluctuations of the electrophotographic characteristics (charging property and pre-exposure fatigue resistance) under the above-described severe conditions become somewhat larger, and the effect of the present invention for obtaining stable duplicated images is reduced.

If the total content of the acidic groups in the resin (A) is less than 1% by weight, the initial potential is low and a sufficient image density cannot be obtained. On the other hand, if the total acidic group content is larger than 20% by weight, the dispersibility is reduced even if the molecular weight of the resin (A) is low, the smoothness of the layer and the electrophotographic characteristics at high humidity are reduced, and further, when the light-sensitive material is used as an offset master plate, the occurrence of background stains is increased.

The resin (A) used in the present invention contains at least one repeating unit represented by the general formula (I) as a polymer component as described above.

In the general formula (I), $a_1$ and $a_2$ each represents a hydrogen atom, a halo9en atom (e.g., chlorine and bromine), a cyano group or a hydrocarbon group, preferably including an alkyl group having from 1 to 4 carbon atoms (e.g., methyl, ethyl, propyl and butyl). $R_1$ preferably represents an alkyl group having from 1 to 18 carbon atoms which may be substituted (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2 ethoxyethyl, and 3-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), or an aryl group which may be substituted (e.g., phenyl, tolyl, xylyl, mesityl, naphthyl, methoxyphenyl, ethoxyphenyl, fluorophenyl, difluorophenyl, bromophenyl, chlorophenyl, dichlorophenyl, iodophenyl, methoxycarbonylphenyl, ethoxycarbonylphenyl, cyanophenyl, and nitrophenyl).

More preferably, the polymerizable component corresponding to the repeating unit represented by the general formula (I) is a methacrylate component having the specific aryl group represented by the general formula (IIa) and/or (IIb) (Resin (A')) described above.

In the general formula (IIa), $A_1$ and $A_2$ each preferably represents a hydrogen atom, a chlorine atom, a bromine atom, a hydrocarbon group (preferably, an alkyl group having from 1 to 4 carbon atoms (e.g., methyl, ethyl, propyl, and butyl), an aralkyl group having from 7 to 9 carbon atoms which may be substituted (e.g., benzyl, phenethyl, 3-phenylpropyl, chlorobenzyl, dichlorobenzyl, bromobenzyl, methylbenzyl, methoxybenzyl, and chloromethylbenzyl), an aryl group which may be substituted (e.g., phenyl, tolyl, xylyl, bromophenyl, methoxyphenyl, chlorophenyl, and dichlorophenyl)), $—COD_1$ or $—COOD_2$, wherein $D_1$ and $D_2$ each preferably represent any of the above-recited hydrocarbon groups as preferred hydrocarbon groups for $A_1$ and $A_2$.

In the general formula (IIa), $B_1$ is a mere bond or a linking group containing from 1 to 4 linking atoms, e.g., $-(CH_2)_{n1}$ ($n_1$ represents an integer of 1, 2 or 3), $—CH_2OCO—$, $—CH_2CH_2OCO—$, $-(CH_2O)_{n2}$ ($n_2$ represents an integer of 1 or 2), and $—CH_2CH_2O—$, which connects —COO— and the benzene ring.

In the general formula (IIb), $B_2$ has the same meaning as $B_1$ in the general formula (Ia).

Specific examples of the copolymerizable component corresponding to the repeating unit represented by the general formula (IIa) or (IIb) which can be used in the resin (A') according to the present invention are described below, but the present invention should not be construed as being limited thereto. In the following formulae, $X_1$ and $X_2$ each represent Cl, Br or I; $R_{11}$ represents $—C_aH_{2a+1}$ or

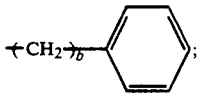

a represents an integer of from 1 to 4; b represents an integer of from 0 to 3; and c represents an integer of from 1 to 3.

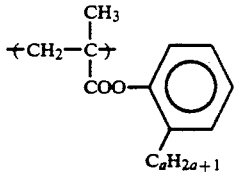

i-1)

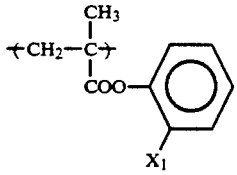

i-2)

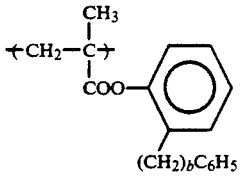

i-3)

-continued
i-4)
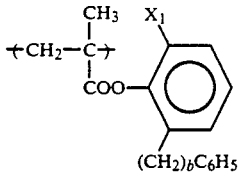
i-5)
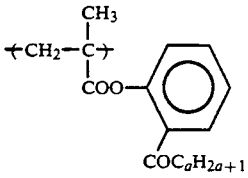
i-6)
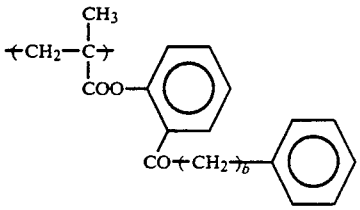
i-7)
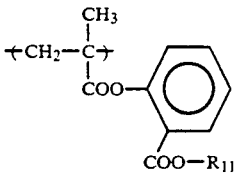
i-8)
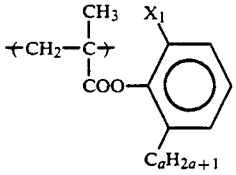
i-9)
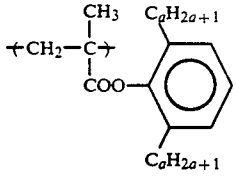
i-10)
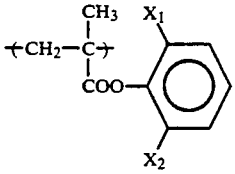
i-11)
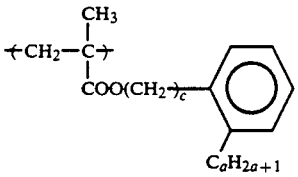
-continued
i-12)
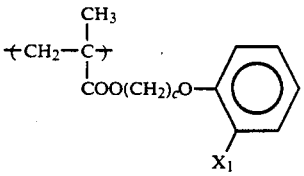
i-13)
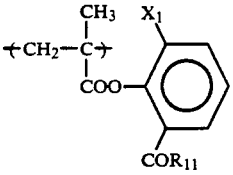
i-14)
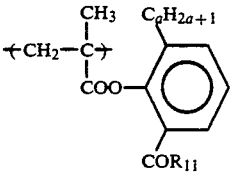
i-15)
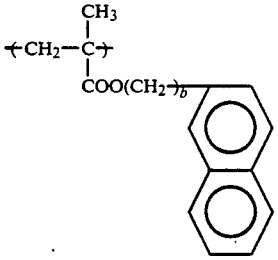
i-16)
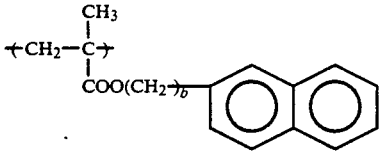
i-17)
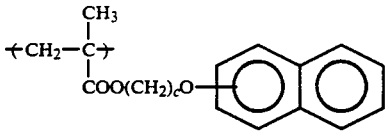
i-18)
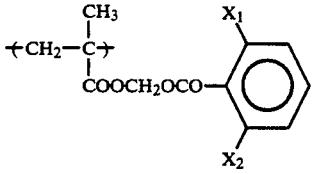
i-19)
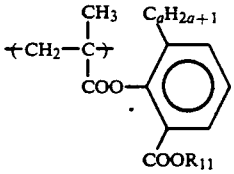

-continued

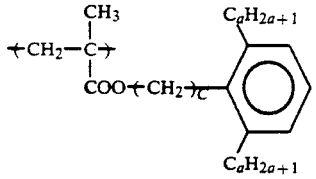

i-20)

As a copolymerizable component corresponding to the repeating unit containing the acidic group contained in the resin (A) used in the present invention, any vinyl compound, having the acidic group capable of copolymerization with the monomer corresponding to the repeating unit represented by the general formula (I) (including the repeating unit represented by the general formula (IIa) or (IIb)) may be used.

For example, such vinyl compounds are described in *Macromolecular Data Handbook* (*Foundation*), edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the acidic group in the substituent thereof.

In the

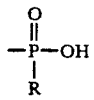

group as an acidic group, R represents a hydrocarbon group or a —OR′ group (wherein R′ represents a hydrocarbon group), and, preferably, R and R′ each represents an aliphatic group having from 1 to 22 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphtnalenedicarboxylic acid anhydride ring, pyridinedicarboxylic acid anhydride ring and thiophenedicarboxyic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

Specific examples of the copolymerizable components having the acidic group are illustrated below, but the present invention should not be construed a being limited thereto.

In the following formulae, $P_1$ represents H or $CH_3$; $P_2$ represents H, $CH_3$, or $CH_2COOCH_3$; $R_{12}$ represents an alkyl group having from 1 to 4 Carbon atoms; $R_{13}$ represents an alkyl group having from 1 to 6 carbon atoms, a benzyl group, or a phenyl group; c represents an integer of from 1 to 3; d represents an integer of from 2 to 11; e represents an integer of from 1 to 11; f represents an integer of from 2 to 4; and g represents an integer of from 2 to 10.

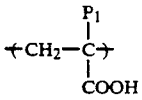

ii-1)

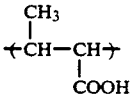

ii-2)

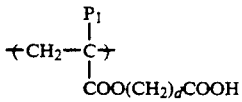

ii-3)

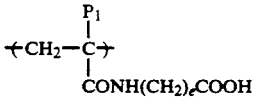

ii-4)

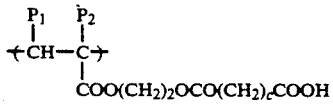

ii-5)

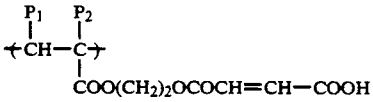

ii-6)

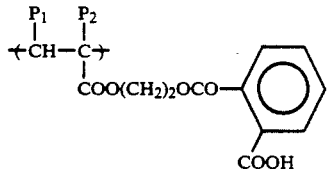

ii-7)

-continued
ii-8)
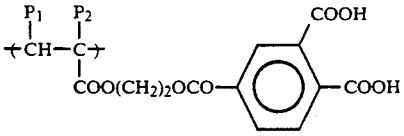
ii-9)
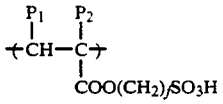
ii-10)
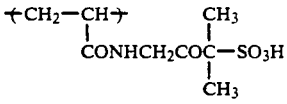
ii-11)
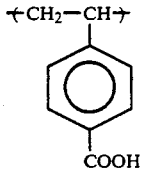
ii-12)
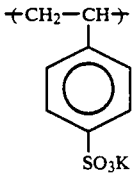
ii-13)
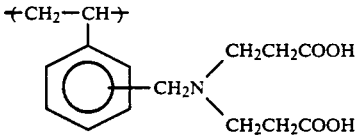
ii-14)
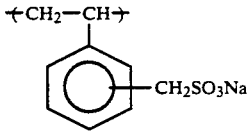
ii-15)
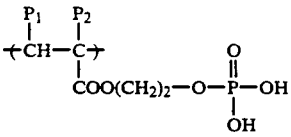
ii-16)
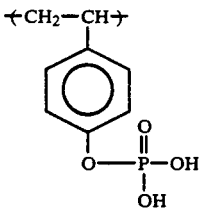
ii-17)
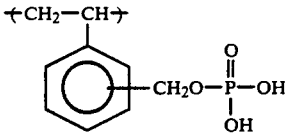
-continued
ii-18)
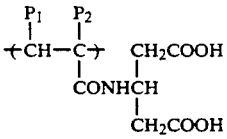
ii-19)
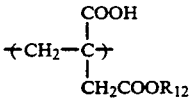
ii-20)
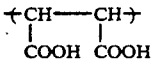
ii-21)
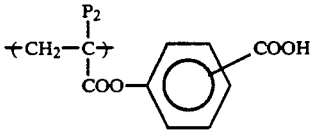
ii-22)
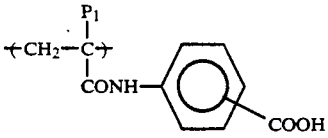
ii-23)
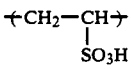
ii-24)
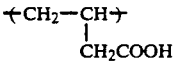
ii-25)
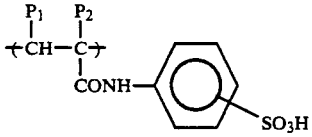
ii-26)
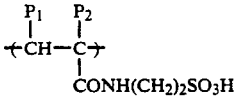
ii-27)
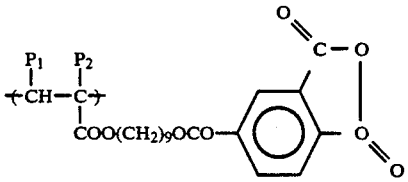
ii-28)
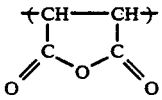
ii-29)
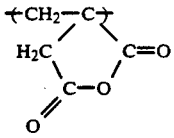

-continued ii-30)

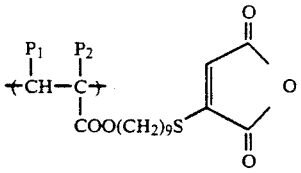

ii-32)

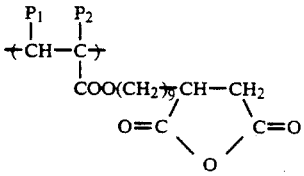

ii-33)

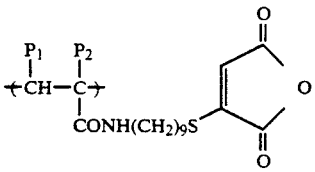

ii-34)

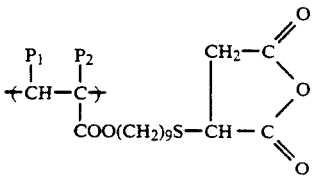

ii-35)

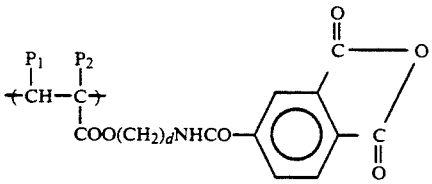

ii-36)

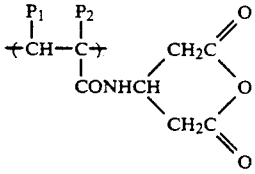

ii-37)

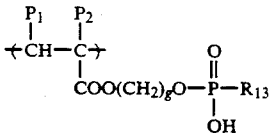

ii-38)

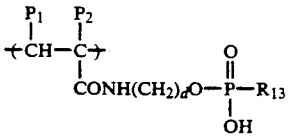

In the resin (A), the above-described acidic group contained in the copolymer component of the polymer may be the same as or different from the acidic group bonded to the terminal of the polymer main chain.

The acidic group which is bonded to one of the terminals of the polymer main chain in the resin (A) according to the present invention includes $-PO_3H_2$, $-SO_3H$, $-COOH$,

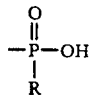

(wherein R is as defined above), and a cyclic acid anhydride-containing group.

The above-described acidic group may be bonded to one of the polymer main chain terminals either directly or via an appropriate linking group.

The linking group can be any group for connecting the acidic group to the polymer main chain terminal. Specific examples of suitable linking group include

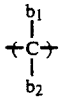

(wherein $b_1$ and $b_2$, which may be the same or different, each represents a hydrogen atom, a halogen atom (e.g., chlorine, and bromine), a hydroxyl group, a cyano group, an alkyl group (e.g., methyl, ethyl, 2-chloroethyl, 2-hydroxyethyl, propyl, butyl, and hexyl), an aralkyl group (e.g., benzyl, and phenethyl), an aryl group (e.g., phenyl)),

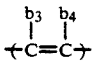

(wherein $b_3$ and $b_4$ each has the same meaning as defined for $b_1$ or $b_2$ above),

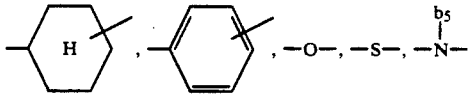

(wherein $b_5$ represents a hydrogen atom or a hydrocarbon group preferably having from 1 to 12 carbon atoms (e.g., methyl, ethyl, propyl, butyl, hexyl, octyl, decyl, dodecyl, 2-methoxyethyl, 2-chloroethyl, 2-cyanoethyl, benzyl, methylbenzyl, chlorobenzyl, methoxybenzyl, phenethyl, phenyl, tolyl, chlorophenyl, methoxyphenyl, and butylphenyl), —CO—, —COO—, —OCO—,

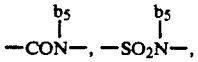

$-SO_2-$, —NHCONH—, —NHCOO—, $-NHSO_2-$, —CONHCOO—, —CONHCONH—, a heterocyclic ring (preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine, and morpholine)),

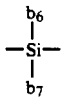

(wherein $b_6$ and $b_7$, which may be the same or different, each represents a hydrocarbon group or —$Ob_8$ (wherein $b_8$ represents a hydrocarbon group)), and a combination thereof. Suitable example of the hydrocarbon group represented by $b_6$, $b_7$ or $b_8$ include those described for $b_5$.

The resin (A) according to the present invention may further comprise other copolymerizable monomers as copolymerizable components in addition to the monomer corresponding to the repeating unit of the general formula (I) (including that of the general formula (IIa) or (IIb)) and the monomer containing the acidic group. Examples of such monomers include, in addition to methacrylic acid esters, acrylic acid esters and crotonic acid esters containing substituents other than those described for the general formula (I), α-olefins, vinyl or allyl esters of alkanoic acids (including, e.g., acetic acid, propionic acid, butyric acid, and valeric acid, as examples of the alkanoic acids), acrylonitrile, methacrylonitrile, vinyl ethers, itaconic acid esters (e.g., dimethyl ester, and diethyl ester), acrylamides, methacrylamides, styrenes (e.g., styrene, vinyltoluene, chlorostyrene, hydroxystyrene, N,N-dimethylaminomethylstyrene, methoxycarbonylstyrene, methanesulfonyloxystyrene, and vinylnaphthalene), and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine).

The resin (A) according to the present invention, in which the specific acidic group is bonded to only one terminal of the polymer main chain, can easily be prepared by an ion polymerization process, in which a various kind of reagents are reacted at the terminal of a living polymer obtained by conventionally known anion polymerization or cation polymerization; a radical polymerization process, in which radical polymerization is performed in the presence of a polymerization initiator and/or a chain transfer agent which contains the specific acidic group in the molecule thereof; or a process, in which a polymer having a reactive group (for example, an amino group, a halogen atom, an epoxy group, and an acid halide group) at the terminal obtained by the above-described ion polymerization or radical polymerization is subjected to a macromolecular reaction to convert the terminal reactive group into the specific acidic group.

More specifically, reference can be made to, e.g., P. Dreyfuss and R. P. Quirk, *Encycl. Polym. Sci. Eng.*, 7, 551 (1987), Yoshiki Nakajo and Yuya Yamashita, Senryo to Yakuhin, 30, 232 (1985), Akira Ueda and Susumu Nagai, *Kagaku to Kogyo*, 60, 57 (1986) and literature references cited therein.

Specific examples of chain transfer agents which can be used include mercapto compounds containing the acidic group or the reactive group capable of being converted into the acidic group (e.g., thioglycolic acid, thiomalic acid, thiosalicyclic acid, 2-mercaptopropionic acid, 3-mercaptopropionic acid, 3-mercaptobutyric acid, N-(2 mercaptopropionyl)glycine, 2-mercaptonicotinic acid, 3-[N-(2-mercaptoethyl)-carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mecaptobutanesulfonic acid, 2-mercaptoethanol, 1-mercapto-2-propanol, 3-mercapto-2-butanol, mercaptophenol, 2-mercaptoethylamine, 2-mercaptoimidazole, 2-mercapto-3-pyridinol, 4-(2-mercaptoethyloxycarbonyl)phthalic anhydride, 2-mercaptoethylphosphonic acid, and monomethyl 2-mercaptoethylphosphonate), and alkyl iodide compounds containing the acidic group or acidic group-forming reactive group (e.g., iodoacetic acid, iodopropionic acid, 2-iodoethanol, 2-iodoethanesulfonic acid, and 3-iodopropanesulfonic acid). Of these compounds, mercapto compounds are preferred.

Specific examples of the polymerization initiators containing the acidic group or reactive group include 4,4'-azobis(4-cyanovaleric acid), 4,4'-azobis(4-cyanovaleric acid chloride), 2,2'-azobis(2-cyanopropanol), 2,2'-azobis(2-cyanopentanol), 2,2'-azobis[2-methyl-N-(2-hydroxyethyl)propionamide], 2,2'-azobis){2-methyl-N-[1,1-bis(hydroxymethyl)-2-hydroxyethyl]propionamide}, 2,2'-azobis[2-[1-(2-hydroxyethyl)-2-imidazolin-2-yl]propane}, 2,2'-azobis[2-(2-imidazolin-2-yl)propane], and 2,2'-azobis[2-(4,5,6,7-tetrahydro-1H-1,3-diazepin-2-yl)propane].

The chain transfer agent or polymerization initiator is usually used in an amount of from 0.5 to 15 parts by weight, preferably from 2 to 10 parts by weight, per 100 parts by weight of the total monomers.

Now, the resin (B) used in the present invention will be described in greater detail below.

The resin (B) is a resin of a graft-type copolymer meeting the above described properties and formed from at least one monofunctional macromonomer (MB) and at least one monomer represented by the general formula (V) described above.

The resin (B) is a graft-type copolymer resin having a weight average molecular weight of at least $3\times10^4$, and preferably from $5\times10^4$ to $3\times10^5$.

The glass transition point of the resin (B) is in the range of preferably from 0° C. to 120° C., and more preferably from 10° C. to 90° C.

The monofunctional macromonomer (MB) which is a copolymerizable component used in forming the resin (B) is described hereinafter in greater detail.

The monofunctional macromonomer (MB) is a macromonomer having a weight average molecular weight of not more than $2\times10^4$, comprising at least one polymer component corresponding to a repeating unit represented by the general formula (IVa) or (IVb) described above, and having a polymerizable double bond group represented by the general formula (III) bonded to only one terminal of the main chain thereof.

In the above described general formulae (III), (IVa), and (IVb), the hydrocarbon groups represented by or included in $c_1$, $c_2$, $V_0$, $d_1$, $d_2$, $V_1$, $Q_1$, and $Q_0$ each has the number of carbon atoms described above (as unsubstituted hydrocarbon group) and these hydrocarbon groups may have one or more substituents.

In the general formula (III), $V_0$ represents COO—, —OCO—, —$CH_2$OCO—, —$CH_2$COO—, —O—, —$SO_2$—, —CO—, —CONHCOO—, —CONHCONH—, —$CONHSO_2$—,

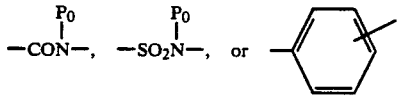

wherein $P_0$ represents a hydrogen atom or a hydrocarbon group, and preferred examples of the hydrocarbon group include an alkyl group having from 1 to 18 carbon atoms which may be substituted (e.g., methyl, ethyl, propyl, butyl, pentyl, hexyl, heptyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

When $V_0$ represents

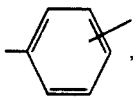

the benzene ring may have a substituent such as, for example, a halogen atom (e.g., chlorine and bromine), an alkyl group (e.g., methyl, ethyl, propyl, butyl, chloromethyl, methoxymethyl) and an alkoxy group (e.g., methoxy, ethoxy, propoxy, and butoxy).

In the general formula (III), $c_1$ and $c_2$, which may be the same or different, each preferably represents a hydrogen atom, a halogen atom (e.g., chlorine and bromide), a cyano group, an alkyl group having from 1 to 4 carbon atoms (e.g., methyl, ethyl, propyl, and butyl), —COO—$Z_1$, or —COO$Z_1$ bonded via a hydrocarbon group (wherein $Z_1$ represents preferably an alkyl group an alkenyl group, an aralkyl group, an alicyclic group or an aryl group, these groups may be substituted, and specific examples thereof are the same as those described above for $P_0$).

In the general formula (III), —COO—$Z_1$ may be bonded via a hydrocarbon group as above, and examples of such hydrocarbon groups include a methylene group, an ethylene group, and a propylene group.

In the general formula (III), $V_0$ is more preferably —COO—, —OCO—, —$CH_2$OCO—, —$CH_2$COO—, —O—, —CONHCOO—, —CONHCONH—, —CONH—, $SO_2$NH—, or 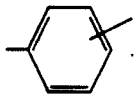

Also, $c_1$ and $c_2$, which may be the same or different, each represents more preferably a hydrogen atom, a methyl group, —COO$Z_1$, or —$CH_2$COO$Z_1$ (wherein $Z_1$ represents more preferably an alkyl group having from 1 to 6 carbon atoms (e.g., methyl, ethyl, propyl, butyl, and hexyl)). Most preferably, one of $c_1$ and $c_2$ represents a hydrogen atom.

That is, specific examples of the polymerizable double bond group represented by the general formula (III) include

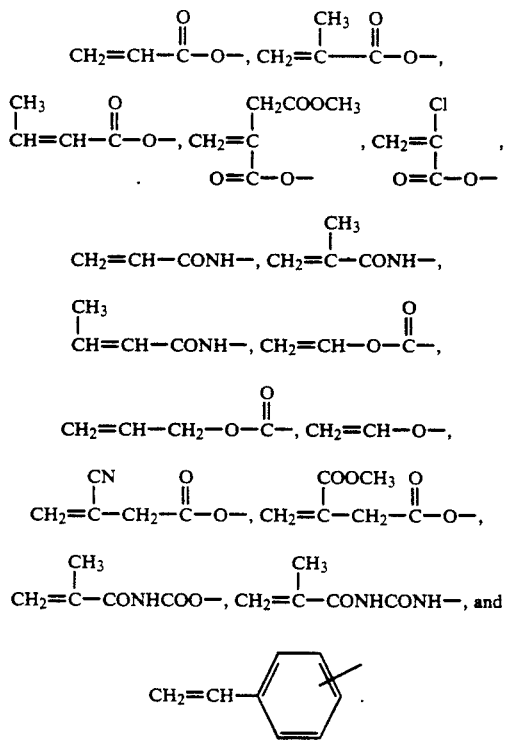

In the general formula (IVa), $V_1$ has the same meaning as $V_0$ in the general formula (III), and $d_1$ and $d_2$, which may be the same or different, each has the same meaning as $c_1$ or $c_2$ in the general formula (III).

$Q_1$ represents an aliphatic group having from 1 to 18 carbon atoms or an aromatic group having from 6 to 12 carbon atoms.

Specific examples of the aliphatic group include an alkyl group having from 1 to 18 carbon atoms which may be substituted (e.g., methyl, ethyl, propyl, butyl, pentyl, hexyl, heptyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloropropyl, 2-(trimethoxysilyl)ethyl, 2-tetrahydrofuryl, 2-thienylethyl, 2-N,N-dimethylaminoethyl, and 2-N,N-diethylaminoethyl), a cycloalkyl group having from 5 to 8 carbon atoms which may be substituted (e.g., cyclopentyl, cyclohexyl, and cyclooctyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, dichlorobenzyl, methylbenzyl, chloromethylbenzyl, dimethylbenzyl, trimethylbenzyl, and methoxybenzyl). Also, specific examples of the aromatic group include an aryl group having from 6 to 12 carbon atoms which may be substituted (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl).

In the general formula (IVa), $V_1$ represents preferably —COO—, —OCO—, —$CH_2$COO—, —$CH_2$OCO—, —O—, —CO—, —CONHCOO—, —CONHCONH—, —CONH—, —$SO_2$NH—,

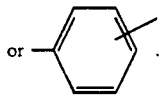

Also, preferred examples of $d_1$ and $d_2$ are same as those described above for $c_1$ and $c_2$ in the general formula (III).

In the general formula (IVb), $Q_0$ represents —CN, —$CONH_2$, or

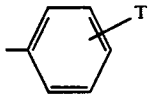

(wherein T represents a hydrogen atom, a halogen atom (e.g., chlorine and bromine), a hydrocarbon group (e.g., methyl, ethyl, propyl, butyl, chloromethyl, and phenyl), an alkoxy group (e.g., methoxy, and ethoxy), or —$COOZ_2$ (wherein $Z_2$ represents an alkyl group having from 1 to 8 carbon atoms, an aralkyl group having from 7 to 12 carbon atoms or an aryl group)).

The monofunctional macromonomer (MB) used in the present invention may have two or more polymer components represented by the general formula (IVa) and/or the polymerizable components represented by the general formula (IVb).

Furthermore, when $V_1$ in the general formula (IVa) is —COO—, it is preferred that the proportion of the polymer component represented by the general formula (IVa) is at least 30% by weight of the whole polymer components in the macromonomer (MB).

As described above, the monofunctional macromonomer (MB) can contain a component having the specific polar group (—COOH, —$PO_3H_2$, —$SO_3H$, —OH,

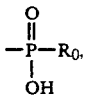

—CHO or a cyclic acid anhydride-containing group) as a copolymerizable component in addition to the copolymer component represented by the general formula (IVa) or (IVb) (macromonomer (MBX)). As the polar group-containing component, any vinyl compounds having the above described polar group capable of copolymerization with the copolymerizable monomer corresponding to the component represented by the general formula (IVa) or (IVb) can be used.

Examples of these vinyl compounds are described, for example, in *Kobunshi Data Handbook* (*Kisohen*), edited by Kobunshi Gakkai, Baifukan (1986).

Specific examples thereof include acrylic acid, an α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid, maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and compounds having the acidic group in the substituent of ester derivatives or amido derivatives of these carboxylic acids or sulfonic acids.

In

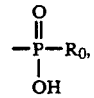

$R_0$ represents a hydrocarbon group or —$OR_0'$ and $R_0'$ represents a hydrocarbon group. Examples of these hydrocarbon groups are same as those described for R above.

With respect to the cyclic acid anhydride-containing group, those described for the resin (A) above are also applied.

The —OH group include a hydroxy group of alcohols containing a vinyl group or allyl group (e.g., allyl alcohol), a hydroxy group of (meth)acrylates containing —OH group in an ester substituent thereof, a hydroxy group of (meth)acrylamides containing —OH group in an N-substituent thereof, a hydroxy of hydroxy-substituted aromatic compounds containing a polymerizable double bond, and a hydroxy group of (meth)acrylic acid esters and amides each having a hydroxyphenyl group as a substituent.

Specific examples of the polymerizable monomer corresponding to the component having the polar group described above are set forth below, but the present invention should not be construed as being limited thereto. In the following formulae, $Q_1$ represents —H, —$CH_3$, Cl, —Br, —CN, —$CH_2COOCH_3$, or —$CH_2COOH$; $Q_2$ represents —H or —$CH_3$; j represents an integer of from 2 to 18; k represents an integer of from 2 to 5; h represents an integer of from 1 to 4; and m represents an integer of from 1 to 12.

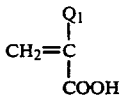

(iii-1)

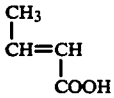

(iii-2)

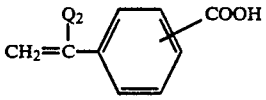

(iii-3)

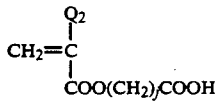

(iii-4)

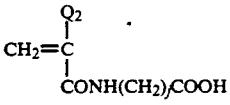

(iii-5)

-continued
(iii-6)
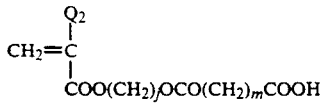
(iii-7)
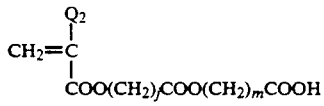
(iii-8)
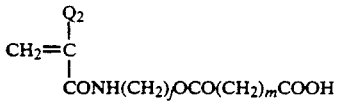
(iii-9)
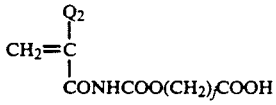
(iii-10)
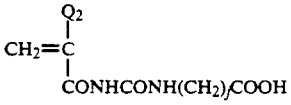
(iii-11)
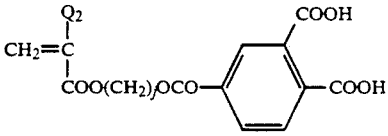
(iii-12)
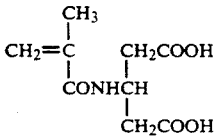
(iii-13)
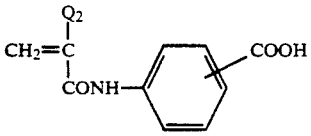
(iii-14)
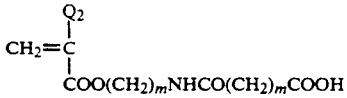
(iii-15)
$CH_2{=}CH{-}CH_2OCO(CH_2)_mCOOH$
(iii-16)
$CH_2{=}CH{+}CH_2{\rightarrow}_n COOH$
(iii-17)
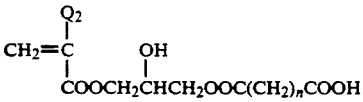
(iii-18)
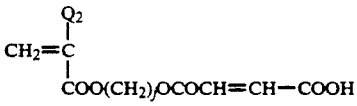
(iii-19)
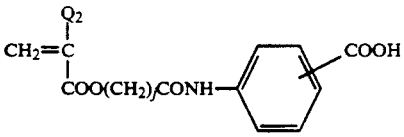
-continued
(iii-20)
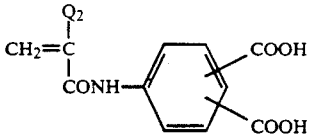
(iii-21)
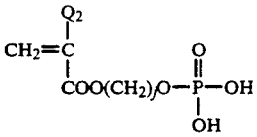
(iii-22)
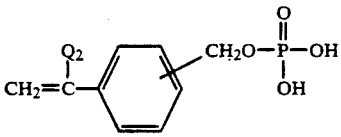
(iii-23)
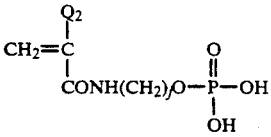
(iii-24)
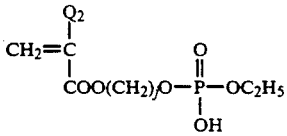
(iii-25)
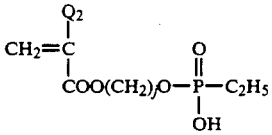
(iii-26)
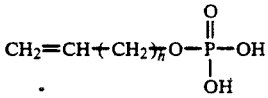
(iii-27)
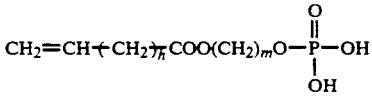
(iii-28)
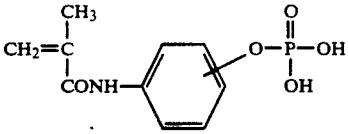
(iii-29)
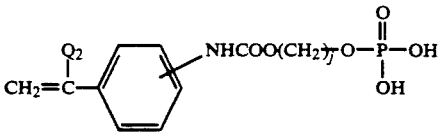
(iii-30)
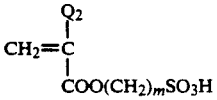
(iii-31)
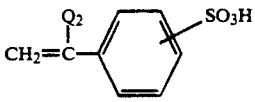

-continued
(iii-32)
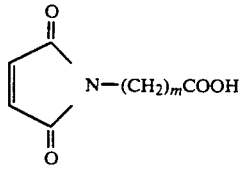
(iii-33)
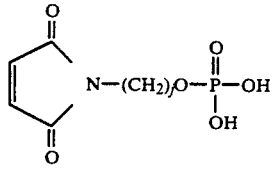
(iii-34)
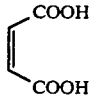
(iii-35)
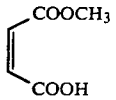
(iii-36)
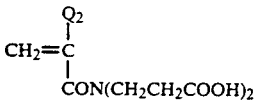
(iii-37)
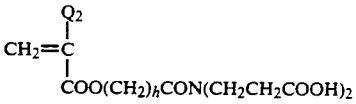
(iii-38)
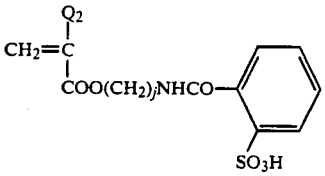
(iii-39)
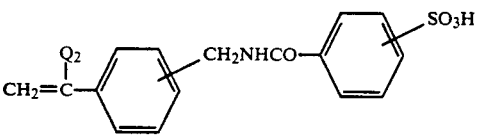
(iii-40)
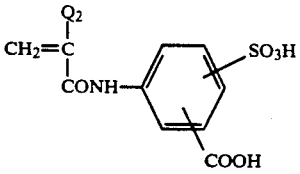
(iii-41)
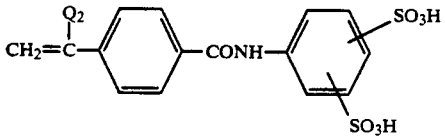
(iii-42)
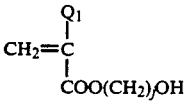
-continued
(iii-43)
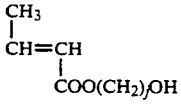
(iii-44)
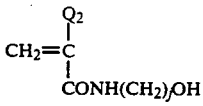
(iii-45)
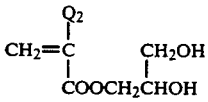
(iii-46)
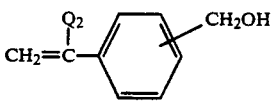
(iii-47)
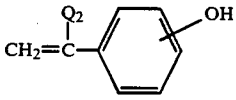
(iii-48)
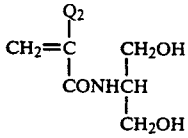
(iii-49)
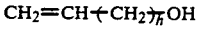
(iii-50)
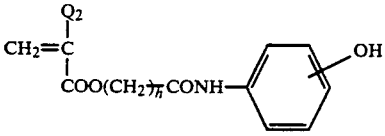
(iii-51)
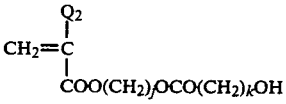
(iii-52)
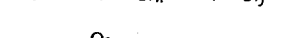
(iii-53)
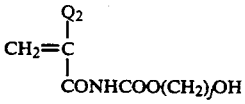
(iii-54)
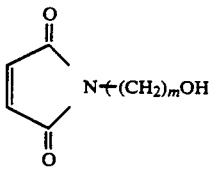
(iii-55)
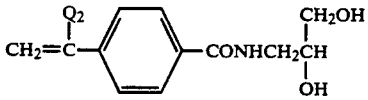
(iii-56)
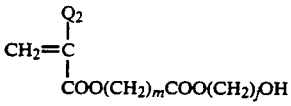

The content of the above described polymerizable component having the polar group used in forming the macromonomer (MBX) is preferably from 0.5 to 50 parts by weight, and more preferably from 1 to 40 parts by weight per 100 parts by weight of the total polymerizable components.

When the monofunctional macromonomer composed of a random copolymer having the polar group exists in the resin (B) as a copolymer component, the total content of the polar group-containing component contained in the total graft portions in the resin (B) is preferably from 0.1 to 10 parts by weight per 100 parts by weight of the total polymer components in the resin (B). When the resin (B) has the polar group selected from —COOH, —$SO_3H$, and —$PO_3H_2$, the total content of the acidic group in the graft portions of the resin (B) is more preferably from 0 1 to 5 parts by weight.

The macromonomer (MB) may further contain other copolymer component(s) in addition to the copolymer components represented by the general formula (IVa) and/or (IVb). Suitable examples of polymerizable monomers corresponding to such copolymer components include acrylonitrile, methacrylonitrile, acrylamides, methacrylamides, styrene, styrene derivatives (e.g., vinyltoluene, chlorostyrene, dichlorostyrene, bromostyrene, hydroxymethylstyrene, and N,N-dimethylaminomethylstyrene), and heterocyclic vinyl compounds (e.g., vinylpyridine, vinylimidazole, vinylpyrrolidone, vinylthiophene, vinylpyrazole, vinyldioxane, and vinyloxazine).

When the macromonomer (MB) (hereinafter, the term "macromonomer (MB)" includes the macromononer (MBX), unless otherwise indicated) contains other monomers described above, the content of the monomer is preferably from 1 to 20 parts by weight per 100 parts by weight of the total polymer components in the macromonomer.

The macromonomer (MB) which is used for the resin (B) in the present invention has a chemical structure that the polymerizable double bond group represented by the general formula (III) is bonded to only one terminal of the main chain of the polymer composed of the repeating unit represented by the general formula (IVa) and/or the repeating unit represented by the general (IVb) and optionally, the repeating unit having the above described polar group directly or by an appropriate linkage group.

The linkage group which connects the component represented by the general formula (III) with the component represented by the formula (IVa) or (IVb) or the polar group-containing component is composed of an appropriate combination of the atomic groups such as a carbon-carbon bond (single bond or double bond), a carbon-hetero atom bond (examples of the hetero atom are oxygen, sulfur, nitrogen, and silicon), and a hetero atom-hetero atom bond.

Preferred macromonomers as the macromonomer (MB) for use in the present invention are represented by the following general formula (VIa) or (VIb):

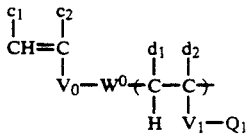

(VIa)

-continued

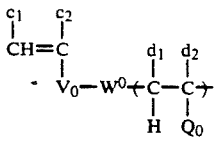

(VIb)

wherein $c_1$, $c_2$, $d_1$, $d_2$, $V_0$, $V_1$, $Q_1$, and $Q_0$ each has the same meaning as defined above for the general formulae (III), (IVa) and (IVb); $W^0$ represents a mere bond or a linkage group singly composed of the atomic group selected from

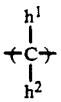

(wherein $h^1$ and $h^2$ each represents a hydrogen atom, a halogen atom (e.g., fluorine, chlorine, and bromine), a cyano group, a hydroxy group, or an alkyl group (e.g., methyl, ethyl, and propyl)), ⟨CH=CH⟩,

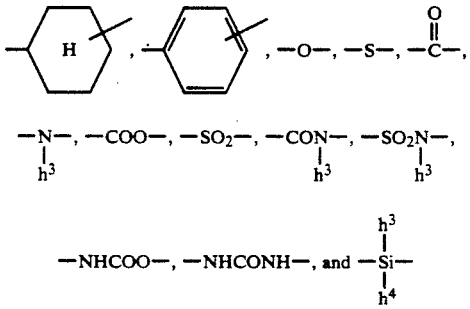

wherein $h_3$ and $h_4$ each represents a hydrogen atom or the hydrocarbon group having the same meaning as $Q_1$ in the general formula (IVa) described above) or composed of an appropriate combination of these atomic groups. (In the general formula (VIa) or (VIb), the polar group-containing component optionally present is not indicated).

If the weight average molecular weight of the macromonomer (MB) exceeds $2\times10^4$, the copolymerizability with the monomer represented by the general formula (V) is undesirably lowered. On the other hand, if the molecular weight thereof is too small, the effect for improving the electrophotographic characteristics of the photoconductive layer is reduced, and hence the molecular weight is preferably not less than $1\times10^3$.

The macromonomer (MB) which does not contain the polar group-containing component in the main chain used for the resin (B) in the present invention can be produced by a conventionally known method such as, for example, a method by an ion polymerization method, wherein a macromonomer is produced by reacting various reagents to the terminal of a living polymer obtained by an anion polymerization or a cation polymerization, a method by a radical polymerization, wherein a macromonomer is produced by reacting various reagents with an oligomer having a reactive group such as a carboxy group, a hydroxy group, or an amino group, at the terminal thereof obtained by a radical polymerization using a polymerization initiator and/or a chain transfer agent each having the reactive group in the molecule, and a method by a polyaddition condensation method of introducing a polymerizable double bond group into an oligomer obtained by a polycondensation reaction or a polyaddition reaction, in the same manner as the above described radical polymerization method.

Specific methods for producing the macromonomer (MB) are described, for example, in P. Dreyfuss & R. P. Quirk, *Encycl. Polym. Sci. Eng.*, 7, 551(1987), P. F. Rempp & E. Franta, *Adv. Polym Sci.*, 58, 1(1984), V. Percec, *Appl. Polym. Sci.*, 285, 95(1984), R. Asami & M. Takaki, *Makromol. Chem. Suppl.*, 12, 163(1985), P. Rempp et al, *Makromol. Chem. Suppl.*, 8, 3(1984), Yusuke Kawakami, *Kagaku Kogyo* (*Chemical Industry*), 38, 56(1987), Yuuya Yamashita, *Kobunshi* (*Macromolecule*), 31, 988(1982), Shio Kobayashi, *Kobunshi* (*Macromolecule*), 30, 625(1981), Toshinobu Higashimura, *Nippon Secchaku Kyokai Shi* (*Journal of Adhesive Society of Japan*), 18, 536(1982), Koichi Ito, *Kobunshi Kako* (*Macromolecule Processing*), 35, 262(1986), and Kishiro Higashi & Takashi Tsuda, *Kino Zairyo* (*Functional Materials*), 1987, No. 10, 5, and the literatures and patents cited therein.

Now, specific examples of the macromonomer (MB), which does not contain the specific polar group-containing component, for use in the present invention are set forth below, but the present invention is not to be construed as being limited thereto.

In the following formulae, $p_1$ represents —H or —$CH_3$; $p_2$ represents —H, —$CH_3$ or —$CH_2COOCH_3$; $R_{31}$ represents —$C_rH_{2r+1}$, —$CH_2C_6H_5$, —$C_6H_5$, or

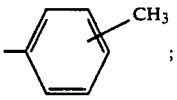

$R_{32}$ represents —$C_rH_{2r+1}$, —$CH_2)_sC_6H_5$, or

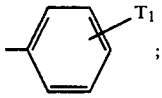

$R_{33}$ represents —$C_4H_{2r+1}$, —$CH_2C_6H_5$, or —$C_6H_5$; $R_{34}$ represents —$C_rH_{2r+1}$ or —$CH_2C_6H_5$; $R_{35}$ represents —$C_rH_{2r+1}$, —$CH_2C_6H_5$, or

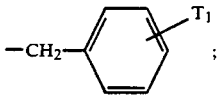

$R_{36}$ represents —$C_rH_{2r+1}$; $R_{37}$ represents —$C_rH_{2r+1}$, —$CH_2C_6H_5$, or

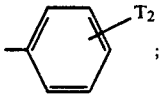

$R_{38}$ represents —$C_rH_{2r+1}$, —$CH_2C_6H_5$, or

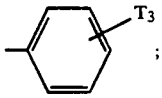

$V_1$ represents —$COOCH_3$, —$C_6H_5$, or —CN; $V_2$ represents —$OC_rH_{2r+1}$, —$OCOC_rH_{2r+1}$, —$COOCH_3$, —$C_6H_5$, or —CN; $V_3$ represents —$COOCH_3$, —$C_6H_5$,

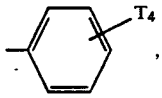

or —CN; $V_4$ represents —$OCOC_rH_{2r+1}$, —CN, —$CONH_2$, or —$C_6H_5$; $V_5$ represents —CN, —$CONH_2$, or —$C_6H_5$; $V_6$ represents —$COOCH_3$, —$C_6H_5$, or

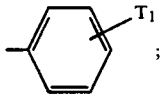

$T_1$ represents —$CH_3$, —Cl, —Br, or —$OCH_3$; $T_2$ represents —$CH_3$, —Cl, or —Br; $T_3$ represents —H, —Cl, —Br, —$CH_3$, —CN or —$COOCH_3$; $T_4$ represents —$CH_3$, —Cl, or —Br; $T_5$ represents —Cl, —Br, —F, —OH, or —CN; $T_6$ represents —H, —$CH_3$, —Cl, —Br, —$OCH_3$, or —$COOCH_3$; r represents an integer of from 1 to 18; s represents an integer of from 1 to 3; t represents an integer of from 2 to 4; and the parenthesized group or the bracketed group shows a recurring unit.

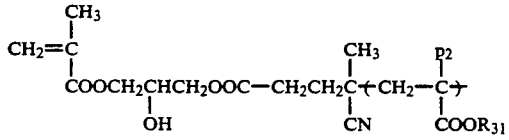

(M-1)

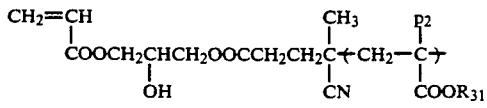

(M-2)

-continued
(M-3)
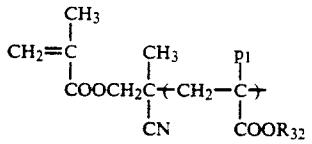
(M-4)
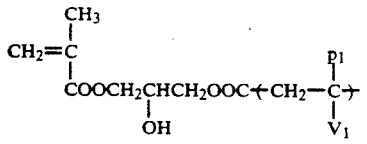
(M-5)
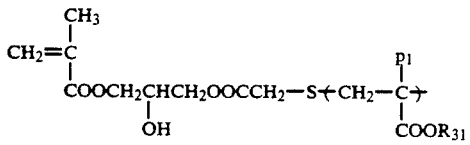
(M-6)
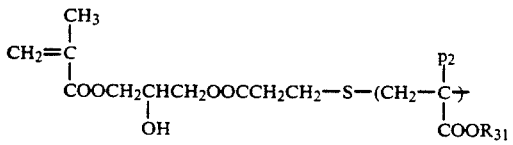
(M-7)
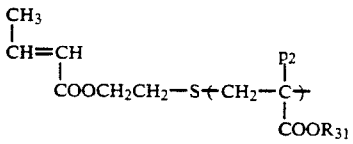
(M-8)
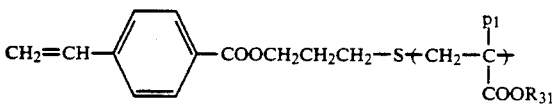
(M-9)
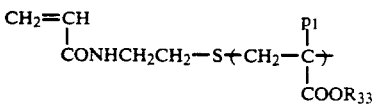
(M-10)
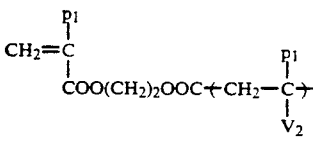
($p_1$ may be the same or different, hereinafter the same)
(M-11)
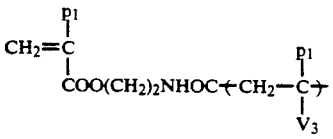
(M-12)
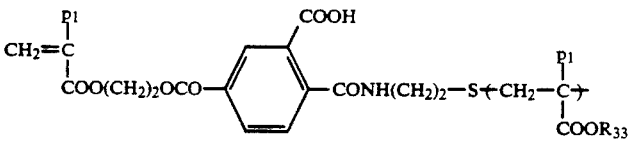
(M-13)
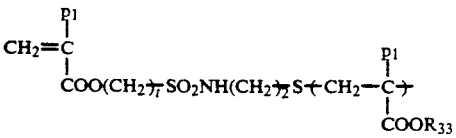

-continued
(M-14)
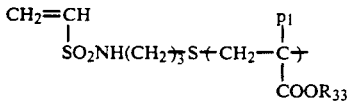
(M-15)
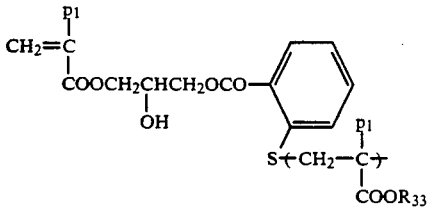
(M-16)
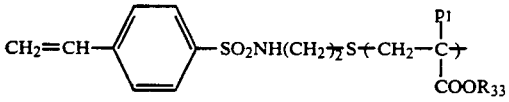
(M-17)
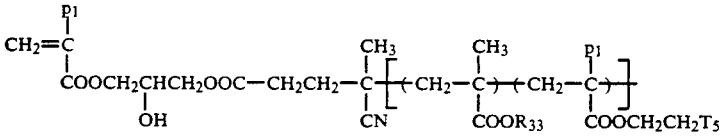
(M-18)
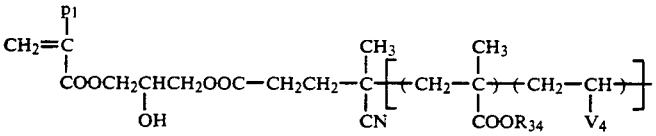
(M-19)
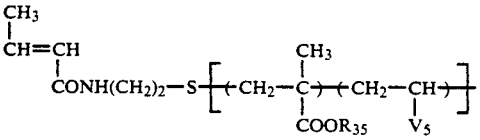
(M-20)
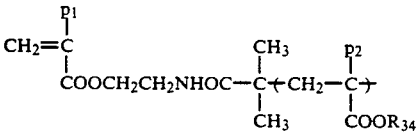
(M-21)
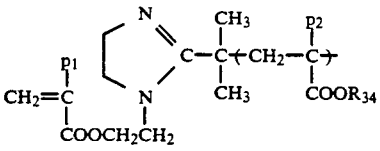
(M-22)
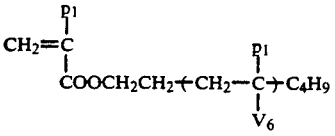
(M-23)
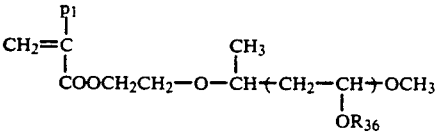

-continued (M-24)

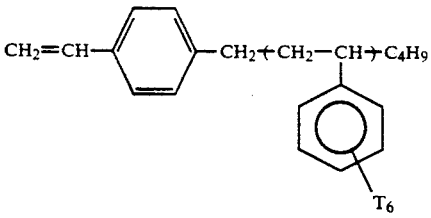

(M-25)

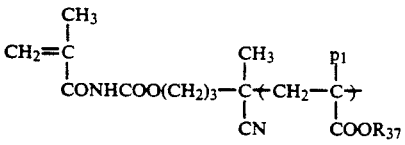

(M-26)

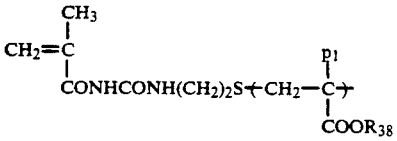

The macromonomer (MBX) containing the specific polar group-containing component as a copolymer component for use in the present invention can be produced by known synthesis methods.

Specifically, the macromonomer can be synthesized by a radical polymerization method of forming the macromonomer by reacting an oligomer having a reactive group bonded to the terminal and various reagents. The oligomer used above can be obtained by a radical polymerization using a polymerization initiator and/or a chain transfer agent each having a reactive group such as a carboxy group, a carboxy halide group, a hydroxy group, an amino group, a halogen atom, or an epoxy group in the molecule thereof.

Specific methods for producing the macromonomer (MBX) are described, for example, in P. Dreyfuss & R. P. Quirk, *Encycl. Polym. Sci. Eng.*, 7, 551 (1987), P. F. Rempp & E. Franta, *Adv. Polym Sci.*, 58, 1 (1984), Yusuke Kawakami, *Kagaku Kogyo* (*Chemical Industry*), 38, 56 (1987), Yuya Yamashita, *Kobunshi* (*Macromolecule*), 31, 988 (1982), Shiro Kobayashi, *Kobunshi* (*Macromolecule*), 30, 625 (1981), Koichi Ito, *Kobunshi Kako* (*Macromolecule Processing*), 35, 262 (1986), Kishiro Higashi & Takashi Tsuda, *Kino Zairyo* (*Functional Materials*), 1987, No. 10, 5, and the literature and patents cited in these references.

However, since the macromonomer (MBX) in the present invention has the above described polar group as the component of the repeating unit, the following matters should be considered in the synthesis thereof.

In one method, the radical polymerization and the introduction of a terminal reactive group are carried out by the above described method using a monomer having the polar group as the form of a protected functional group as described, for example, in the following Reaction Scheme (1).

Reaction Scheme (1)

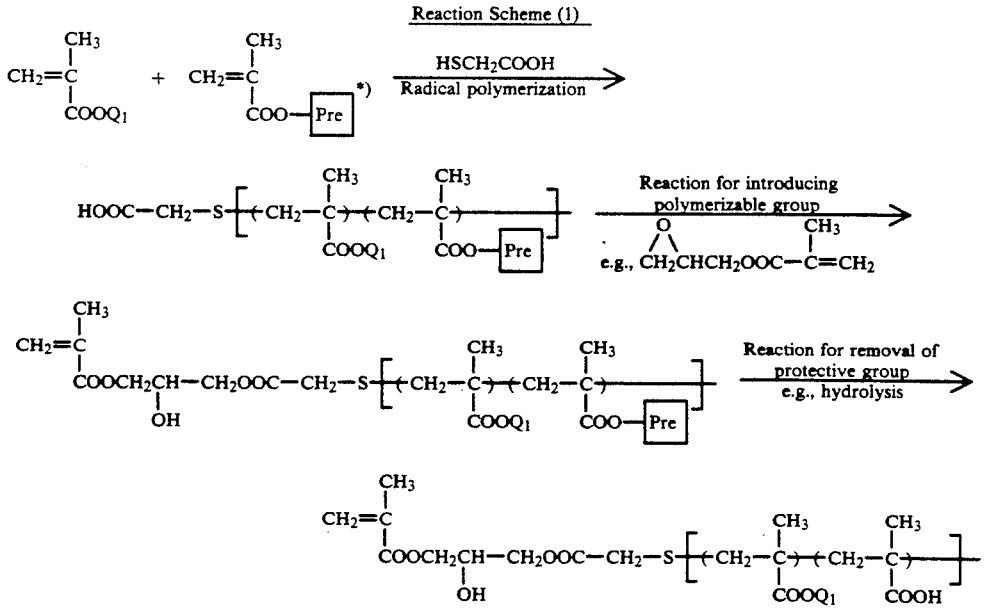

-continued

Reaction Scheme (1)

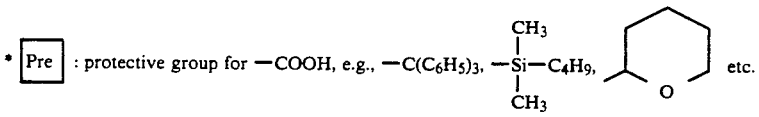

The reaction for introducing the protective group and the reaction for removal of the protective group (e.g., hydrolysis reaction, hydrogenolysis reaction, and oxidation-decomposition reaction) for the polar group (—$SO_3H$, —$PO_3H_2$, —COOH,

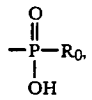

—OH, —CHO, and a cyclic acid anhydride-containing group) which is contained at random in the macromonomer (MBX) for use in the present invention can be carried out by any of conventional methods.

The methods which can be used are specifically described, for example, in J. F. W. McOmie, *Protective Groups in Organic Chemistry,* Plenum Press (1973), T. W. Greene, *Protective Groups in Organic Synthesis,* John Wiley & Sons (1981), Ryohei Oda, *Kobunshi (Macromolecular) Fine Chemical,* Kodansha (1976), Yoshio Iwakura and Keisuke Kurita, *Hannosei Kobunshi (Reactive Macromolecules),* Kodansha (1977), G. Berner et al, J. *Radiation Curing,* No. 10, 10(1986), JP-A-62-212669, JP-A-62-286064, JP-A-62-210475, JP-A-62-195684, JP-A-62-258476, JP-A-63-260439, JP-A-1-63977 and JP-A-1-70767.

Another method for producing the macromonomer (MBX) comprises synthesizing the oligomer in the same manner as described above and then reacting the oligomer with a reagent having a polymerizable double bond group which reacts with only "specific reactive group" bonded to one terminal thereof by utilizing the difference between the reactivity of the "specific reactive group" and the reactivity of the polar group contained in the oligomer as shown in the following Reaction Scheme (2).

Reaction Scheme (2)

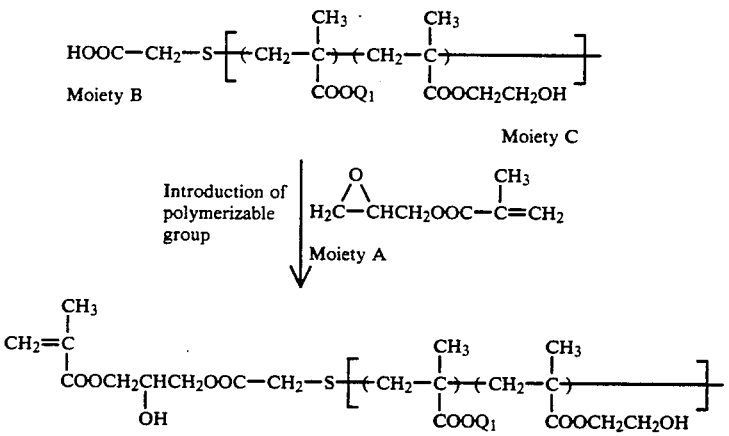

Specific examples of a combination of the specific functional groups (moieties A, B and C) described, in Reaction Scheme (2) are set forth in Table A below but the present invention should not be construed as being limited thereto. It is important to utilize the selectivity of reaction in an ordinary organic chemical reaction and the macromonomer can be formed without protecting the polar group in the oligomer. In Table A, Moiety A is a functional group in the reagent for introducing a polymerizable group, Moiety B is a specific functional group at the terminal of oligomer, and Moiety C is a polar group in the repeating unit in the oligomer.

TABLE A

| Moiety A | Moiety B | Moiety C |
|---|---|---|
| —CH(O)—CH2, —CH(S)—CH2, | —COOH, —NH2 | —OH |
| —N(CH2)2CH2, —Halogen (Br, I, Cl) | | |
| —COCl, Acid Anhydride | —OH, —NH2 | —COOH, —SO3H, —PO3H2, |

TABLE A-continued

| Moiety A | Moiety B | Moiety C |
|---|---|---|
| $-SO_2Cl$, | | $-\overset{\overset{O}{\|}}{\underset{\underset{OH}{\|}}{P}}-R_0$ |
| $-COOH$, $-NHR_{20}$ | $-$Halogen | $-COOH$, $-SO_3H$, $-PO_3H_2$, $-OH$, $-\overset{\overset{O}{\|}}{\underset{\underset{OH}{\|}}{P}}-R_0$ |
| $-COOH$, $-NHR_{20}$ | $-CH\overset{O}{\diagup\diagdown}CH_2$, $-CH\overset{S}{\diagup\diagdown}CH_2$, $-N\begin{matrix}\diagup CH_2\\ \diagdown CH_2\end{matrix}$ | $-OH$ |
| $-OH$, $-NHR_{20}$ | $-COCl$, $-SO_2Cl$ | $-COOH$, $-SO_3H$, $-PO_3H_2$ |

(wherein $R_{20}$ is a hydrogen atom or an alkyl group)

The chain transfer agent which can be used for producing the oligomer includes, for example, mercapto compounds having a substituent capable of being derived into the polar group later (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol), disulfide compounds which are the oxidation products of these mercapto compounds, and iodinated alkyl compounds having the above described polar group or substituent (e.g., iodoacetic acid, iodopropionic acid, 2-iodoethanol, 2-iodoethanesulfonic acid, and 3-iodopropanesulfonic acid). Of these compounds, the mercapto compounds are preferred.

Also, as the polymerization initiator having a specific reactive group, which can be used for the production of the oligomer, there are, for example, 2,2'-azobis(2-cyanopropanol), 2,2'-azobis(2-cyanopentanol), 4,4'-azobis(4-cyanovaleric acid), 4,4'-azobis(4-cyanovaleric acid chloride), 2,2'-azobis[2-(5-methyl-2-imidazolin-2-yl)propane], 2,2'-azobis[2-(2-imidazolin-2-yl)propane], 2,2'-azobis[2-(3,4,5,6-tetrahydropyrimidin-2-yl)propane], 2,2'-azobis){2-[1-(2-hydroxyethyl)-2-imidazolin-2-yl propane}, 2,2'-azobis[2-methyl-N-(2-hydroxyethyl)propionamide] and the derivatives thereof.

The chain transfer agent or the polymerization initiator is used in an amount of from 0.1 to 15 parts by weight, and preferably from 0.5 to 10 parts by weight per 100 parts by weight of the total monomers.

Specific examples of the macromonomer (MBX) for use in the present invention are set forth below, but the present invention should not be construed as being limited thereto.

In the following formulae, $Q_2$ represents —H or $-CH_3$; $Q_3$ represents —H, $-CH_3$, or $-CH_2COOCH_3$; $R_{41}$ represents $-C_nH_{2n+1}$ (wherein n represents an integer of from 1 to 18),

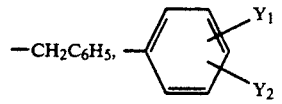

(wherein $Y_1$ and $Y_2$ each represents —H, —Cl, —Br, $-CH_3$, $-COCH_3$, or $-COOCH_3$),

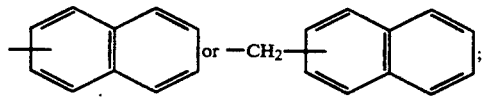

$W_1$ represents —CN, $-OCOCH_3$, $-CONH_2$, $-C_6H_5$; $W_2$ represents —Cl, —Br, —CN, or $-OCH_3$; $\alpha$ represents an integer of from 2 to 18; $\beta$ represents an integer of from 2 to 12; and $\gamma$ represents an integer of from 2 to 4.

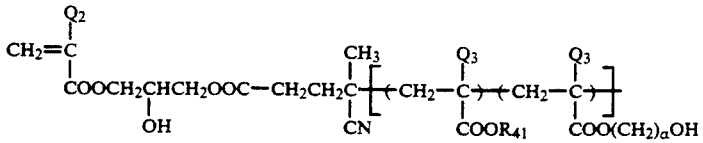

(M-101)

-continued
(M-102)
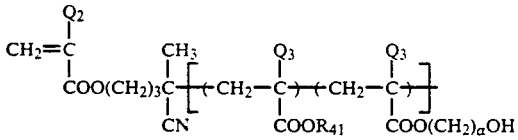
(M-103)
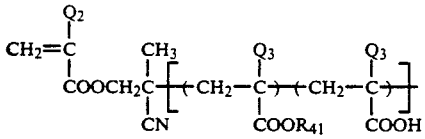
(M-104)
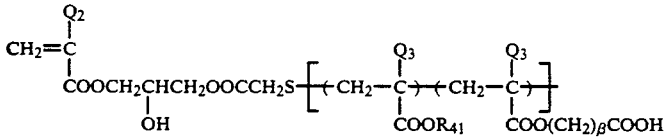
(M-105)
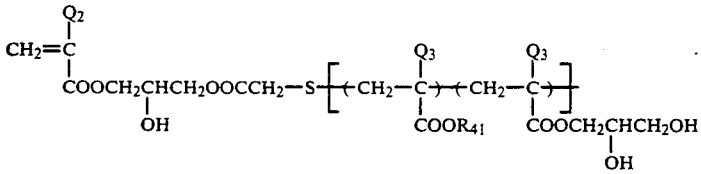
(M-106)
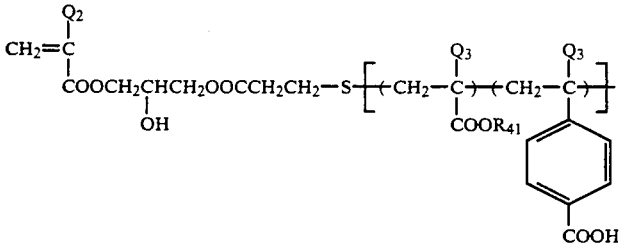
(M-107)
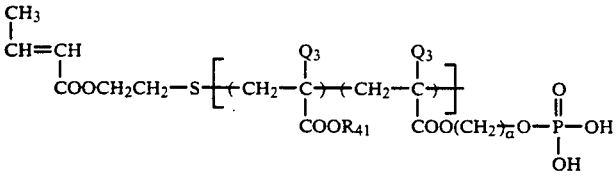
(M-108)
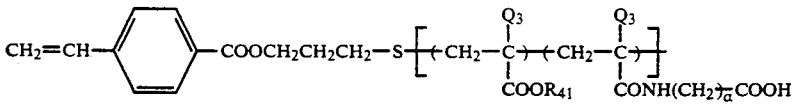
(M-109)
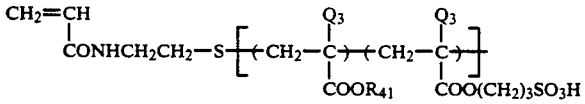
(M-110)
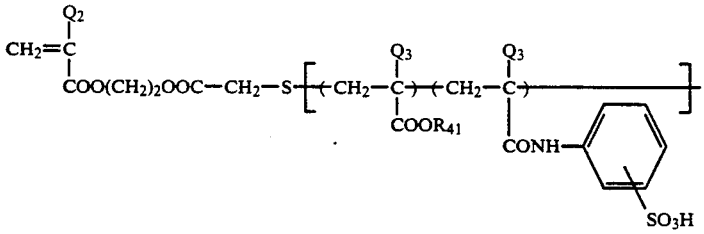
(M-111)
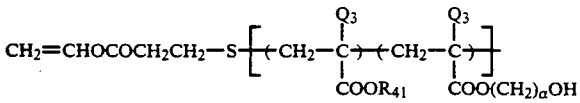

-continued
(M-112)
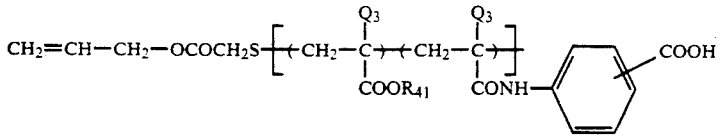
(M-113)
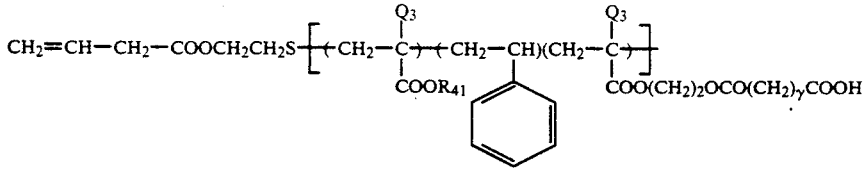
(M-114)
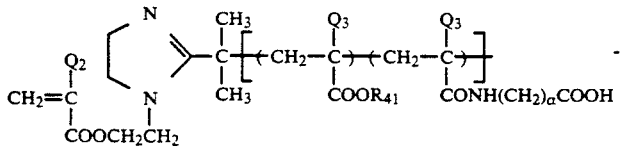
(M-115)
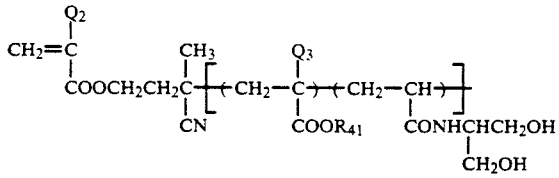
(M-116)
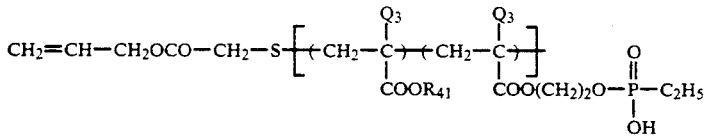
(M-117)
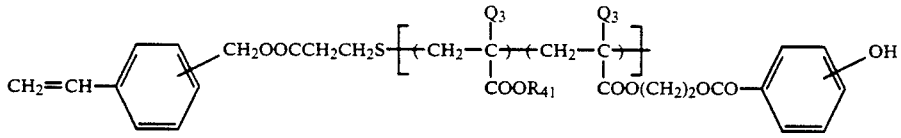
(M-118)
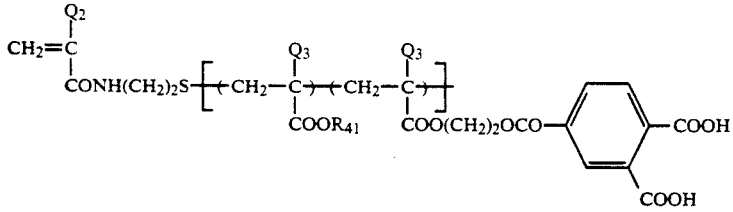
(M-119)
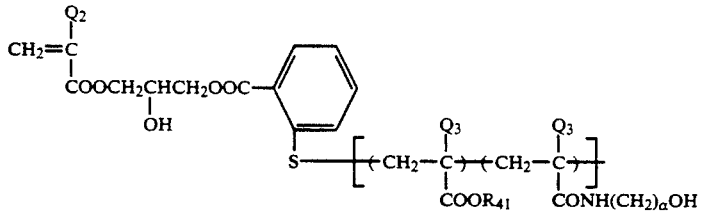
(M-120)
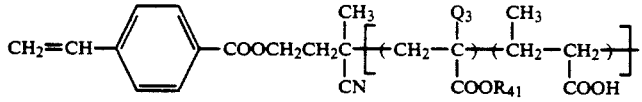
(M-121)
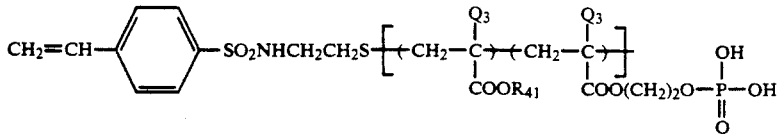

-continued

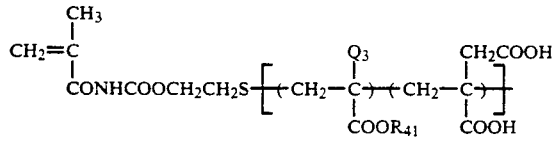

(M-122)

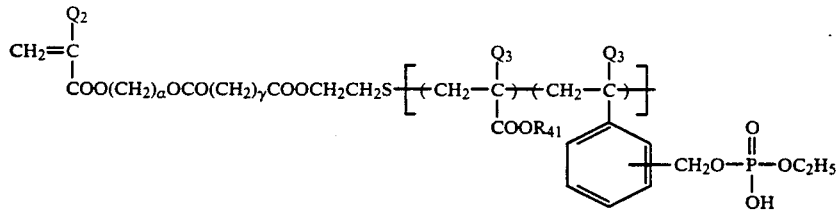

(M-123)

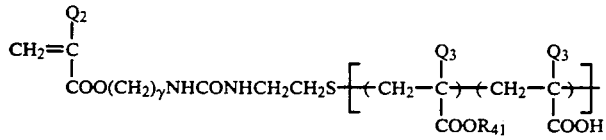

(M-124)

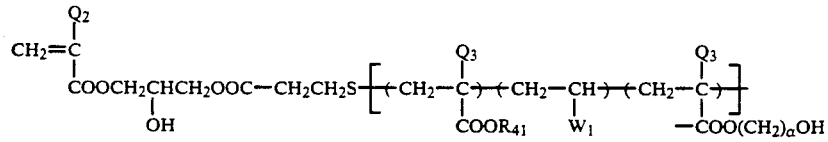

(M-125)

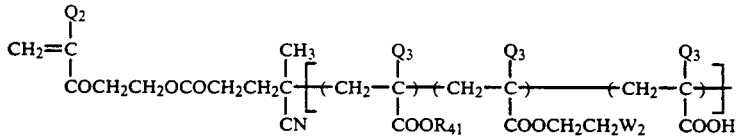

(M-126)

The monomer which is copolymerized with the above described macromonomer (MB) is represented by the above described general formula (V).

In the general formula (V), $e_1$ and $e_2$, which may be the same or different, each has the same meaning as $c_1$ or $c_2$ in the general formula (III) described above; $V_2$ has the same meaning as $V_1$ in the general formula (IVa); and $Q_2$ has the same meaning as $Q_1$ in the general formula (IVa).

Furthermore, the, resin (B) for use in the present invention may be formed of other monomer(s) as other copolymerizable component(s) together with the above described macromonomer (MB) and the monomer represented by the general formula (V).

Examples of such other monomers include vinyl compounds having an acidic group, α-olefins, acrylonitrile, methacrylonitrile, acrylamides, methacrylamides, styrenes, naphthalene compounds having a vinyl group (e.g., vinylnaphthalene and 1-isopropenylnaphthalene), and heterocyclic compounds having a vinyl group (e.g., vinylpyridine, vinylpyrrolidone, vinylthiophene, vinyltetrahydrofuran, vinyl-1,3-dioxolane, vinylimidazole, vinylthiazole, and vinyloxazoline).

In the resin (B), the ratio of copolymerizable component composed of the macromonomer (MB) as a recurring unit to the copolymerizable component composed of the monomer represented by the general formula (V) as a recurring unit is 1 to 80/99 to 20 by weight, and preferably 5 to 60/95 to 40 by weight.

The above described vinyl compounds having an acidic group are described, for example, in *Kobunshi (Macromolecule) Data Handbook Kisohen (Foundation)*, edited by Kobunshi Gakkai, Baifukan (1986).

Specific examples of the vinyl compound include acrylic acid, α- and/or β-substituted acrylic acids (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzensulfonic acid, vinylsulfonic acid, vinylphosphonic acid, half ester derivatives of the vinyl group or allyl group of dicarboxylic acids, and the ester derivatives or amide derivatives of the above described carboxylic acid or sulfonic acid having an acidic group in the substituent thereof.

When the resin (B) contains the vinyl compound having an acidic group as the copolymer component corresponding to the recurring unit, it is preferred that the content of the copolymer component having the acidic group is not more than 10% by weight of the copolymer.

If the content of the acidic group-containing component exceeds 10% by weight, the interaction of the binder resin with inorganic photoconductive particles becomes remarkable to reduce the surface smoothness of the photoconductive layer, which results in deteriorating the electrophotographic characteristics (in particular, charging property and dark charge retentivity) of the photoconductive layer.

Furthermore, the resin (B') which can be used in a preferred embodiment of the present invention is a polymer formed from at least one kind of the recurring unit corresponding to the monomer represented by the general formula (V) and at least one kind of the recurring unit corresponding to the monofunctional macromonomer represented by the macromonomer (MB) and having at least one polar group selected from $-PO_3H_2$, $-SO_3H$, —COOH, —OH, —SH,

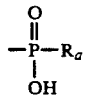

(wherein $R_a$ represents a hydrocarbon group or $-OR_a'$ (wherein $R_a'$ represents a hydrocarbon group)), and a cyclic acid anhydride-containing group bonded to only one terminal of the main chain of the polymer.

Specific examples of the hydrocarbon group represented by $R_a$ or $R_a'$ include an alkyl group having from 1 to 18 carbon atoms which may be substituted (e.g., methyl, ethyl, propyl, butyl, hexyl, octyl, decyl, dodecyl, tetradecyl, octadecyl, 2-methoxyethyl, 3-methoxypropyl, 2-cyanoethyl, and 2-ethoxyethyl), an aralkyl group having from 7 to 9 carbon atoms which may be substituted (e.g., benzyl, phenethyl, 3-phenylpropyl, methylbenzyl, dimethylbenzyl, methoxybenzyl, and chlorobenzyl), an alicyclic group having from 5 to 8 carbon atoms which may be substituted (e.g., cyclopentyl, and cyclohexyl), and an aromatic group having from 6 to 12 carbon atoms which may be substituted (e.g., phenyl, tolyl, xylyl, naphthyl, chlorophenyl, bromophenyl, alkoxyphenyl (the alkyl group including, e.g., methyl, ethyl, propyl, butyl, hexyl, octyl, nonyl, decyl, and dodecyl), acetoxyphenyl, methylchlorophenyl, propylphenyl, butylphenyl, and decylphenyl).

The resin (B') has a chemical structure that the above described polar group is bonded to one terminal of the polymer main chain directly or via an appropriate linkage group.

The linkage group is composed of an appropriate combination of the atomic groups such as a carbon-carbon bond (single bond and double bond), a carbon-hetero atom bond (examples of the hetero atom are oxygen, sulfur, nitrogen, and silicon), and a hetero atom-hetero atom bond.

Specific examples of the linkage group include a linkage group singly composed of an atomic group selected from

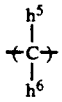

wherein $h^5$ and $h^6$ each has the same meaning as $h^1$ or $h^2$ defined above), $\text{-}(CH{=}CH)\text{-}$,

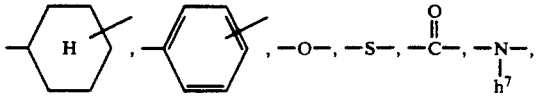

-continued

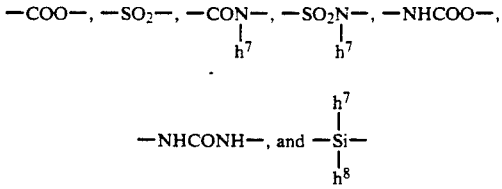

wherein $h^7$ and $h^8$ each has the same meaning as $h^3$ or $h^4$ defined above) and a linkage group composed of an appropriate combination of these atomic groups.

In the resin (B'), the content of the polar group bonded to one terminal of the polymer main chain is preferably from 0.1 to 15% by weight, and more preferably from 0.5 to 10% by weight of the resin (B'). If the content thereof is less than 0.1% by weight, the effect of improving the film strength is small. On the other hand, if the content thereof exceeds 15% by weight, photoconductive particles are not uniformly dispersed in the binder resin at the preparation of the dispersion thereof to cause aggregation, whereby the preparation of uniform coated layer becomes difficult.

The resin (B') having the specific polar group at only one terminal of the polymer main chain can be easily produced by a synthesis method, for example, an ion polymerization method, wherein various reagents are reacted to one terminal of a living polymer obtained by a conventionally known anion polymerization or cation polymerization, a radical polymerization method, wherein the radical polymerization is carried out using a polymerization initiator and/or a chain transfer agent each having the specific polar group in the molecule, or a method wherein a reactive group of a polymer bonded to the terminal thereof obtained by the above described ion polymerization or radical polymerization is converted into the specific polar group by a macromolecular reaction.

Specific methods of producing the resin (B') are described, for example, in P. Dreyfuss & R. P. Quirk, *Encycl. Polym. Sci. Eng.*, 7, 551(1987), Yoshiki Nakajo & Yuya Yamashita, *Senryo to Yakuhin* (*Dyes and Chemicals*), 30, 232(1985), and Akira Ueda & Susumu Nagai, *Kagaku to Kogyo* (*Science and Industry*), 60, 57(1986) and the literatures cited therein.

The electrophotographic light-sensitive material according to the present invention may be required to have much greater mechanical strength while maintaining the excellent electrophotographic characteristics. For such a purpose, a method of introducing a heat- and/or photo-curable functional group into the main chain of the copolymer can be utilized.

More specifically, in the present invention the resin (A) and/or the resin (B) may further contain at least one monomer containing a heat- and/or photo-curable functional group as a copolymerizable component. The heat- and/or photo-curable functional group appropriately forms a crosslinkage between the polymers to increase the interaction between the polymers and resulting in improvement of the mechanical strength of layer. Therefore, the resin further containing the heat- and/or photo-curable functional group according to the present invention increase the interaction between the binder resins without damaging the suitable adsorption and coating of the binder resins onto the inorganic photoconductive substance such as zinc oxide particles, and as a result, the film strength of the photoconductive layer is further improved.

The term "heat- and/or photo-curable functional group" used in the present invention means a functional group capable of inducing curing of the resin by the action of at least one of heat and light.

Suitable examples of the heat-curable functional group (i.e., functional group capable of performing a heat-curing reaction) include functional groups as described, for example, in Tsuyoshi Endo, *Netsukakosei Kobunshi no Seimitsuka,* C.M.C. (1986), Yuji Harasaki, *Saishin Binder Gijutsu Binran,* Ch. II-I, Sogo Gijutsu Center (1985), Takayuki Ohtsu, *Acryl Jushi no Gosei Sekkei to Shin-Yotokaihatsu,* Chubu Keiei Kaihatsu Center Shuppanbu (1985), and Eizo Ohmori, *Kinosei Acryl Jushi,* Techno System (1985}.

Specific examples of the heat-curable functional groups which can be used include —OH, —SH, —$NH_2$, —$NHR_{21}$ (wherein $R_{21}$ represents a hydrocarbon group which has the same meaning as that defined for Po in the general formula (III) above,

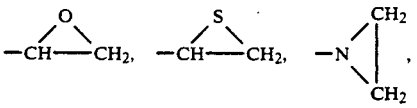

—$CONHCH_2OR_{22}$ (wherein $R_{22}$ represents a hydrogen atom or an alkyl group having from 1 to 8 carbon atoms (e.g., methyl, ethyl, propyl, butyl, hexyl, and octyl), —N=C=O, and

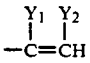

(wherein $\gamma_1$ and $\gamma_2$ each represents a hydrogen atom, a halogen atom (e.g., chlorine, and bromine or an alkyl group having from 1 to 4 carbon atoms (e.g., methyl, and ethyl)). Also, specific examples of the polymerizable double bond group include

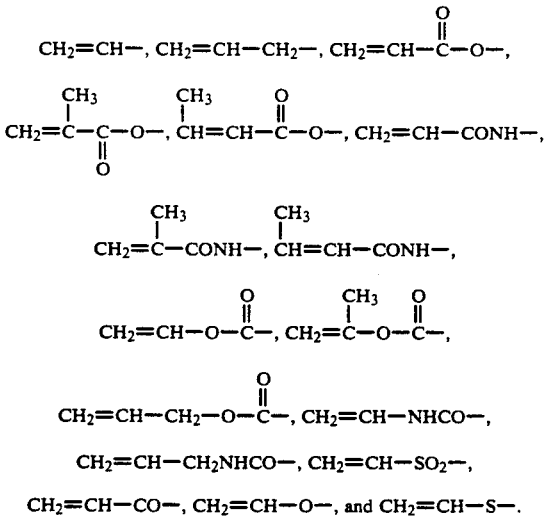

Suitable examples of the photo-curable functional group include functional groups as described, for example, in Takahiro Tsunoda, *Kankosei Jushi,* Insatsu Gakkai Shuppanbu (1972), Gentaro Nagamatsu & Hideo Inui, *Kankosei Kobunshi,* Kodansha (1977), and G. A. Delgenne, *Encyclopedia of Polymer Science and Technology Supplement,* Vol. I (1976).

Specific examples of the photo-curable functional group include an addition polymerizing group such as an allyl ester group or a vinyl ester group, and a dimerizing group such as s cinnamoyl group or a maleimide ring group which may be substituted.

In order to synthesize the resin containing the heat- and/or photo-curable functional group according to the present invention, a monomer containing the heat- and/or photo-curable functional group is employed as a copolymerizable component.

Where the resin according to the present invention contains the hat-curable functional group described above, a reaction accelerator may be used, if desired, in order to accelerate a crosslinking reaction in the light-sensitive layer. Examples of reaction accelerators which can be employed in the reaction system for forming a chemical bond between functional groups include an organic acid (e.g., acetic acid, propionic acid, butyric acid, benzenesulfonic acid, and p-toluenesulfonic acid), and a crosslinking agent.

Specific examples of crosslinking agents are described, for example, in Shinzo Yamashita and Tosuke Kaneko (ed.), *Kakyozai Handbook,* Taiseisha (1981), including commonly employed crosslinking agents, such as organosilanes, polyurethanes, and polyisocyanates, and curing agents, such as epoxy resins and melamine resins.

Where the crosslinking reaction is a polymerization reaction system, polymerization initiators (e.g., peroxides and azobis series polymerization initiators, and preferably azobis series polymerization initiators) and monomers having a polyfunctional polymerizable group (e.g., vinyl methacrylate, allyl methacrylate, ethylene glycol diacrylte, polyethylene glycol diacrylate, divinylsuccinic acid esters, divinyladipic acid esters, diallylsuccinic acid esters, 2-methylvinyl methacrylate, and divinylbenzene) can be used as the reaction accelerator.

When the binder resin containing a heat-curable functional group is employed in the present invention, the photoconductive substance-binder resin dispersed system is subjected to heat-curing treatment. The heat-curing treatment can be carried out by drying the photoconductive coating under conditions severer than those generally employed for the preparation of conventional photoconductive layer. For example, the heat-curing can be achieved by treating the coating at a temperature of from 60° to 120° C. for 5 to 120 minutes. In this case, the treatment can be performed under milder conditions using the above described reaction accelerator.

The ratio of the amount of the resin (A) (including the resin (A')) to the amount of the resin (B) (including the resin (B')) used in the present invention varies depending on the kind, particle size, and surface conditions of the inorganic photoconductive substance used. In general, however, the weight ratio of resin (A)/resin (B) is 5 to 80/95 to 20, preferably 10 to 60/90 to 40.

In addition to the resin (A) (including the resin (A')) and the resin (B) (including the resin (B')), the resin binder according to the present invention may further comprise other resins. Suitable examples of such resins include alkyd resins, polybutyral resins, polyolefins, ethylene-vinyl acetate copolymers, styrene resins, ethylene-butadiene resins, acrylate-butadiene resins, and vinyl aklanoate resins.

The proportion of these other resins should not exceed 30% by weight based on the total binder. If the proportion exceeds 30% by weight, the effects of the present invention, particularly the improvement in electrostatic characteristics, would be lost.

The inorganic photoconductive substance which can be used in the present invention includes zinc oxide, titanium oxide, zinc sulfide, cadmium sulfide, cadmium carbonate, zinc selenide, cadmium selenide, tellurium selenide and lead sulfide. Among them zinc oxide is preferred.

The total amount of the binder resin used for the inorganic photoconductive substance is from 10 to 100 parts by weight, and preferably from 15 to 50 parts by weight, per 100 parts by weight of the photoconductive substance.

The spectral sensitizer used in the present invention includes various kinds of dyes capable of spectrally sensitizing the inorganic photoconductor to the visible to infrared region. Examples of these dyes include carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (which may contain metals) described in Harumi Miyamoto and Hidehiko Takei, *Imaging*, 1973, (No. 8), 12, C. J. Young et al, *RCA Review*, 15, 469 (1954), Kohei Kiyota, *Journal of Electric Communication Society of Japan, J 63 C (No. 2)*, 97 (1980), Yuji Harasaki et al, *Kogyo Kagaku Zasshi*, 66, 78 and 188 (1963), and Tadaaki Tani, *Journal of the Society of Photographic Science and Technology of Japan*, 35, 208 (1972).

Specific examples of suitable carbonium dyes, triphenylmethane dyes, xanthene dyes, and phthalein dyes are described, for example, in JP-B-51-452, JP-A-50-90334, JP-A-50-114227, JP-A-53-39130, JP-A-53-82353, U.S. Pat. Nos. 3,052,540 and 4,054,450 and JP-A-57-16456.

The polymethine dyes such as oxonol dyes, merocyanine dyes, cyanine dyes, and rhodacyanine dyes which can be used include those described, for example, in F. M. Hamer, *The Cyanine Dyes and Related Compounds*, and, more specifically, the dyes described, for example, in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-A-48-7814 and JP-B-55-18892.

Furthermore, polymethine dyes capable of spectrally sensitizing in the wavelength region of from near infrared to infrared longer than 700 nm are those described, for example, in JP-A-47-840, JP-A-47-44180, JP-B-51-41061 JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, 216, 117 to 118 (1982).

The light-sensitive material of the present invention is excellent in that, even when various sensitivizing dyes are used for the photoconductive layer, the performance thereof is not liable to vary by such sensitizing dyes.

Further, if desired, the photoconductive layers may further contain various additives commonly employed in electrophotographic light-sensitive layer, such as chemical sensitizers. Examples of such additives include electron-acceptive compounds (e.g., halogen, benzoquinone, chloranil, acid anhydrides, and organic carboxylic acids) as described, for example in *Imaging*, 1973, (No. 8), page 12, and polyarylalkane compounds, hindered phenol compounds, and p-phenylenediamine compounds as described in Hiroshi Kokado et al, *Recent Photoconductive Materials and Development and Practical Use of Light-sensitive Materials*, Chapters 4 to 6, Nippon Kagaku Joho K.K. (1986).

There is no particular restriction on the amount of these additives, but the amount thereof is usually from 0.0001 to 2.0 parts by weight per 100 parts by weight of the photoconductive substance.

The thickness of the photoconductive layer is from 1 μm to 100 μm, and preferably from 10 μm to 50 μm.

Also, when the photoconductive layer is used as a charge generating layer of a double layer type electrophotographic light-sensitive material having the charge generating layer and a charge transporting layer, the thickness of the charge generating layer is from 0.01 μm to 1 μm, and preferably from 0.05 μm to 0.5 μm.

If desired, an insulating layer is provided on the photoconductive layer for the main purpose of the protection of the photoconductive layer and the improvement of the durability and the dark decay characteristics of the photoconductive layer. In this case, the thickness of the insulating layer is relatively thin. However, when the light-sensitive material is used for a specific electrophotographic process, the insulating layer having a relatively large thickness is provided.

In the latter case, the thickness of the insulating layer is from 5 μm to 70 μm and particularly from 10 μm to 50 μm.

As the charge transporting materials for the double layer type light-sensitive material, there are polyvinylcarbazole, oxazole dyes, pyrazoline dyes, and triphenylmethane dyes. The thickness of the charge transporting layer is from 5 μm to 40 μm, and preferably from 10 μm to 30 μm.

Resins which can be used for the insulating layer and the charge transporting layer typically include thermoplastic and thermosetting resins such as polystyrene resins, polyester resins, cellulose resins, polyether resins, vinyl chloride resins, vinyl acetate resins, vinyl chloride-vinyl acetate copolymer resins, polyacryl resins, polyolefin resins, urethane resins, epoxy resins, melamine resins, and silicone resins.

The photoconductive layer according to the present invention can be provided on a conventional support. In general, the support for the electrophotographic light-sensitive material is preferably electroconductive. As the electroconductive support, there are base materials such as metals, paper, and plastic sheets rendered electroconductive by the impregnation of a low resistant substance, the base materials the back surface of which (the surface opposite to the surface of providing a photoconductive layer) is rendered electroconductive and having coated with one or more layer for preventing the occurrence of curling of the support, the above-described support having formed on the surface a water-resistant adhesive layer, the above-described support having formed on the surface at least one precoat, and a support formed by laminating on paper a plastic film rendered electroconductive by vapor depositing thereon aluminum.

More specifically, the electroconductive base materials or conductivity-imparting materials as described, for example, in Yukio Sakamoto, *Denshi Shashin (Electrophotography)*, 14 (No. 1), 2–11 (1975), Hiroyuki Moriga, *Introduction for Chemistry of Specific Paper*, Kobunshi Kankokai, 1975, and M. F. Hoover, *J. Macromol. Sci. Chem.*, A-4 (6), 1327–1417 (1970) can be used.

In accordance with the present invention, an electrophotographic light-sensitive material which exhibits improved electrostatic charging characteristics and pre-exposure fatigue resistance can be obtained. Also, an electrophotographic lithographic printing plate precursor which provides clear prints of good image quality can be obtained.

Moreover, the electrophotographic characteristics are more improved when the specific methacrylate component represented by the general formula (IIa) or (IIb) is employed as a copolymerizable component in the resin (A).

When the resin (B) having the specific polar group at the terminal of the main chain is employed, the electrostatic characteristics, particularly, DRR and $E_{1/10}$ are further improved, and these preferred characteristics are almost maintained in the case of greatly changing the environmental conditions from high temperature and high hymidity to low temperature and low humidity.

The present invention will now be illustrated in greater detail with reference to the following examples, but it should be understood that the present invention is not to be construed as being limited thereto.

SYNTHESIS EXAMPLE A-1

Synthesis of Resin (A-1)

A mixed solution of 98 g of benzyl methacrylate, 2 g of acrylic acid, 3 g of thiosalicylic acid, and 200 g of toluene was heated to 70° C. under nitrogen gas stream. Then, after adding 1.0 g of 2,2'-azobisisobutyronitrile (hereinafter simply referred to as AIBN) to the above mixture, the reaction was carried out for 4 hours. Then, after adding thereto 0.4 g of AIBN, the mixture was stirred for 2 hours and, after further adding thereto 0.2 g of AIBN, the mixture was stirred for 3 hours. The weight average molecular weight (Mw) of the resulting copolymer (A-1) was $6.5\times10^3$.

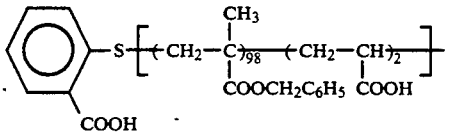

(A-1)

SYNTHESIS EXAMPLES A-2 TO A-16

Synthesis of Resins (A-2) to (A-16)

Each of resins (A) shown in Table 1 was synthesized by following the same procedure as Synthesis Example A-1 except that each of the monomers shown in Table 1 below was used in place of 98 g of benzyl methacrylate and 2 g of acrylic acid. The weight average molecular weight of each of the resins obtained was in a range from $6\times10^3$ to $8\times10^3$.

TABLE 1

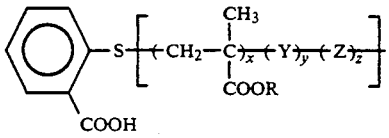

| Synthesis Example No. | Resin (A) | R | —Y— | —Z— | x/y/z (weight ratio) |
|---|---|---|---|---|---|
| 2 | A-2 | $-C_2H_5$ | — | $-CH_2-C(CH_3)(COOH)-$ | 97/0/3.0 |
| 3 | A-3 | $-C_3H_7$ | — | $-CH_2-C(CH_3)(COOH)-$ | 96.5/0/3.5 |
| 4 | A-4 | $-CH_2C_6H_5$ | — | $-CH(CH_3)-CH(COOH)-$ | 98/0/2.0 |
| 5 | A-5 | $-CH_2C_6H_5$ | $-CH_2-CH(COOCH_3)-$ | $-CH_2-C(COOH)(CH_2COOH)-$ | 89/10/1.0 |
| 6 | A-6 | $-CH_3$ | $-CH_2-CH(COOC_2H_5)-$ | $-CH_2-CH(COO(CH_2)_2COOH)-$ | 82/15/3.0 |
| 7 | A-7 | $-C_6H_5$ | — | $-CH_2-CH(COOH)-$ | 98.5/0/1.5 |

TABLE 1-continued
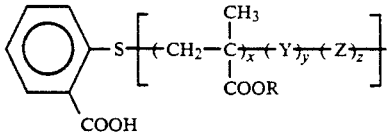
| Synthesis Example No. | Resin (A) | R | —Y— | —Z— | x/y/z (weight ratio) |
|---|---|---|---|---|---|
| 8 | A-8 | 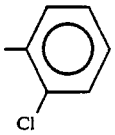 | — | " | 98/0/2.0 |
| 9 | A-9 | 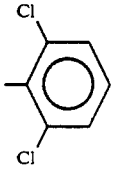 | — | 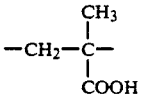 | 97/0/3.0 |
| 10 | A-10 | 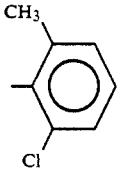 | — | 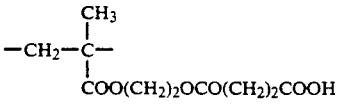 | 95/0/5.0 |
| 11 | A-11 | 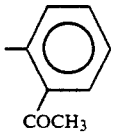 | — | 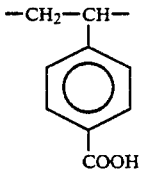 | 96/0/4.0 |
| 12 | A-12 | 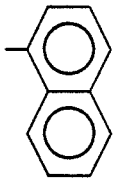 | 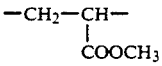 | 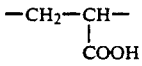 | 82.5/15/2.5 |
| 13 | A-13 | 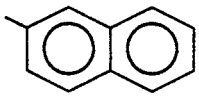 | — | 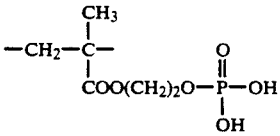 | 99/0/1.0 |
| 14 | A-14 | 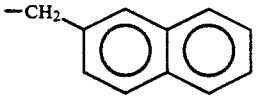 | — | 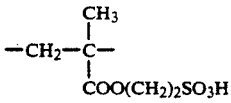 | 99.2/0/0.8 |
| 15 | A-15 | $-CH_2C_6H_5$ | — | 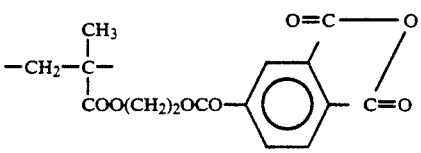 | 94/0/6.0 |

TABLE 1-continued

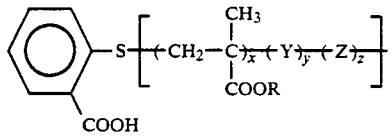

| Synthesis Example No. | Resin (A) | R | —Y— | —Z— | x/y/z (weight ratio) |
|---|---|---|---|---|---|
| 16 | A-16 | $-C_4H_9$ | $-CH_2-CH(CN)-$ | $-CH_2-C(CH_3)(COO(CH_2)_2COOH)-$ | 92/5/3.0 |

SYNTHESIS EXAMPLES A-17 TO A-27

Synthesis of Resins (A-17) to (A-27)

Each of resins (A) shown in Table 2 was synthesized by following the same procedure as Synthesis Example A-1 except that each of the methacrylates and each of the mercapto compounds shown in Table 2 below were used in place of 98 g of benzyl methacrylate and 3 g of thiosalicylic acid, and that 150 g of toluene and 50 g of isopropanol were used in place of 200 g of toluene.

TABLE 2

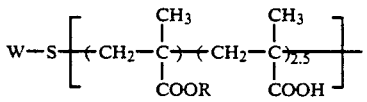

| Synthesis Example No. | Resin (A) | Mercapto Compound (W—) | | R— | | Weight Average Molecular Weight |
|---|---|---|---|---|---|---|
| 17 | A-17 | $HOOCCH_2CH_2CH_2-$ | 4 g | $-C_2H_5$ | 96 g | $7.3 \times 10^3$ |
| 18 | A-18 | $HOOCCH_2-$ | 5 g | $-C_3H_7$ | 95 g | $5.8 \times 10^3$ |
| 19 | A-19 | $HOOC-CH(HOOC-CH_2)-$ | 5 g | $-CH_2C_6H_5$ | 95 g | $7.5 \times 10^3$ |
| 20 | A-20 | $HOOCCH_2CH_2-$ | 5.5 g | $-C_6H_5$ | 94.5 g | $6.5 \times 10^3$ |
| 21 | A-21 | $HOOCCH_2-$ | 4 g | 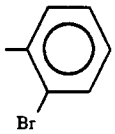 | 96 g | $5.3 \times 10^3$ |
| 22 | A-22 | $HO-P(=O)(OH)-OCH_2CH_2-$ | 3 g | 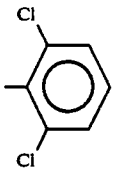 | 97 g | $6.0 \times 10^3$ |
| 23 | A-23 | $HO_3SCH_2CH_2-$ | 3 g | 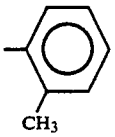 | 97 g | $8.8 \times 10^3$ |
| 24 | A-24 | $H_5C_2O-P(=O)(OH)-OCH_2CH_2-$ | 4 g | 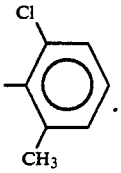 | 96 g | $7.5 \times 10^3$ |

TABLE 2-continued

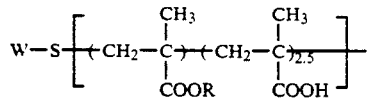

| Synthesis Example No. | Resin (A) | Mercapto Compound (W—) | | R— | | Weight Average Molecular Weight |
|---|---|---|---|---|---|---|
| 25 | A-25 | 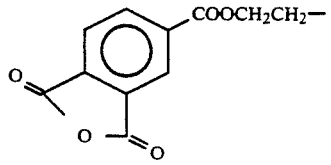 | 7 g | 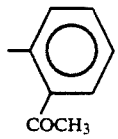 | 93 g | $5.5 \times 10^3$ |
| 26 | A-26 | 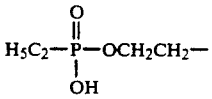 | 6 g | 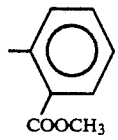 | 94 g | $4.5 \times 10^3$ |
| 27 | A-27 | 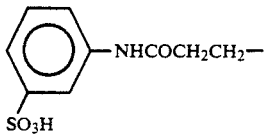 | 4 g | 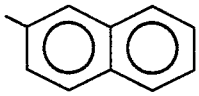 | 96 g | $5.6 \times 10^3$ |

SYNTHESIS EXAMPLE A-28

Synthesis of Resin (A-28)

A mixed solution of 97 g of 1-naphthyl methacrylate, 3 g of methacrylic acid, 150 g of toluene, and 50 g of isopropanol was heated to 80° C. under nitrogen gas stream. After adding 5.0 g of 4,4'-azobis(4-cyanovaleric acid) (hereinafter simply referred to as ACV) tot he mixture, the resulting mixture was stirred for 5 hours. Then, after adding thereto 1 g of ACV, the mixture was stirred for 2 hours and, after further adding thereto 1 g of ACV, the mixture was stirred for 3 hours. The weight average molecular weight of the resulting copolymer (A-28) was $7.5 \times 10^3$.

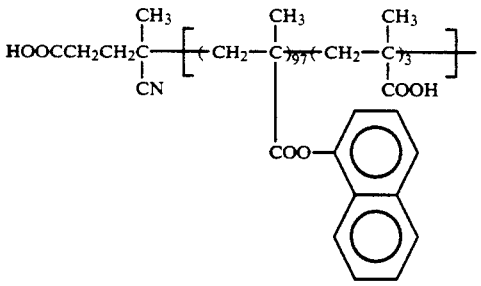

(A-28)

SYNTHESIS EXAMPLE A-29

Synthesis of Resin (A-29)

A mixed solution of 97 g of benzyl methacrylate, 3 g of vinylbenzenecarboxylic acid, 1.5 g of thiosalicylic acid, and 200 g of toluene was heated to 75° C. under nitrogen gas stream. Then, after adding 3.0 of ACV to the resulting mixture, the reaction was carried out for 6 hours and, after further adding thereto 0.4 g of AIBN, the reaction was carried out for 3 hours. An Mw of the resulting copolymer (A-29) was $5.8 \times 10^3$.

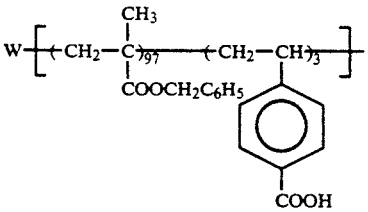

(A-29)

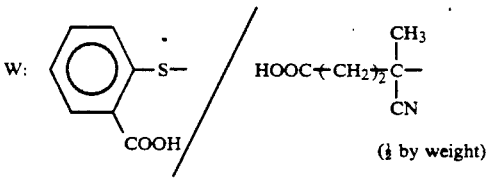

(½ by weight)

SYNTHESIS EXAMPLE MB-1

Synthesis of Macromonomer (MB-1)

A mixed solution of 95 g of methyl methacrylate, 5 g of β-mercaptopropionic acid, and 200 g of toluene was heated to 75° C. with stirring under nitrogen gas stream. To the mixture was added 1.0 g of AIBN to conduct a reaction for 8 hours. To the reaction mixture were added 8 g of glycidyl methacrylate, 1.0 g of N,N-dimethyldodecylamine, and 0.5 g of tert-butylhydroquinone, followed by stirring at 100° C. for 12 hours. After cooling, the reaction mixture was reprecipitated from 2 l of methanol to obtain 82 g of Macromonomer (MB-1) having a weight average molecular weight of 7,000 as white powder.

SYNTHESIS EXAMPLE MB-2

Synthesis of Macromonomer (MB-2)

A mixed solution of 95 g of methyl methacrylate, 5 g of thioglycolic acid, and 200 g of toluene was heated to 70° C. with stirring under nitrogen gas stream. To the mixture was added 1.5 g of AIBN to conduct a reaction for 8 hours. To the reaction mixture were added 7.5 g of glycidyl methacrylate, 1.0 g of N,N-dimethyldodecylamine, and 0.8 g of tert-butylhydroquinone, followed by stirring at 100° C. for 12 hours. After cooling, the reaction mixture was reprecipitated from 2 l of methanol to obtain 85 g of Macromonomer (MB-2) having a weight average molecular weight of 3,600 as the colorless clear viscous substance.

SYNTHESIS EXAMPLE MB-3

Synthesis of Macromonomer (MB-3)

A mixed solution of 94 g of propyl methacrylate, 6 g of 2-meracptoethanol, and 200 g of toluene was heated to 70° C. under nitrogen gas stream. To the mixture was added 1.2 g of AIBN to conduct a reaction for 8 hours.

The reaction mixture was cooled to 20° C. in a water bath, 10.2 g of triethylamine was added thereto, and 14.5 g of methacrylic chloride was added thereto dropwise with stirring at a temperature of 25° C. or less. After the dropwise addition, the stirring was continued for 1 hour. Then, 0.5 g of tert-butylhydroquinone was added, followed by stirring for 4 hours at a temperature of 60° C. After cooling, the reaction mixture was reprecipitated from 2 l of methanol to obtain 79 g of Macromonomer (MB-3) having a weight average molecular weight of 6,500 as the colorless clear viscous substance.

SYNTHESIS EXAMPLE MB-4

Synthesis of Macromonomer (MB-4)

A mixed solution of 95 g of ethyl methacrylate and 200 g of toluene was heated to 70° C. under nitrogen gas stream, and 5 g of 2,2-azobis(cyanoheptanol) was added thereto to conduct a reaction for 8 hours.

After cooling, the reaction mixture was cooled to 20° C. in a water bath, and 1.0 g of triethylamine and 21 g of methacrylic anhydride were added thereto, followed by stirring at that temperature for 1 hour and then at 60° C. for 6 hours.

The resulting reaction mixture was cooled and reprecipitated from 2 l of methanol to obtain 75 g of Macromonomer (MB-4) having a weight average molecular weight of 9,000 as the colorless clear viscous substance.

SYNTHESIS EXAMPLE MB-5

Synthesis of Macromonomer (MB-5)

A mixed solution of 93 g of benzyl methacrylate, 7 g of 3-mercaptopropionic acid, 170 g of toluene, and 30 g of isopropanol was heated to 70° C. under nitrogen gas stream to prepare a uniform solution. To the solution was added 2.0 g of AIBN to conduct a reaction for 8 hours. After cooling, the reaction mixture was reprecipitated from 2 l of methanol, and the solvent was removed by distillation at 50° C. under reduced pressure. The resulting viscous substance was dissolved in 200 g of toluene, and to the solution were added 16 g of glycidyl methacrylate, 1.0 g of N,N-dimethyldodecylamine, and 1.0 g of tert-butylhydroquinone, followed by stirring at 110° C. for 10 hours. The reaction solution was again reprecipitated from 2 l of methanol to obtain Macromonomer (MB-5) having a weight average molecular weight of 5,000 as the light yellow viscous substance.

SYNTHESIS EXAMPLE MB-6

Synthesis of Macromonomer (MB-6)

A mixed solution of 95 g of propyl methacrylate, 5 g of thioglycolic acid, and 200 g of toluene was heated to 70° C. with stirring under nitrogen gas stream, and 1.0 g of AIBN was added thereto to conduct a reaction for 8 hours. To the reaction mixture were added 13 g of glycidyl methacrylate, 1.0 g of N,N-dimethyldodecylamine, and 1.0 g of tert-butylhydroquinone, followed by stirring at 110° C. for 10 hours. After cooling, the reaction mixture was reprecipitated from 2 l of methanol to obtain 86 g of Macromonomer (MB-6) having a weight average molecular weight of 5,200 as white powder.

SYNTHESIS EXAMPLE MB-7

Synthesis of Macromonomer (MB-7)

A mixed solution of 40 g of methyl methacrylate, 54 g of ethyl methacrylate, 6 g of 2-mercaptoethylamine, 150 g of toluene, and 50 g of tetrahydrofuran was heated to 75° C. with stirring under nitrogen gas stream, and 2.0 g of AIBN was added thereto to conduct a reaction for 8 hours. The reaction mixture was cooled to 20° C. in a water bath, and 23 g of methacrylic anhydride was added thereto dropwise in such a manner that the temperature did not exceed 25° C, followed by stirring at that temperature for 1 hour. To the reaction mixture was added 0.5 g of 2,2'-methyelnebis(6-tert-butyl-p-cresol) was added, followed by stirring at 40° C. for 3 hours. After cooling, the reaction mixture was reprecipitated from 2 l of methanol to obtain 83 g of Macromonomer (MB-7) having a weight average molecular weight of 3,300 as the viscous substance.

SYNTHESIS EXAMPLE MB-8

Synthesis of Macromonomer (MB-8)

A mixed solution of 95 g of 2-chlorophenyl methacrylate, 150 g of toluene, and 150 g of ethanol was heated to 75° C. under nitrogen gas stream, and 5 g of ACV was added thereto to conduct a reaction for 8 hours. Then, 15 g of glycidyl acrylate, 1.0 g of N,N-dimethyldodecylamine, and 1.0 g of 2,2'-methylenebis(6-tert-butyl-p-cresol) were added thereto, followed by stirring at 100° C. for 15 hours. After cooling, the reaction mixture was reprecipitated from 2 of methanol to obtain 83 of Macromonomer (MB-8) having a weight average molecular weight of 5,400 as the clear viscous substance.

SYNTHESIS EXAMPLES MB-9 TO MB-18

Synthesis of Macromonomers (MB-9) to (MB-18)

Macromonomers (MB-9) to (MB-18) were prepared in the same manner as in Synthesis Example MB-3, except for replacing methacrylic chloride with each of the acid halides shown in Table 3 below. The weight average molecular weight of each macromonomer was in the range of from 6,000 to 8,000.

TABLE 3

| Synthesis Example No. | Macro-monomer (MB) | Acid Halide | Amount Used (g) | Yield (g) |
|---|---|---|---|---|
| MB-9 | (MB-9) | $CH_2{=}CH{-}COCl$ | 13.5 | 75 |

TABLE 3-continued

| Synthesis Example No. | Macro-monomer (MB) | Acid Halide | Amount Used (g) | Yield (g) |
|---|---|---|---|---|
| MB-10 | (MB-10) | $CH_3$<br>\|<br>$CH{=}CH{-}COCl$ | 14.5 | 80 |
| MB-11 | (MB-11) | 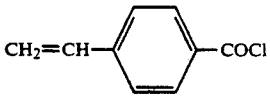 | 15.0 | 83 |
| MB-12 | (MB-12) | $CH_2{=}CH$<br>\|<br>$COO(CH_2)_2COCl$ | 15.5 | 73 |
| MB-13 | (MB-13) | $CH_3$<br>\|<br>$CH_2{=}C$<br>\|<br>$COO(CH_2)_2OCO(CH_2)_2COCl$ | 18.0 | 75 |
| MB-14 | (MB-14) | $CH_3$<br>\|<br>$CH_2{=}C$<br>\|<br>$CONH(CH_2)_4COCl$ | 18.0 | 80 |
| MB-15 | (MB-15) | 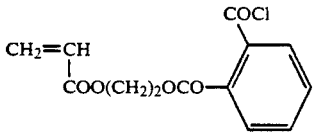 | 20.0 | 81 |
| MB-16 | (MB-16) | $CH_3$<br>\|<br>$CH_2{=}C$ Br<br>\| \|<br>$COOCH_2CHCH_2OCO(CH_2)_3COCl$ | 20.0 | 78 |
| MB-17 | (MB-17) | $CH_2{=}CH{-}CH_2$<br>\|<br>$OCO(CH_2)_2COCl$ | 16.0 | 72 |
| MB-18 | (MB-18) | $CH_2{=}C{-}COCl$<br>\|<br>$CH_2COOCH_3$ | 17.5 | 75 |

SYNTHESIS EXAMPLES MB-19 TO MB-27

Synthesis of Macromonomers (MB-19) to (MB-27)

Macromonomers (MB-19) to (MB-27) were prepared in the same manner as in Synthesis Example MB-2, except for replacing methyl methacrylate with each of the monomers shown in Table 4 below.

TABLE 4

| Synthesis Example No. | Macro-monomer (MB) | Monomer (Amount: g) | Mw |
|---|---|---|---|
| MB-19 | (MB-19) | Ethyl methacrylate (95) | 4,200 |
| MB-20 | (MB-20) | Methyl methacrylate (60)<br>Butyl methacrylate (35) | 4,800 |
| MB-21 | (MB-21) | Butyl methacrylate (85)<br>2-Hydroxyethyl methacrylate (10) | 5,000 |
| MB-22 | (MB-22) | Ethyl methacrylate (75)<br>Styrene (20) | 3,300 |
| MB-23 | (MB-23) | Methyl methacrylate (80)<br>Methyl acrylate (15) | 3,700 |
| MB-24 | (MB-24) | Ethyl acrylate (75)<br>Acrylonitrile (20) | 4,500 |
| MB-25 | (MB-25) | Propyl methacrylate (87)<br>N,N-Dimethylaminoethyl methacrylate (8) | 3,300 |
| MB-26 | (MB-26) | Butyl methacrylate (90) | 4,500 |

TABLE 4-continued

| Synthesis Example No. | Macro-monomer (MB) | Monomer (Amount: g) | Mw |
|---|---|---|---|
| MB-27 | (MB-27) | N-Vinylpyrrolidone (5)<br>Methyl methacrylate (89)<br>Dodecyl methacrylate (6) | 4,500 |

SYNTHESIS EXAMPLE M-1

Synthesis of Macromonomer (MBX-1)

A mixed solution of 90 g of ethyl methacrylate, 10 g of 2-hydroxyethyl methacrylate, 5 g of thioglycolic acid and 200 g of toluene was heated to 75° C. with stirring under nitrogen gas stream and, after adding thereto 1.0 g of AIBN, the reaction was carried out for 8 hours. Then, to the reaction mixture were added 8 g of glycidyl methacrylate, 1.0 g of N,N-dimethyldodecylamine and 0.5 g of tert-butylhydroquninone, and the resulting mixture was stirred for 12 hours at 100° C. After cooling, the reaction mixture was reprecipitated from 2 liters of n-hexane to obtain 82 g of the desired macromonomer as a white powder. The weight average molecular weight of the macromonomer obtained was $3.8'10^3$.

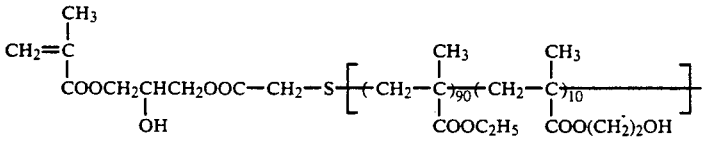

(MBX-1)

SYNTHESIS EXAMPLE M-2

Synthesis of Macromonomer (MBX-2)

A mixed solution of 90 g of butyl methacrylate, 10 g of methacrylic acid, 4 g of 2-mercaptoethanol, and 200 g of tetrahydrofuran was heated to 70° C. under nitrogen gas stream and, after adding thereto 1.2 g of AIBN, the reaction was carried out for 8 hours.

Then, after cooling the reaction mixture in a water bath to 20° C, 10.2 g of triethylamine was added to the reaction mixture and then 14.5 g of methacrylic chloride was added dropwise to the mixture with stirring at a temperature below 25° C. Thereafter, the resulting mixture was further stirred for one hour. Then, after adding thereto 0.5 g of tert-butylhydroquinone, the mixture was heated to 60° C. and stirred for 4 hours. After cooling, the reaction mixture was added dropwise to one liter of water with stirring over a period of about 10 minutes, and the mixture was stirred for one hour. Then, the mixture was allowed to stand and water was removed by decantation. The mixture was washed twice with water and, after dissolving it in 100 ml of tetrahydrofuran, the solution was reprecipitated from 2 liter of petroleum ether. The precipitates thus formed were collected by decantation and dried under reduced pressure to obtain 65 g of the desired macromonomer as a viscous product. The weight average molecular weight of the product was $5.6\times10^3$.

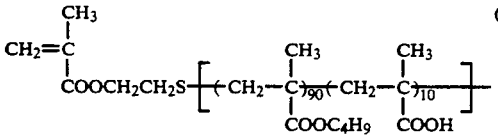

(MBX-2)

SYNTHESIS EXAMPLE M-3

Synthesis of Macromonomer (MBX-3)

A mixed solution of 95 g of benzyl methacrylate, 5 g of 2-phosphonoethyl methacrylate, 4 g of 2-aminoethylmercaptan, and 200 g of tetrahydrofuran was heated to 70° C. with stirring under nitrogen gas stream.

Then, after adding 1.5 g of AIBN to the reaction mixture, the reaction was carried out for 4 hours and, after further adding thereto 0.5 g of AIBN, the reaction was carried out for 4 hours. Then, the reaction mixture was cooled to 20° C. and, after adding thereto 10 g of acrylic anhydride, the mixture was stirred for one hour at a temperature of from 20° C. to 25° C. Then, 1.0 g of tert-butylhydroquinone was added to the reaction mixture, and the resulting mixture was stirred for 4 hours at a temperature of from 50° C. to 60° C. After cooling, the reaction mixture was added dropwise to one liter of water with stirring over a period of about 10 minutes followed by stirring for one hour. The mixture was allowed to stand, and water was removed by decantation. The product was washed twice with water, dissolved in 100 ml of tetrahydrofuran and the solution was reprecipitated from 2 liters of petroleum ether. The precipitates formed were collected by decantation and dried under reduced pressure to obtain 70 g of the desired macromonomer as a viscous product. The weight average molecular weight of the product was $7.4\times10^3$.

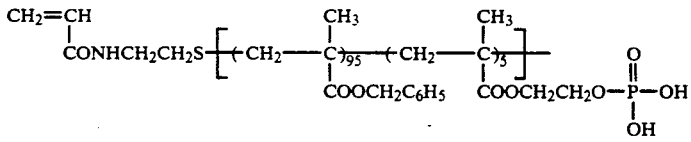

(MBX-3)

SYNTHESIS EXAMPLE MBX-4

Synthesis of Macromonomer (MBX-4)

A mixed solution of 95 g of 2-chlorophenyl methacrylate, 5 g of Monomer (I) having the structure shown below, 4 g of thioglycolic acid and 200 g of toluene was heated to 70° C. under nitrogen gas stream.

Monomer (I):

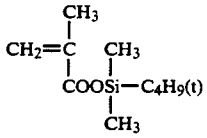

Then, 1.5 g of AIBN was added to the reaction mixture, and the reaction was carried out for 5 hours. After further adding thereto 0.5 g of AIBN, the reaction was carried out for 4 hours. Then, after adding thereto 12.4 g of glycidyl methacrylate, 1.0 g of N,N-dimethyldodecylamine, and 1.5 g of tert-butylhydroquinone, the reaction was carried out for 8 hours at 110° C. After cooling, the reaction mixture was added to a mixture of 3 g of p-toluenesulfonic acid and 100 ml of an aqueous solution of 90% by volume tetrahydrofuran, and the mixture was stirred for one hour at a temperature of from 30° C. to 35° C. The reaction mixture obtained was reprecipitated from 2 liters of a mixture of water and ethanol (⅓ by volume ratio), and the precipitates thus formed were collected by decantation and dissolved in 200 ml of tetrahydrofuran. The solution was reprecipitated from 2 liters of n-hexane to obtain 58 g of the desired macromonomer as powder. The weight average molecular weight thereof was $7.6\times10^3$.

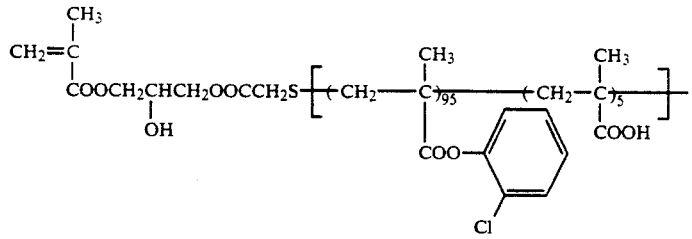

(MBX-4)

SYNTHESIS EXAMPLE M-5

Synthesis of Macromonomer (MBX-5)

A mixed solution of 95 g of 2,6-dichlorophenyl methacrylate, 5 g of 3-(2'-nitrobenzyloxysulfonyl)propyl methacrylate, 150 g of toluene and 50 g of isopropyl alcohol was heated to 80° C. under nitrogen gas stream. Then, after adding 5.0 g of ACV to the reaction mixture, the reaction was carried out for 5 hours and, after further adding thereto 1.0 g of ACV, the reaction was carried out for 4 hours. After cooling, the reaction mixture was reprecipitated from 2 liters of methanol and the powder thus formed was collected and dried under reduced pressure.

A mixture of 50 g of the powder obtained in the above step, 14 g of glycidyl methacrylate, 0.6 g of N,N,-dimethyldodecylamine, 1.0 g of tert-butylhydroquinone, and 100 g of toluene was stirred for 10 hours at 110° C. After cooling to room temperature, the reaction mixture was irradiated with a high pressure mercury lamp of 80 watts with stirring for one hour. Thereafter, the reaction mixture was reprecipitated from one liter of methanol, and the powder formed was collected b filtration and dried under reduced pressure to obtain 34 g of the desired macromonomer. The weight average molecular weight of the product was $7.3\times10^3$.

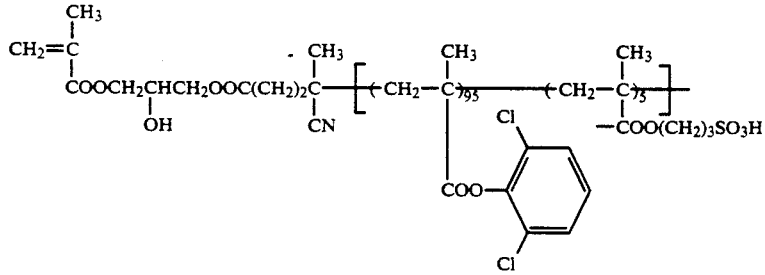

(MBX-5)

SYNTHESIS EXAMPLE B-1

Synthesis of Resin (B-1)

A mixed solution of 70 g of ethyl methacrylate, 30 g of Macromonomer (MB-1), and 150 g of toluene was heated to 70° C. under nitrogen gas stream. Then, after adding 0.5 g of AIBN to the reaction mixture, the reaction was carried out for 4 hours and, after further adding thereto 0.3 g of AIBN, the reaction was carried out for 6 hours to obtain the desired Resin (B-1).

The weight average molecular weight of the copolymer was $9.8\times10^4$ and the glass transition point thereof was 72° C.

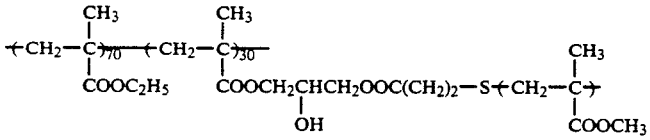

(B-1)

SYNTHESIS EXAMPLES B-2 TO B-15

Synthesis of Resins (B-2) to (B-15)

By following the similar procedure to Synthesis Example B-1, each of the resins (B) shown in Table 5 below was produced. The weight average molecular weight of each resin was in the range of from $8\times10^4$ to $1.5\times10^5$.

TABLE 5

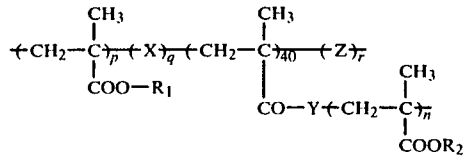

| Synthesis Example No. | Resin (B) | $R_1$ | p | $\leftarrow X \rightarrow$ | q | Y | $R_2$ | Z | r |
|---|---|---|---|---|---|---|---|---|---|
| B-2 | B-2 | $-CH_3$ | 60 | — | 0 | $-OCH_2CH(OH)CH_2OOC-CH_2-S-$ | $-C_4H_9$ | — | 0 |
| B-3 | B-3 | 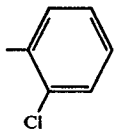 | 60 | — | 0 | " | $-C_3H_7$ | — | 0 |
| B-4 | B-4 | $-C_2H_5$ | 60 | — | 0 | " | $-C_2H_5$ | — | 0 |
| B-5 | B-5 | $-C_2H_5$ | 50 | $\leftarrow CH_2-CH \rightarrow$ 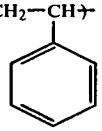 | 10 | $-OCH_2CH(OH)CH_2OOC-CH_2-S-$ | $-C_2H_5$ | — | 0 |
| B-6 | B-6 | 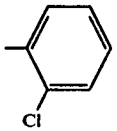 | 50 | $\leftarrow CH_2-CH(COOCH_3) \rightarrow$ | 10 | " | " | — | 0 |
| B-7 | B-7 | $-CH_2C_6H_5$ | 60 | — | 0 | " | " | — | 0 |
| B-8 | B-8 | $-C_2H_5$ | 49.2 | $\leftarrow CH_2-CH(COOCH_3) \rightarrow$ | 10 | $-OCH_2CH(OH)CH_2OOC-CH_2-S-$ | $-C_2H_5$ | $\leftarrow CH_2-CH(COOH) \rightarrow$ | 0.8 |
| B-9 | B-9 | $-C_2H_5$ | 45 | $\leftarrow CH_2-CH(CN) \rightarrow$ | 15 | $-OCH_2CH_2-S-$ | 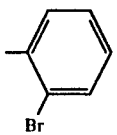 | — | 0 |

TABLE 5-continued
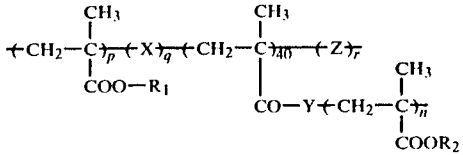
| Synthesis Example No. | Resin (B) | $R_1$ | p | (X) | q | Y | $R_2$ | Z | r |
|---|---|---|---|---|---|---|---|---|---|
| B-10 | B-10 | $-CH_3$ | 49.5 | 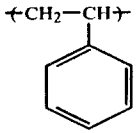 | 10 | $-NHCH_2CH_2-S-$ | $-C_4H_9$ | 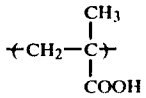 | 0.5 |
| B-11 | B-11 | 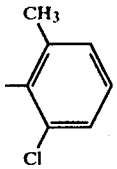 | 57 | — | 0 | 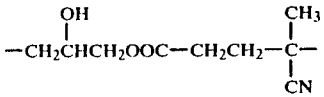 | $-CH_2C_6H_5$ | 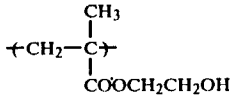 | 3 |
| B-12 | B-12 | $-C_3H_7$ | 45 | 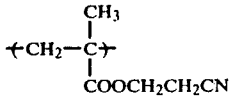 | 15 | " | $-C_2H_5$ | — | 0 |
| B-13 | B-13 | $-C_2H_5$ | 40 | 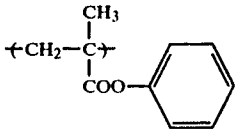 | 15 | 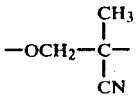 | $-C_3H_7$ | 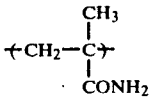 | 5 |
| B-14 | B-14 | $-CH_3$ | 49.5 | 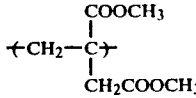 | 10 | 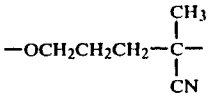 | $-C_4H_9$ | 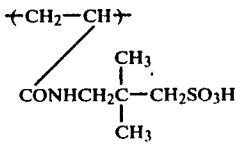 | 0.5 |

TABLE 5-continued
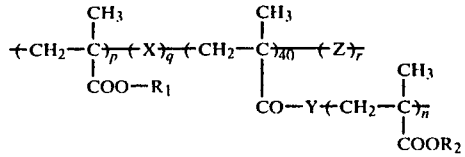
| Synthesis Example No. | Resin (B) | $R_1$ | p | $\leftarrow X \rightarrow$ | q | Y | $R_2$ | Z | r |
|---|---|---|---|---|---|---|---|---|---|
| B-15 | B-15 | $-C_3H_7$ | 50 | $\leftarrow CH_2-CH \rightarrow$ 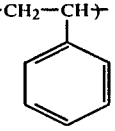 | 10 | $-OCH_2CH(OH)CH_2OOC-CH_2CH_2-S-$ | 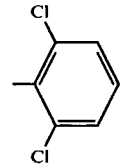 | — | 0 |

SYNTHESIS EXAMPLE B-16

Synthesis of Resin (B-16)

A mixed solution of 70 g of ethyl methacrylate, 30 g of Macromonomer (MB-2), 150 g of toluene and 50 g of isopropanol was heated to 70° C. under nitrogen gas stream and, after adding 0.8 g of ACV to the reaction mixture, the reaction was carried out for 10 hours to obtain the desired Resin (B-16). The weight average molecular weight of the copolymer was $9.8\times10^4$ and the glass transition point thereof was 72° C.

SYNTHESIS EXAMPLES B-17 TO B-24

Synthesis of Resins (B-17) to (B-24)

By following the similar procedure to Synthesis Example B-16, each of Resins (B-17) to (B-24) was produced.

The weight average molecular weight of each resin was in the range of from $9\times10^4$ to $1.2\times10^5$.

TABLE 6

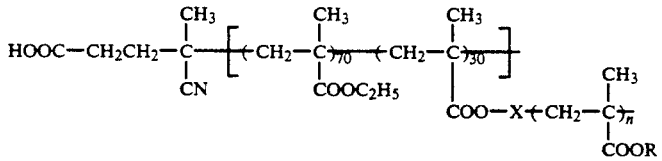

| Synthesis Example No. | Resin (B) | —X— | —R |
|---|---|---|---|
| B-17 | B-17 | $-CH_2CH_2-S-$ | $-C_4H_9$ |
| B-18 | B-18 | $-CH_2CH_2CH_2C(CH_3)(CN)-$ | $-C_2H_5$ |
| B-19 | B-19 | $-CH_2CH_2-S-$ | $-CH_2C_6H_5$ |
| B-20 | B-20 | $-CH_2CH(OH)CH_2OOC-CH_2-S-$ | $-C_3H_7$ |
| B-21 | B-21 | $-CH_2CH(OH)CH_2OOC-CH_2-S-$ | 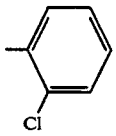 |
| B-22 | B-22 | " | $-C_4H_9$ |
| B-23 | B-23 | " | $-CH_2C_6H_5$ |
| B-24 | B-24 | " | $-C_6H_5$ |

SYNTHESIS EXAMPLES B-25 TO B-31

Synthesis of Resins (B-25) to (B-31)

By following the similar procedure to Synthesis Example B-16 except that each of the azobis compounds shown in Table 7 below was used in place of ACV, each of Resins (B-25) to (B-31) was produced.

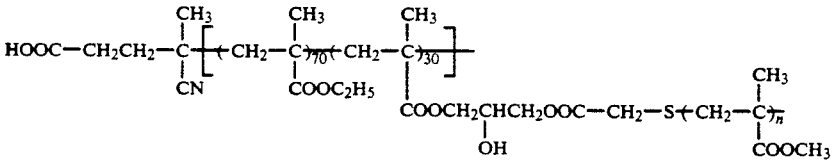

(B-16)

TABLE 7

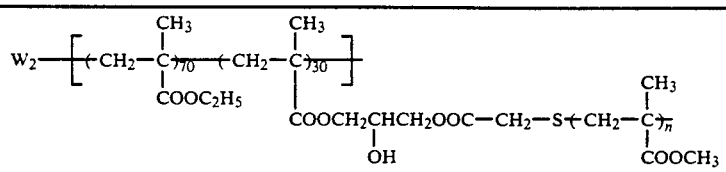

| Synthesis Example No. | Resin (B) | Azobis Compound | $W_2$— | Mw |
|---|---|---|---|---|
| B-25 | B-25 | 2,2'-Azobis(2-cyanopropanol) | 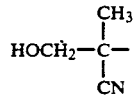 | $10.5 \times 10^4$ |
| B-26 | B-26 | 2,2'-Azobis(2-cyanopentanol) | 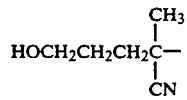 | $10 \times 10^4$ |
| B-27 | B-27 | 2,2'-Azobis{2-methyl-N-[1,1-bis-(hydroxymethyl)-2-hydroxyethyl]-propionamide} | 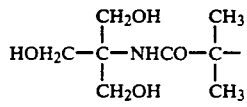 | $9 \times 10^4$ |
| B-28 | B-28 | 2,2'-Azobis[2-methyl-N-(2-hydroxy-ethyl)propionamide] | 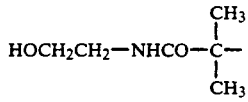 | $9.5 \times 10^4$ |
| B-29 | B-29 | 2,2'-Azobis{2-methyl-N-[1,1-bis-(hydroxymethyl)ethyl]propionamide} | 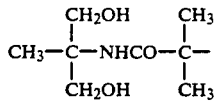 | $8.5 \times 10^4$ |
| B-30 | B-30 | 2,2'-Azobis[2-(5-hydroxy-3,4,5,6-tetrahydropyrimidin-2-yl)propane] | 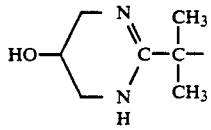 | $8.0 \times 10^4$ |
| B-31 | B-31 | 2,2'-Azobis{2-[1-(2-hydroxyethyl)-2-imidazolin-2-yl]propane} | 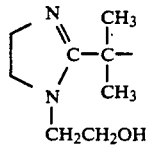 | $7.5 \times 10^4$ |

SYNTHESIS EXAMPLE B-32

Synthesis of Resin (B-32)

A mixed solution of 80 g of butyl methacrylate, 20 g of Macromonomer (MB-8), 1.0 g of thioglycolic acid, 100 g of toluene, and 50 g of isopropanol was heated to 80° C under nitrogen gas stream and, after adding 0.5 g of 1,1-azobis(cyclohexane-1-carbonitrile) (hereinafter simply referred to as ACHN) to the reaction mixture, the mixture was stirred for 4 hours. Then, after further adding thereto 0.3 g of ACHN, the mixture was stirred for 4 hours to obtain the desired Resin (B-32). The weight average molecular weight of the copolymer was $8.0 \times 10^4$ and the glass transition point thereof was 41° C.

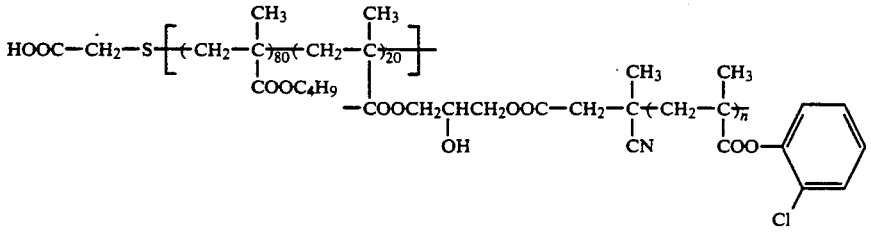

(B-32)

SYNTHESIS EXAMPLES B-33 TO B-39

Synthesis of Resins (B-33) to (B-39)

By following the similar procedure to Synthesis Example B-32 except that each of the compounds shown in Table 8 below was used in place of thioglycolic acid, each of Resins (B-33) to (B-39) was produced.

SYNTHESIS EXAMPLES B-40 TO B-48

Synthesis of Resins [B-40) to (B-48)

By following the similar procedure to Synthesis Example B-26 , each of the copolymers shown in Table 9 below was produced.

The weight average molecular weight of each resin was in the range of from $9.5\times10^4$ to $1.2\times10^5$.

TABLE 8

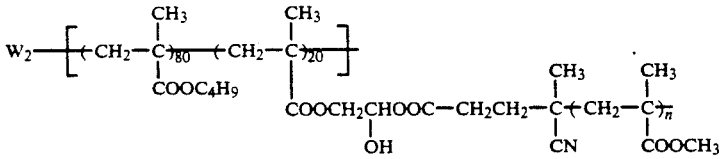

| Synthesis Example No. | Resin (B) | Mercaptan Compound | $W_1$— | Mw |
|---|---|---|---|---|
| B-33 | B-33 | 3-Mercaptopropionic acid | $HOOC-CH_2CH_2-S-$ | $8.5\times10^4$ |
| B-34 | B-34 | 2-Mercaptosuccinic acid | $HOOC-HC(HOOC-CH_2)-S-$ | $10\times10^4$ |
| B-35 | B-35 | Thiosalicylic acid | 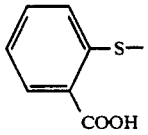 | $9\times10^4$ |
| B-36 | B-36 | 2-Mercaptoethanesulfonic acid pyridine salt | 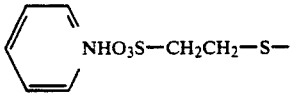 | $8\times10^4$ |
| B-37 | B-37 | $HSCH_2CH_2CONHCH_2COOH$ | $HOOCH_2CNHCOCH_2CH_2-S-$ | $9.5\times10^4$ |
| B-38 | B-38 | 2-Mercaptoethanol | $HO-CH_2CH_2-S-$ | $9\times10^4$ |
| B-39 | B-39 | $HSCH_2CH_2COOCH_2CH_2-O-P(=O)(OH)-OH$ | $HO-P(=O)(OH)-OCH_2CH_2OOCCH_2CH_2-S-$ | $10.5\times10^4$ |

TABLE 9

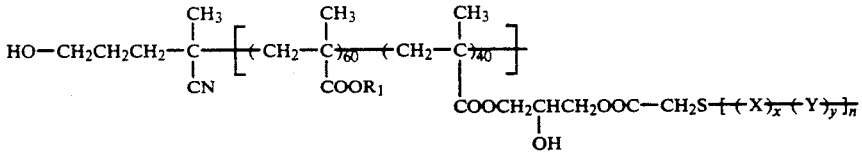

| Synthesis Example No. | Resin (B) | $R_1$ | X | x | Y | y |
|---|---|---|---|---|---|---|
| B-40 | B-40 | $-C_2H_5$ | 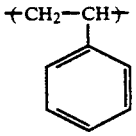 | 20 | 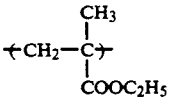 | 80 |
| B-41 | B-41 | $-C_2H_5$ | 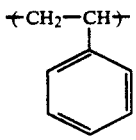 | 40 | $+CH_2-CH(CN)+$ | 60 |

TABLE 9-continued

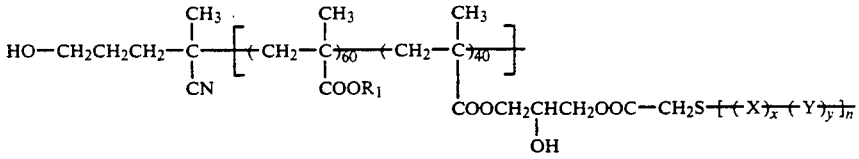

| Synthesis Example No. | Resin (B) | $R_1$ | X | x | Y | y |
|---|---|---|---|---|---|---|
| B-42 | B-42 | $-C_2H_5$ | $\leftarrow CH_2-C(CH_3)(COOCH_3)\rightarrow$ | 90 | $\leftarrow CH_2-CH(COOCH_3)\rightarrow$ | 10 |
| B-43 | B-43 | $-C_3H_7$ | $\leftarrow CH_2-CH\rightarrow$ 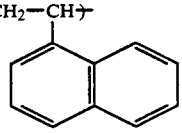 | 100 | — | 0 |
| B-44 | B-44 | $-C_3H_7$ | $\leftarrow CH_2-C(CH_3)(COOCH_2CH_2CN)\rightarrow$ | 50 | $\leftarrow CH_2-C(CH_3)(COOC_4H_9)\rightarrow$ | 50 |
| B-45 | B-45 | $-C_2H_5$ | $\leftarrow CH_2-C(CH_3)(COOC_3H_7)\rightarrow$ | 85 | $\leftarrow CH_2-C(CH_3)(COOCH_2CH_2N(CH_3)_2)\rightarrow$ | 15 |
| B-46 | B-46 | $-C_2H_5$ | $\leftarrow CH_2-C(CH_3)(COOC_2H_5)\rightarrow$ | 90 | $\leftarrow CH_2-CH\rightarrow$ 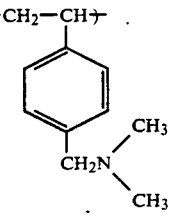 | 10 |
| B-47 | B-47 | $-C_3H_7$ | $\leftarrow CH_2-C(CH_3)(COOC_2H_5)\rightarrow$ | 90 | $\leftarrow CH_2-C(CH_3)(COOCH_2CH_2SO_2CH_3)\rightarrow$ | 10 |
| B-48 | B-48 | $-C_2H_5$ | $\leftarrow CH_2-C(CH_3)(COOC_3H_7)\rightarrow$ | 75 | $\leftarrow CH_2-C(CH_3)(CONH_2)\rightarrow$ | 25 |

SYNTHESIS EXAMPLES B-49 TO B-56

Synthesis of Resins (B-49) to (B-56)

By following the similar procedure to Synthesis Example B-16, each of the resins shown in Table 10 below was produced.

The weight average molecular weight of each resin wa in the range of from $9.5\times10^4$ to $1.1\times10^5$.

TABLE 10

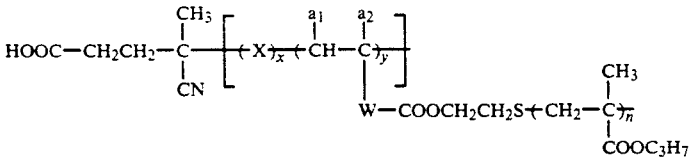

| Synthesis Example No. | Resin (B) | —X— | $a_1$ | $a_2$ | —W— | x/y (weight ratio) |
|---|---|---|---|---|---|---|
| B-49 | B-49 | $-CH_2-C(CH_3)(COOC_2H_5)-$ | H | H | — | 80/20 |
| B-50 | B-50 | " | $CH_3$ | H | — | 70/30 |
| B-51 | B-51 | $-CH_2-CH-$ 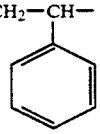 | H | H | 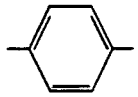 | 60/40 |
| B-52 | B-52 | $-CH_2-C(CH_3)(COOC_2H_5)-$ | H | H | $-COOCH_2CH_2-$ | 80/20 |
| B-53 | B-53 | $-CH_2-C(CH_3)(COOC_2H_5)-$ | H | $CH_3$ | $-COO(CH_2)_2OCO(CH_2)_2-$ | 80/20 |
| B-54 | B-54 | $-CH_2-C(CH_3)(COOCH_2C_6H_5)-$ | H | $CH_3$ | $-CONH(CH_2)_4-$ | 80/20 |
| B-55 | B-55 | $-CH_2-C(CH_3)(COOCH_3)-$ | H | H | 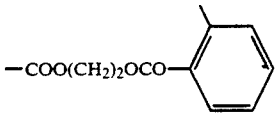 | 50/50 |
| B-56 | B-56 | $-CH_2-CH-$ 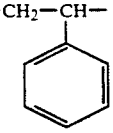 | H | H | $-CH_2OCO(CH_2)_2-$ | 80/20 |

SYNTHESIS EXAMPLE B-101

Synthesis of Resin (B-101)

A mixed solution of 80 g of benzyl methacrylate, 20 g of Macromonomer (MBX-2) obtained in Synthesis Example M-2, and 100 g of toluene was heated to 75° C. under nitrogen gas stream. After adding 0 8 g of 1,1'-azobis(cyclohexane-1-carbocyanide) (hereinafter simply referred to as ABCC) to the reaction mixture, the reaction was carried out for 4 hours and, after further adding thereto 0.5 g of AIBN, the reaction was carried out for 3 hours to obtain the desired resin. The weight average molecular weight of the copolymer was $1.0\times10^5$.

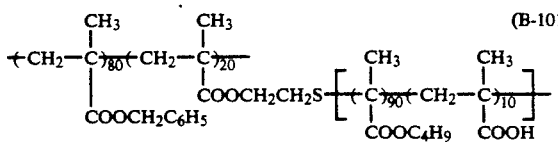

(B-101)

SYNTHESIS EXAMPLE B-102

Synthesis of Resin (B-102)

A mixed solution of 70 g of 2-chlorophenyl methacrylate, 30 g of Macromonomer (MBX-1) obtained in Synthesis Example M-1, 0.7 g of thioglycolic acid, and 150 g of toluene was heated to 80° C. under nitrogen gas stream and, after adding thereto 0.5 g of ABCC, the reaction was carried out for 5 hours. Then, 0.3 g of ABCC was added to the reaction mixture, and the reaction was carried out for 3 hours and after further adding 0.2 g of ABCC, the reaction was further carried out for 3 hours to obtain the desired resin. The weight average molecular weight of the copolymer was $9.2\times10^4$.

adding thereto 0.3 g of ACV, the reaction was carried out for 4 hours to obtain the desired resin. The weight average molecular weight of the copolymer was $1.1\times10^5$.

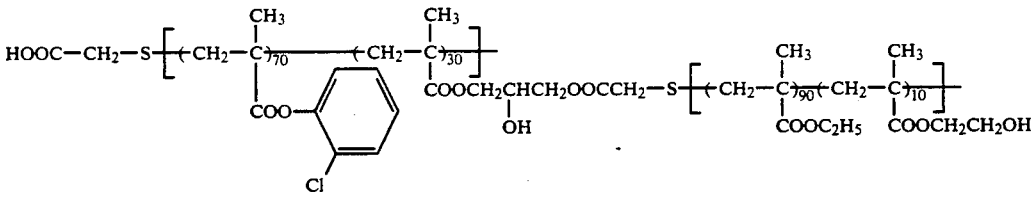

(B-102)

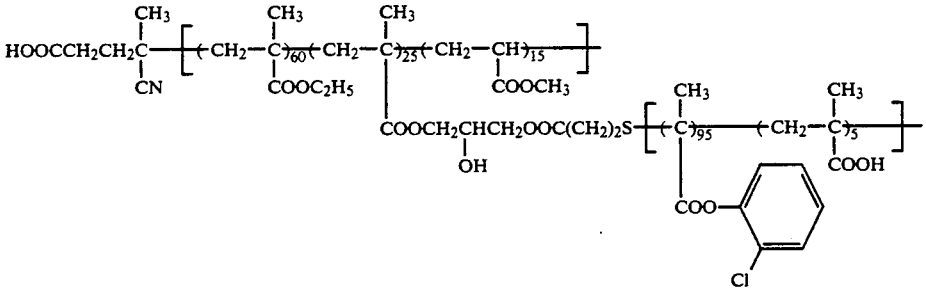

(B-103)

SYNTHESIS EXAMPLE B-103

Synthesis of Resin (B-103)

A mixed solution of 60 g of ethyl methacrylate, 25 g of Macromonomer (MBX-4) obtained in Synthesis Example M-4, 15 g of methyl acrylate, and 150 g of toluene was heated to 75° C. under nitrogen gas stream. Then, 0.5 of ACV was added to the reaction mixture, and the reaction was carried out for 5 hours and, after further

SYNTHESIS EXAMPLES B-104 TO B-111

Synthesis of Resins (B-104) to (B-111)

Resins (B) shown in Table 11 below were synthesized in the same manner as described in Synthesis Example B-101 except for using the corresponding methacrylates and macromonomers shown in Table 11 below, respectively. The weight average molecular weight of each resin was in the range of from $9.5\times10^4$ to $1.2\times10^5$.

TABLE 11

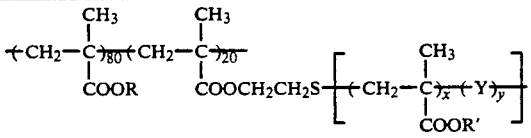

| Synthesis Example No. | Resin (B) | R | R' | x/y (weight ratio) | —Y— |
|---|---|---|---|---|---|
| B-104 | (B-104) | $-C_2H_5$ | 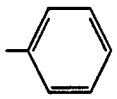 | 95/5 | $-CH_2-\underset{\underset{COOH}{\mid}}{CH}-$ |
| B-105 | (B-105) | $-C_3H_7$ | $-CH_2-$ 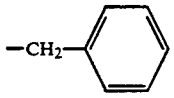 | 93/7 | $-CH_2-\overset{\overset{CH_3}{\mid}}{C}-$ <br> $COO(CH_2)_2OCO(CH_2)_3COOH$ |
| B-106 | (B-106) | $-C_4H_9$ | 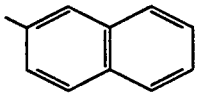 | 96/4 | $-CH_2-\overset{\overset{CH_3}{\mid}}{C}-$ <br> $COO(CH_2)_2O-\overset{\overset{O}{\parallel}}{P}-OH$ <br> $OH$ |
| B-107 | (B-107) | 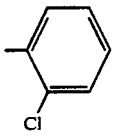 | $-CH_3$ | 95/5 | $-CH_2-\underset{\underset{COOCH_2CH_2COOH}{\mid}}{CH}-$ |

TABLE 11-continued

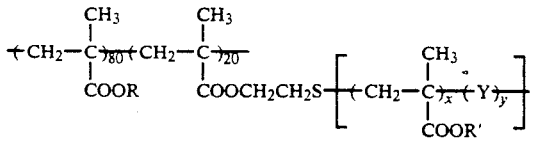

| Synthesis Example No. | Resin (B) | R | R' | x/y (weight ratio) | —Y— |
|---|---|---|---|---|---|
| B-108 | (B-108) | 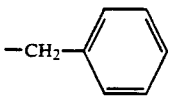 | $-C_2H_5$ | 94/6 | 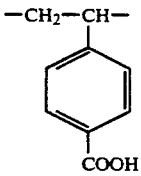 |
| B-109 | (B-109) | 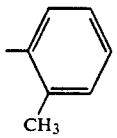 | $-C_4H_9$ | 96/4 | 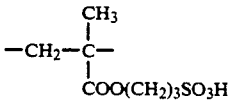 |
| B-110 | (B-110) | $-CH_3$ | 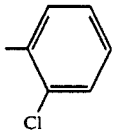 | 96/4 | 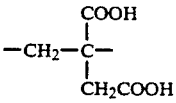 |
| B-111 | (B-111) | $-CH_3$ | $-C_2H_5$ | 92/8 | 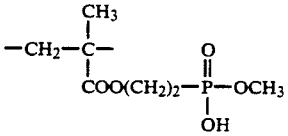 |

SYNTHESIS EXAMPLES B-112 TO B-119

Synthesis of Resins (B-112) to (B-119)

Resins (B) shown in Table 12 below were synthesized in the same manner as described in Synthesis Example B-102, except for using the methacrylates, macromonomers and mercapto compounds as shown in Table 12 below, respectively. The weight average molecular weight of each resin was in the range of from $9\times10^4$ to $1.1\times10^5$.

TABLE 12

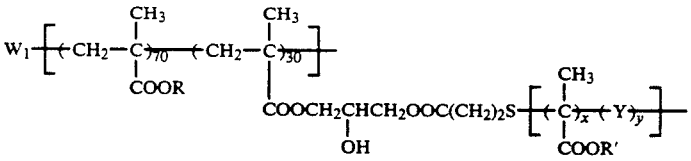

| Synthesis Exam-No. | Resin (B) | $W_1$— | R | R' | x/y (weight ratio) | —Y— |
|---|---|---|---|---|---|---|
| B-112 | (B-112) | HOOC—$H_2C$—S— | 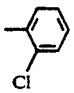 | $-C_2H_5$ | 90/10 | 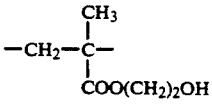 |
| B-113 | (B-113) | 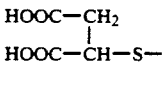 | 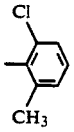 | 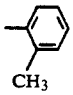 | 85/15 | 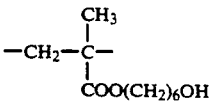 |

TABLE 12-continued

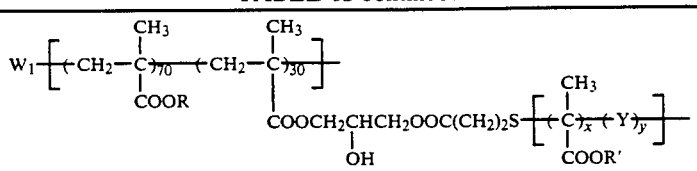

| Synthesis Exam-No. | Resin (B) | $W_1$— | R | R' | x/y (weight ratio) | —Y— |
|---|---|---|---|---|---|---|
| B-114 | (B-114) | 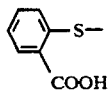 | 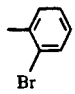 | 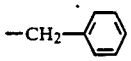 | 90/10 | 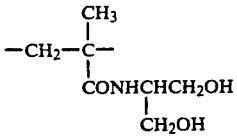 |
| B-115 | (B-115) | 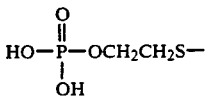 | $-C_2H_5$ | 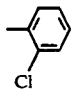 | 92/8 | 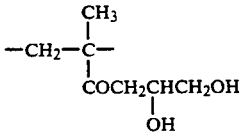 |
| B-116 | (B-116) | $HO_3SCH_2CH_2S$— | 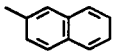 | $-C_4H_9$ | 93/7 | 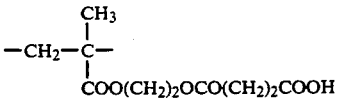 |
| B-117 | (B-117) | $HOCH_2CH_2$—S— | 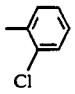 | $-C_2H_5$ | 92/8 | 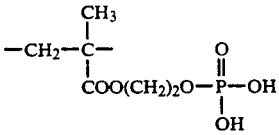 |
| B-118 | (B-118) | HOOC—$(CH_2)_2$S— | 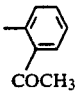 | $-C_3H_7$ | 95/5 | 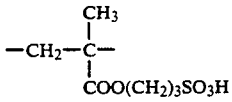 |
| B-119 | (B-119) | 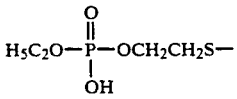 | 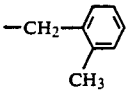 | 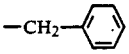 | 80/20 | 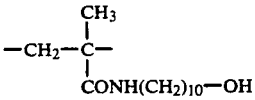 |

SYNTHESIS EXAMPLES B-120 TO B-127

Synthesis of Resins (B-120) to (B-127)

Resins (B) shown in Table 13 below were synthesized in the same manner as described in Synthesis Example B-103, except for using the methacrylates, macromonomers and azobis compounds as shown in Table 13 below, respectively. The weight average molecular weight of each resin was in the range of from $9.5\times10^4$ to $1.5\times10^5$.

TABLE 13
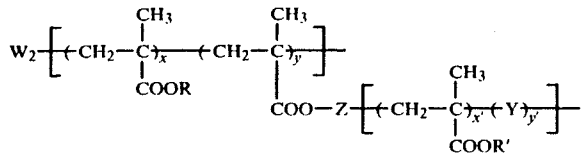
| Synthesis Example No. | Resin (B) | $W_2$— | R | x/y (weight ratio) | —Z— | R' | —Y— | x'/y' (weight ratio) |
|---|---|---|---|---|---|---|---|---|
| B-120 | (B-120) | $HOOC(CH_2)_2C(CH_3)(CN)$— | $-C_2H_5$ | 70/30 | $-CH_2-CHOH-CH_2OOCH_2S-$ | 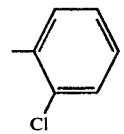 | $-CH_2-C(CH_3)(COOCH_2CH_2OH)-$ | 90/10 |
| B-121 | (B-121) | " | $-C_3H_7$ | 75/25 | " | $-CH_2C_6H_5$ | $-CH_2-CH(CONH(CH_2)_6OH)-$ | 85/15 |
| B-122 | (B-122) | $HOCH_2-C(CH_3)(CN)$— | $-C_2H_5$ | 90/10 | $-(CH_2)_2OOC(CH_2)_2S-$ | 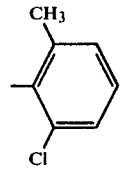 | $-CH_2-C(CH_3)(COOH)-$ | 90/10 |
| B-123 | (B-123) | $HO(CH_2)_3C(CH_3)(CN)$— | $-CH_2C_6H_5$ | 85/15 | $-(CH_2)_2S-$ | $-C_2H_5$ | $-CH_2-CH(COO(CH_2)_2COOH)-$ | 92/8 |
| B-124 | (B-124) | $HO(CH_2)_2NHCO-C(CH_3)_2$— | 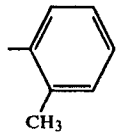 | 88/12 | $-(CH_2)_2S-$ | $-C_4H_9$ | 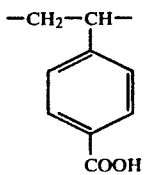 | 90/10 |

TABLE 13-continued
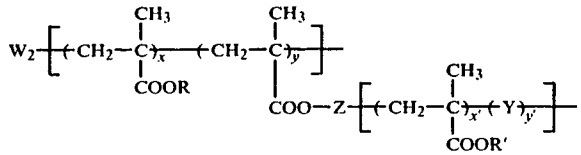
| Synthesis Example No. | Resin (B) | $W_2$— | R | x/y (weight ratio) | —Z— | R' | —Y— | x'/y' (weight ratio) |
|---|---|---|---|---|---|---|---|---|
| B-125 | (B-125) | 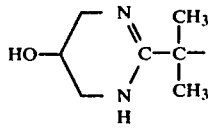 | $-C_2H_5$ | 85/15 | " | 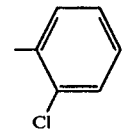 | 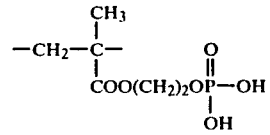 | 95/5 |
| B-126 | (B-126) | 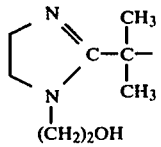 | $-C_3H_7$ | 80/20 | 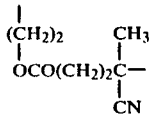 | 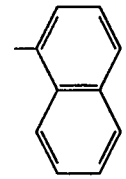 | 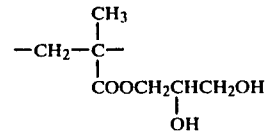 | 90/10 |
| B-127 | (B-127) | 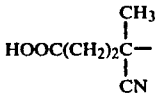 | $-CH_2C_6H_5$ | 85/15 | 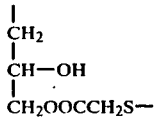 | 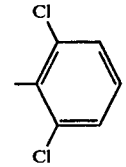 | 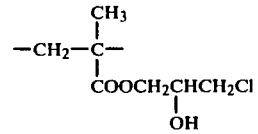 | 90/10 |

EXAMPLE 1

A mixture of 6.8 g (solid basis, hereinafter the same) of Resin (A-1), 33.2 g (solid basis, hereinafter the same) of Resin (B-16), 200 g of zinc oxide, 0.018 g of Cyanine Dye (I) shown below, and 300 g of toluene was dispersed by a homogenizer (manufactured by Nippon Seiki K.K.) at $1\times10^4$ r.p.m. for 10 minutes to prepare a coating composition for a light-sensitive layer. The coating composition was coated on paper, which had been subjected to electrically conductive treatment, by a wire bar at a dry coverage of 25 g/m2, followed by drying at 110° C. for 30 seconds. The coated material was allowed to stand in a dark place at 20° C. and 65% RH (relative humidity) for 24 hours to prepare an electrophotographic light-sensitive material.

Cyanine Dye (I):

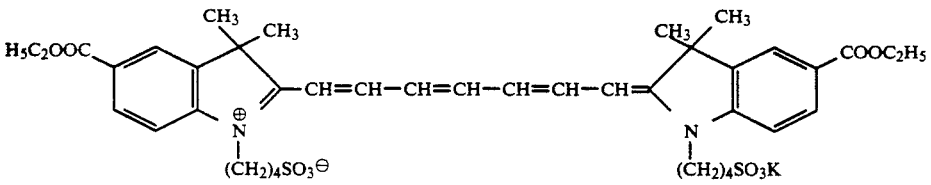

EXAMPLE 2

An electrophotographic light-sensitive material was prepared in the same manner as described in Example 1, except for using 6.8 g of Resin (A-8) in place of 6.8 g of Resin (A-1).

COMPARATIVE EXAMPLE A

An electrophotographic light-sensitive material was prepared in the same manner as described in Example 1 except that 6.8 g of Resin (R-1) for comparison having the following formula was used as a binder resin in place of 6.8 g of Resin (A-1).

Resin (R-1):

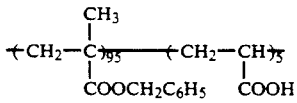

(weight ratio)

Mw: $6.3\times10^3$

COMPARATIVE EXAMPLE B

An electrophotographic light-sensitive material was prepared in the same manner as described in Example 1 except that 6.8 g of Resin (R-2) for comparison having the following formula was used as a binder resin in place of 6.8 g of Resin (A-1).

Resin (R-2):

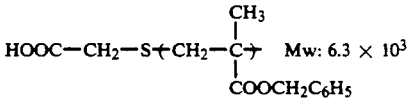

COMPARATIVE EXAMPLE C

An electrophotographic light-sensitive material was prepared in the same manner a described in Example 1 except that 40 g of Resin (R-2) described above was used as a binder resin in place of Resin (A-1) and Resin (B-16).

With each of the light-sensitive materials thus prepared, the film property (surface smoothness), the charging property (occurrence of uneven charging), and the pre-exposure fatigue resistance were determined.

Furthermore, the printing property (background stains and printing durability) were determined when each of the light-sensitive materials was used as an offset printing master plate.

The results obtained are shown in Table 14 below.

TABLE 14

| | Example 1 | Example 2 | Comparative Example A | Comparative Example B | Comparative Example C |
|---|---|---|---|---|---|
| Smoothness of Photoconductive Layer*1 (sec/cc) | 550 | 560 | 580 | 560 | 570 |
| Charging Property*2 (Uneven Charging) | Good (none) | Very Good (none) | Poor (uneven charging) | No Good (slight uneven charging) | Poor (uneven charging) |
| Pre-Exposure Fatigue Resistance*3 $V_{10}$ Recovery Ratio (%) | 90% | 98% | 65% | 77% | 73% |
| Image-Forming Performance | Good | Very Good | Very Poor (reduced Dmax, background fog, scratches of fine lines) | Poor (reduced Dmax, background fog, scratches of fine lines) | Poor (reduced Dmax, background fog, scratches of fine lines) |
| Printing Property*4 Background Stains of Light-Sensitive Material | None | None | None | None | None |
| Printing Durability | 10,000 | 10,000 | Background stains from the start of printing | Background stains from the start of printing | Background stains from the start of printing |

The evaluations described in Table 14 above were conducted as follows.

*1) Smoothness of Photoconductive Layer:

The smoothness (sec/cc) of the light-sensitive material was measured using a Beck's smoothness test machine (manufactured by Kumagaya Riko K.K.) under an air volume condition of 1 cc.

*2) Charging Property:

The light-sensitive material was allowed to stand one day under the condition of 20° C. and 65% RH. Then, after modifying parameters of a full-automatic plate making machine (ELP-404V, manufactured by Fuji Photo Film Co., Ltd.) to the forced conditions of a charging potential of −4.5 kV and a charging speed of 20 cm/sec, the light-sensitive material was treated with the machine using a solid black image as an original and a toner (ELP-T, manufactured by Fuji Photo Film Co., Ltd.). The solid black image thus obtained was visually evaluated with respect to the presence of unevenness of charging and density in the solid black portion.

*3) Pre-Exposure Fatigue Resistance: $V_{10}$ Recovery Ratio:

After applying a corona discharge to the light-sensitive material in a dark place at 20° C. and 65% RH using a paper analyzer (Paper Analyzer Type SP-428, manufactured by Kawaguchi Denki K.K.) for 20 seconds at −6 kV, the light-sensitive material was allowed to stand for 10 seconds, and a surface potential $V_{10}A$ at the point of time was measured.

On the other hand, after exposing the light-sensitive material to a fluorescent lamp for 20 seconds at a distance of 2 meters (500 lux), the light-sensitive material was allowed to stand in a dark place for 10 seconds, and then a surface potential $V_{10}B$ was measured in the same manner as $V_{10}A$ above. The $V_{10}$ recovery ratio was calculated by the following equation: $(V_{10}B/V_{10}A)\times 100(\%)$.

Image-Forming Performance:

The light-sensitive material was allowed to stand one day in a dark place at 20° C. and 65% RH. Then, the light-sensitive material was subjected to the above described pre-exposure, thereafter charged to −5 kV, irradiated by scanning with a gallium-aluminum-arsenic semiconductor laser (oscillation wavelength: 780 nm) of 2.8 mW output as a light source in an exposure amount on the surface of 50 erg/cm$^2$, at a pitch of 25 μm and a scanning speed of 300 meters/sec., and then developed using ELP-T (manufactured by Fuji Photo Film Co., Ltd.) as a liquid developer followed by fixing. The duplicated image thus formed was visually evaluated for fog and image quality.

*4) Printing Property:

Background Stains of Light-Sensitive Material:

After subjecting the photoconductive layer surface of the light-sensitive material to an oil-desensitizing treatment by passing once the light-sensitive material through an etching processor using a solution obtained by diluting twice an oil-desensitizing solution (ELP-EX, manufactured by Fuji Photo Film Co., Ltd.) with distilled water, the thus treated material was mounted on an offset printing machine (Oliver Type 52, manufactured by Sakurai Seisakusho K.K.) as an offset master plate for printing, and the extent of background stains occurred on prints was visually evaluated.

Printing Durability:

The light-sensitive material was subjected to the plate making under the same condition as described above for the image-forming performance of the preexposure. Then, the photoconductive layer of the master plate was subjected to an oil-desensitizing treatment by passing twice the master plate through the etching processor using the oil-desensitizing solution ELP-EX. The resulting plate was mounted on the offset printing machine in the same manner as described above as an offset master for printing, and the number of prints obtained without the occurrence of background stains in the non-image portions of the prints and problems on the image quality of the image portions was determined. The larger the number of the prints, the better the printing durability.

As is apparent from the results shown in Table 14, each of the electrophotographic light-sensitive materials according to the present invention had the photoconductive layer of good smoothness. Also, at the electrostatic charging, uniform charging property was observed without causing uneven charging. Further, under the condition wherein the light-sensitive material which had been pre-exposed prior to making a printing plate, the recovery was very good and the characteristics were almost the same as those obtained under no pre-exposure condition. The duplicated images had no background fog and the image quality was good. This is assumed to be based on that the photoconductive substance, the spectral sensitizer and the binder resin are adsorbed each other in an optimum state and the state is stably maintained.

Also, when the light-sensitive material was subjected to an oil-desensitizing treatment with an oil-desensitizing solution without conducting the plate making procedure and a contact angle between the surface thus treated and a water drop was measured. The contact angle was as small as 10 degree or less, which indicated that the surface was sufficiently rendered hydrophilic. When printing was conducted, the background stains of the prints was not observed.

Furthermore, when a printing plate was prepared from the light-sensitive material and used, since the light-sensitive material had good charging property and pre-exposed fatigue resistance, the duplicated images obtained was clear and had no background fog. Thus, the oil-desensitization with an oil-desensitizing solution sufficiently proceeded and, after printing 10,000 prints, the prints had no background stains and showed clear image quality.

As shown in Example 2, when the electrophotographic light-sensitive material of the present invention contained the resin (A') having the methacrylate component of the specific substituent, the charging property and the pre-exposure fatigue resistance were more improved.

On the other hand, in Comparative Examples A and B each using a known low-molecular weight resin, the uneven charging occurred under the severe condition. Also, the pre-exposure fatigue was large which influenced on the image forming performance to deteriorate the quality of duplicated images (occurrence of background fog, cutting of fine lines and letters, decrease in density, etc.). Also, when the oil-desensitization treatment with an oil-desensitizing solution was conducted, it was confirmed that the light-sensitive materials in the comparative examples showed no background stains on the prints, and the surface of the photoconductive layer was sufficiently rendered hydrophilic. However, when the light-sensitive material for comparison was subjected to plate making and conducted the oil-desensitizing treatment, and used for printing as an offset master plate, prints obtained showed background stains in the non-image portions from the start of printing and the image quality of the image portions was deteriorated (cutting of fine lines and letters, decrease in density, etc.). This means that the degradation of the image quality of the master plate obtained by plate making appears on the prints as it is without being compensated by the oil-desensitizing treatment and, hence, the plate cannot be practically used.

With Comparative Example C using the conventionally known low-molecular weight resin alone, all the characteristics are almost the same as the cases of Comparative Examples A and B. Further, since the film strength of the photoconductive layer was not sufficient, the layer was damaged after obtaining several hundred prints during the printing durability evaluation.

Thus, it can be seen that only the light-sensitive materials according to the present invention are excellent in all aspects of the smoothness of the photoconductive layer, electrostatic characteristics, and printing property.

EXAMPLES 3 TO 28

By following the same procedure as Example 1 except that 6.5 g of each of Resins (A) and 33.5 g of each of Resins (B) shown in Table 15 below were used in place of Resin (A-1) and Resin (B-16), each of the electrophotographic light-sensitive materials shown in Table 15 was produced.

TABLE 15

| Example No. | Resin (A) | Resin (B) |
|---|---|---|
| 3 | A-4 | B-2 |
| 4 | A-5 | B-4 |
| 5 | A-7 | B-8 |
| 6 | A-8 | B-9 |
| 7 | A-9 | B-10 |
| 8 | A-10 | B-112 |
| 9 | A-11 | B-14 |
| 10 | A-12 | B-116 |
| 11 | A-13 | B-117 |
| 12 | A-14 | B-18 |
| 13 | A-17 | B-19 |
| 14 | A-19 | B-20 |
| 15 | A-21 | B-21 |
| 16 | A-22 | B-22 |
| 17 | A-23 | B-23 |
| 18 | A-24 | B-25 |
| 19 | A-25 | B-26 |
| 20 | A-26 | B-27 |
| 21 | A-27 | B-29 |
| 22 | A-28 | B-32 |
| 23 | A-29 | B-35 |
| 24 | A-24 | B-39 |
| 25 | A-22 | B-101 |
| 26 | A-18 | B-103 |
| 27 | A-20 | B-105 |
| 28 | A-2 | B-109 |

As shown in Table 15 above, the light-sensitive materials of the present invention were excellent in the charging property, dark charge retention rate and photosensitivity, and provided clear duplicated images having no background fog even under the high-temperature and high-humidity conditions (30° C. and 80% RH) or the preexposure fatigue condition.

Furthermore, when each of the light-sensitive materials was subjected to the plate making procedure and used for printing as an offset printing master plate, more than 8,000 prints having clear images of no background stains were obtained.

EXAMPLES 29 TO 42

By following the same procedure as Example 1 except that 6 g of each of Resins (A) and 34 g of each of Resins (B) shown in Table 16 below were used as the binder resin and 0.018 g of Dye (II) shown below was used in place of 0.018 g of Cyanine Dye (I), each of the electrophotographic light-sensitive materials was prepared.

Dye (II):

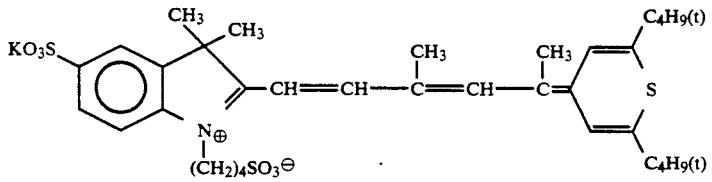

TABLE 16

| Example No. | Resin (A) | Resin (B) |
|---|---|---|
| 29 | A-1 | B-103 |
| 30 | A-4 | B-20 |
| 31 | A-5 | B-42 |
| 32 | A-6 | B-55 |
| 33 | A-7 | B-101 |
| 34 | A-9 | B-108 |
| 35 | A-10 | B-109 |
| 36 | A-13 | B-112 |
| 37 | A-14 | B-114 |
| 38 | A-15 | B-112 |
| 39 | A-19 | B-114 |
| 40 | A-22 | B-115 |
| 41 | A-24 | B-119 |
| 42 | A-26 | B-125 |

Each of the electrophotographic light-sensitive material of the present invention had excellent charging property and pre-exposure fatigue resistance, and, by the duplication using it under the severe conditions, clear images having no occurrence of background fog and cutting of fine lines were obtained. Furthermore, when printing was conducted using an offset printing master plate prepared therefrom, more than 10,000 prints having clear images of no background stains in the non-image portions were obtained.

EXAMPLE 43

A mixture of 6.5 g of Resin (A-2), 33.5 g of Resin (B-104), 200 g of zinc oxide, 0.03 g of uranine, 0.075 g of Rose Bengale, 0.045 g of bromophenol blue, 0.1 g of phthalic anhydride, and 240 g of toluene was dispersed by a homogenizer at 8x103 r.p.m. for 15 minutes to prepare a coating composition for a light-sensitive layer. The coating composition was coated on paper, which had been subjected to electrically conductive treatment, by a wire bar at a dry coverage of 25 g/m$^2$ followed by heating at 110° C. for 30 seconds, and then allowed to stand in a dark place for 24 hours at 20° C. and 65% RH to prepare an electrophotographic light-sensitive material.

COMPARATIVE EXAMPLE D

By following the same procedure as Example 43 except that 6.5 g of Resin (R-1) used in Comparative Example A described above was used in place of 6.5 g of Resin (A-2), an electrophotographic light-sensitive material was produced.

COMPARATIVE EXAMPLE E

By following the same procedure as Example 43 except that 6.5 g of Resin (R-2) used in Comparative Example B described above was used in place of 6.5 g of Resin (A-2), an electrophotographic light-sensitive material was produced.

COMPARATIVE EXAMPLE F

By following the same procedure as Example 43 except that 40 g of Resin (R 3) for comparison having the following formula was used in place of Resin (A-2) and Resin (B-104) as the binder resin, an electrophotographic light-sensitive material was produced.

Resin (R-3):

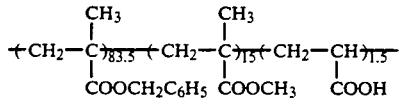

Mw: $4.8 \times 10^4$

With each of the light-sensitive materials thus prepared, the film property (surface smoothness), the charging property (occurrence of uneven charging), and the pre-exposure fatigue resistance were determined. Furthermore, each of the light-sensitive materials was used as an offset printing master plate, and the printing property (background stains and printing durability) of the resulting plate was determined.

The results obtained are shown in Table 17 below.

TABLE 17

| | Example 43 | Comparative Example D | Comparative Example E | Comparative Example F |
|---|---|---|---|---|
| Smoothness of Photoconductive Layer (sec/cc) | 350 | 380 | 385 | 370 |
| Charging Property (Uneven Charging) | Good (none) | Poor (uneven charging) | No Good (slight uneven charging) | Poor (uneven charging) |
| Pre-Exposure Fatigue Resistance $V_{10}$ Recovery Ratio (%) | 95% | 66% | 75% | 73% |
| Image-Forming Performance[5)] | Very Good | Very Poor (reduced Dmax, background fog, scratches of fine lines) | Poor (reduced Dmax, background fog) | Poor (reduced Dmax, background fog) |
| Printing Property | | | | |
| Background Stains of Light-Sensitive Material | None | None | None | None |
| Printing Durability[6)] | 10,000 | Background stains from the start of printing | Background stains from the start of printing | Background stains from the start of printing |

The image forming performance and the printing durability in Table 17 were evaluated as follows. The other evaluations were conducted in the same as described in Example 1.

*5) Image Forming Performance After Pre-exposure:

The light-sensitive material was allowed to stand one day in a dark place at 20° C. and 65% RH. Then, after conducting the pre-exposure under the same conditions as described in *3) above, the light-sensitive material was subjected to plate making by ELP-404V using ELP-T (toner), and the duplicated image obtained was visually evaluated.

*6) Printing Durability:

The light-sensitive material was subjected to the plate making under the same conditions as described in the image forming performance of *5) above. Then, the master plate was subjected to the oil-desensitizing treatment, the printing was conducted in the same manner as in the printing durability of *4) described above, and the resulting prints were evaluated.

The electrophotographic light-sensitive material of the present invention had a sufficient smoothness of the photoconductive layer, caused no uneven charging, and, also, even when pre-exposure was applied thereto, the effect of pre-exposure was recovered very quickly. Also, the duplicated images having no background fog were stably obtained. Further, when it was used as an offset printing plate, the non-image portions were sufficiently rendered hydrophilic and after printing 10,000 prints, further prints having clear images of no background stains were obtained.

On the other hand, with Comparative Examples D and E each using the known low-molecular weight resin, the charging property and pre-exposure fatigue resistance were lowered and, in the duplicated images formed, background fog, decrease in density, cutting of fine lines and letters were observed. Also, when the light-sensitive material was used as an offset master plate, stains occurred on the prints and the image quality of the prints was degraded. Thus, they could not be practically used. Although the sample of Comparative Example F was exhibited the same level of image forming performance as the sample of Comparative Example D, the damage of the photoconductive layer occurred after obtaining several hundred prints during the printing durability evaluation.

Thus, it can be seen that the electrophotographic light-sensitive material having sufficient electrostatic characteristics and printing suitability was obtained only in the case of using the binder resin according to the present invention.

EXAMPLES 44 TO 51

By following the same procedure as Example 43 except that 6.0 g of each of Resins (A) and 34.0 g of each of Resins (B) shown in Table 18 below were used in place of Resin (A-2}and Resin (B-104), each of the electrophotographic light-sensitive materials was produced.

TABLE 18

| Example No. | Resin (A) | Resin (B) |
|---|---|---|
| 44 | A-1 | B-18 |
| 45 | A-2 | B-39 |
| 46 | A-6 | B-103 |
| 47 | A-8 | B-106 |
| 48 | A-13 | B-107 |
| 49 | A-14 | B-111 |
| 50 | A-22 | B-113 |
| 51 | A-27 | B-121 |

The characteristics of each of the light-sensitive materials were determined in the same manner as in Example 43. The results indicated that each of the light-sensitive materials was excellent in charging property and pre-exposure fatigue resistance, and by the formation of the duplicated images under severe conditions, clear images having neither background fog nor cutting of fine lines were obtained.

Furthermore, when printing was conducted using the offset printing master plate obtained by plate making of the light-sensitive material, 10,000 prints having clear images of no background stains in the nonimage portions were obtained.

EXAMPLE 52

A mixture of 6.5 g of Resin (A-30) shown below, 33.5 g of Resin (B-125), 200 g of zinc oxide, 0.03 g of uranine, 0.040 g of Methine Dye (III) shown below, 0.035 g of Methine Dye (IV) shown below, 0.15 g of salicylic acid, and 240 g of toluene was dispersed by a homogenizer at $1\times10^4$ r.p.m. for 10 minutes, then 0.5 g of glutaric anhydride was added thereto and further dispersed by a homogenizer at $1\times10^3$ r.p.m. for one minute to prepare a coating composition for a light-sensitive layer.

The coating composition was coated on paper, which had been subjected to electrically conductive treatment, by a wire bar at a dry coverage of 25 g/m$^2$ followed by heating at 110° C. for 15 seconds and, after further heating at 140° C. for 2 hours, allowed to stand for 24 hours in a dark place at 20° C. and 65% RH to prepare an electrophotographic light-sensitive material.

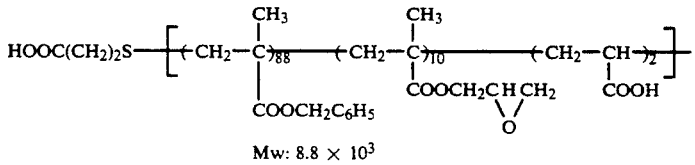

(A-30)

Mw: 8.8 × 10$^3$

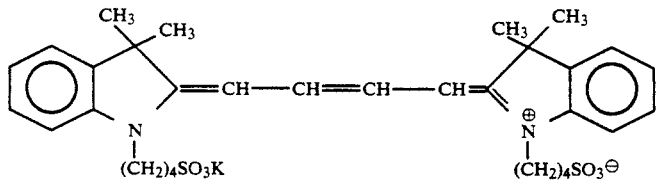

Methine Dye (III)

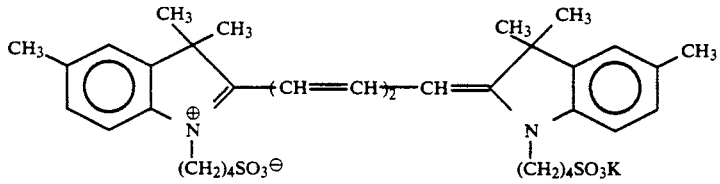

Methine Dye (IV)

The characteristics of the light-sensitive material were determined in the same manners as in Example 43. The smoothness of the photoconductive layer was 225 (sec/cc) and the charging property was uniform and good. The pre-exposure fatigue resistance was the $V_{10}$ recovery ratio of 93% and the image forming performance was good. Also, when it was subjected to the oil-desensitizing treatment and used as an offset printing mater plate, no background stains were observed. When printing was conducted using the printing plate prepared therefrom, more than 10,000 prints having clear images of no background stains were obtained.

EXAMPLES 53 TO 56

By following the same procedure as Example 52 except that each of the compounds shown in Table 19 below was used in place of 6.5 g of Resin (A-30) and 0.5 g of glutaric anhydride as crosslinking agent, and also 33 g of Resin (B-121) was used in place of Resin (B-125), each of the electrophotographic light-sensitive materials was produced.

TABLE 19

| Example No. | Resin (A) | Resin (A) (weight ratio) | Crosslinking Agent and Amount Used |
|---|---|---|---|
| 53 | (A-31) | 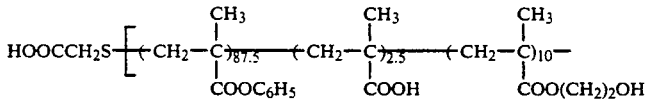 Mw: $7 \times 10^3$ | 1,6-Hexanediisocyanate 1 g |
| 54 | (A-32) | 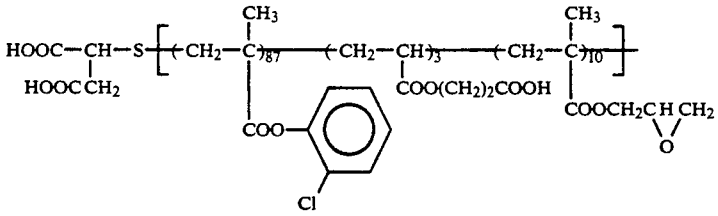 Mw: $6 \times 10^3$ | 3-(N,N-dimethylamino)propylamine 0.8 g |
| 55 | (A-33) | 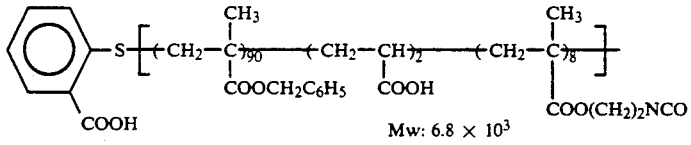 Mw: $6.8 \times 10^3$ | 1,6-Butanediol 0.8 g |
| 56 | (A-34) | 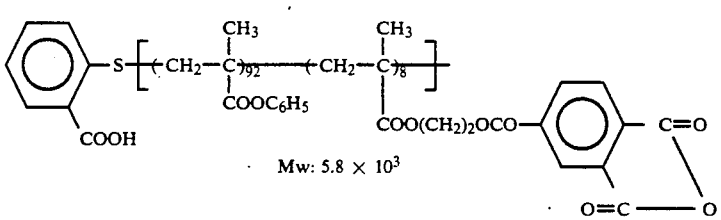 Mw: $5.8 \times 10^3$ | Hexamethylenediamine 0.6 g |

With each of the light-sensitive material, the characteristics were evaluated same as in Example 43.

As a result, each light-sensitive material was good in the charging property and pre-exposure fatigue resistance, and by the formation of duplicated image even under severe conditions, clear images of neither background fog nor cutting of fine lines were obtained. Furthermore, when it was used as an offset master printing plate after making printing plate, more than 10,000 prints having clear images of no background stains in the non-image portions were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon a photoconductive layer containing at least an inorganic photoconductive substance, a spectral sensitizer and a binder resin, wherein the binder resin contains (1) at least one resin (Resin (A)) having a weight average molecular weight of from $1\times10^3$ to $1\times10^4$ which contains at least 30% by weight of a polymer component represented by the general formula (I) described below and from 0.1 to 10% by weight of a polymer component containing at least one acidic group selected from $—PO_3H_2$, $—SO_3H$, —COOH,

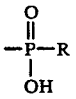

wherein R represents a hydrocarbon group or —OR' (wherein R' represents a hydrocarbon group)) and a cyclic acid anhydride-containing group, and which has at least one acidic group selected from the above-described acidic groups at one terminal of the main chain of the copolymer;

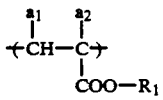

(I)

wherein $a_1$ and $a_2$ each represents a hydrogen atom, a halogen atom, a cyano group or a hydrocarbon group; and $R_1$ represents a hydrocarbon group; and (2) at least one copolymer (Resin (B)) formed from at least a monofunctional macromonomer (MB) having a weight average molecular weight of not more than $2\times10^4$ and a monomer represented by the general formula (V) described below, the macromonomer (MB) comprising at least a polymer component corresponding to a repeating unit represented by the general formula (IVa) or (IVb) described below, and the macromonomer (MB) having a polymerizable double bond group represented by the general formula (III) described below bonded to only one terminal of the main chain thereof

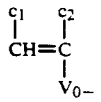

(III)

wherein $V_0$ represents —COO—, —OCO—, —$CH_2OCO$—, —$CH_2COO$—, —O—, —$SO_2$—, —CO—, —CONHCOO—, —CONHCONH—, —$CONHSO_2$—,

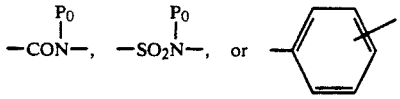

(wherein $P_0$ represents a hydrogen atom or a hydrocarbon group); and $c_1$ and $c_2$, which may be the same or different, each represents a hydrogen atom, a halogen atom, a cyano group, a hydrocarbon group, —COO—$Z_1$ or —COO—$Z_1$ bonded via a hydrocarbon group (wherein $Z_1$ represents a hydrocarbon group which may be substituted);

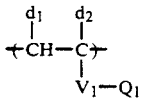

(IVa)

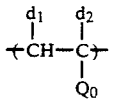

(IVb)

wherein $V_1$ has the same meaning as $V_0$ in the general formula (III); $Q_1$ represents an aliphatic group having from 1 to 18 carbon atoms or an aromatic group having from 6 to 12 carbon atoms; $d_1$ and $d_2$, which may be the same or different, each has the same meaning as $c_1$ or $c_2$ in the general formula (III); and $Q_0$ represents —CN, —$CONH_2$,

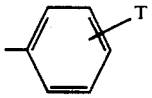

(wherein T represents a hydrogen atom, a halogen atom, a hydrocarbon group, an alkoxy group, or —$COOZ_2$ (wherein $Z_2$ represents an alkyl group, an aralkyl group, or an aryl group));

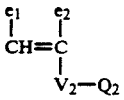

(V)

wherein $V_2$ has the same meaning as $V_1$ in the general formula (IVa); $Q_2$ has the same meaning as $Q_1$ in the general formula (IVa); and $e_1$ and $e_2$, which may be the same of different, each has the same meaning as $c_1$ or $c_2$ in the general formula (III).

2. An electrophotographic light-sensitive material as claimed in claim 1, wherein the polymer component represented by the general formula (I) is a polymerizable component represented by the following general formula (IIa) or (IIb):

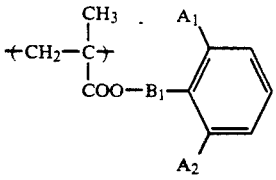

(IIa)

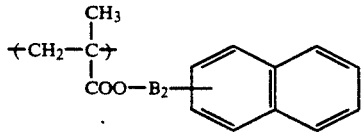

(IIb)

wherein $A_1$ and $A_2$ each represents a hydrogen atom, a hydrocarbon group having from 1 to 10 carbon atoms, a chlorine atom, a bromine atom, —$COD_1$ or —$COOD_2$, wherein $D_1$ and $D_2$ each represents a hydrocarbon group having from 1 to 10 carbon atoms; and $B_1$ and $B_2$ each represents a mere bond or a linking group containing from 1 to 4 atoms, which connects —COO— and the benzene ring.

3. An electrophotographic light-sensitive material as claimed in claim 2, wherein the linking group containing from 1 to 4 linking atoms represented by $B_1$ or $B_2$ is —$CH_2$—$_{n1}$ ($n_1$ represents an integer of 1, 2 or 3), —$CH_2OCO$—, —$CH_2CH_2OCO$—, $\text{-}(CH_2O)\text{-}_{n2}$ (n2 represents an integer of 1 or 2), or —$CH_2CH_2O$—.

4. An electrophotographic light-sensitive material as claimed in claim 1, wherein the content of the polymer component represented by the general formula (I) is from 50 to 97% by weight.

5. An electrophotographic light-sensitive material as claimed in claim 1, wherein the content of the polymer component containing the acidic group in the resin (A is from 0.5 to 8% by weight.

6. An electrophotographic light-sensitive material as claimed in claim 1, wherein the acidic group which is bonded to the terminal of the polymer main chain of the resin (A) is —$PO_3H_2$, —$SO_3H$, —COOH,

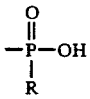

or a cyclic acid anhydride-containing group.

7. An electrophotographic light-sensitive material as claimed in claim 1, wherein the resin (A) further contains a copolymer component having a heat-and/or photo-curable functional group.

8. An electrophotographic light-sensitive material as claimed in claim 7, wherein the photoconductive layer further contains a crosslinking agent.

9. An electrophotographic light-sensitive material as claimed in claim 1, wherein the macromonomer (MB) further contains a polymer component containing at least one polar group selected from —COOH, —$PO_3H_2$, —$SO_3H$, —OH,

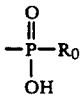

(wherein $R_0$ represents a hydrocarbon group or $—OR_0'$, wherein $R_0'$ represents a hydrocarbon group), —CHO and a cyclic acid anhydride-containing group.

10. An electrophotographic light-sensitive material as claimed in claim 9, wherein the content of the polymer component containing the polar group in the macromonomer (MB) is from 0.5 to 50 parts by weight per 100 parts by weight of the total copolymer components.

11. An electrophotographic light-sensitive material as claimed in claim 9, wherein the resin (B) has at least one polar group selected from $—PO_3H_2$, $—SO_3H$, —COOH, —OH, —SH, and

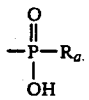

(wherein $R_a$ represents a hydrocarbon group or $—OR_a'$ (wherein $R_a'$ represents a hydrocarbon group)) bonded to only one terminal of the main chain of the polymer.

12. An electrophotographic light-sensitive material as claimed in claim 9, wherein the ratio of copolymerizable component composed of the macromonomer (MB) as a recurring unit to the copolymerizable component composed of the monomer represented by the general formula (V) as a recurring unit is from 1 to 80 to from 99 to 20 by weight.

13. An electrophotographic light-sensitive material as claimed in claim 9, wherein a weight ratio of the resin (A)/the resin (B)is 5 to 80/95 to 20.

14. An electrophotographic light-sensitive material as claimed in claim 1, wherein a weight average molecular weight of the macromonomer (MB) is from $1\times10^3$ to $2\times10^4$.

15. An electrophotographic light-sensitive material as claimed in claim 1, wherein a weight average molecular weight of the resin (B) is not less than $3\times10^4$.

16. An electrophotographic light-sensitive material as claimed in claim 1, wherein a weight average molecular weight of the resin (B) is from $5\times10^4$ to $3\times10^5$.

17. An electrophotographic light-sensitive material as claimed in claim 1, wherein the ratio of copolymerizable component composed of the macromonomer (MB) as a recurring unit to the copolymerizable component composed of the monomer represented by the general formula (V) as a recurring unit is from 1 to 80 to from 99 to 20 by weight.

18. An electrophotographic light-sensitive material as claimed in claim 1, wherein the resin (B) has at least one polar group selected from $—PO_3H_2$, $—SO_3H$, —COOH, —OH, —SH, and

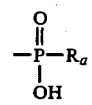

(wherein $R_a$ represents a hydrocarbon group or $—OR_a'$ (wherein $R_a'$ represents a hydrocarbon group) bonded to only one terminal of the main chain of the polymer.

19. An electrophotographic light-sensitive material as claimed in claim 1, wherein a weight ratio of the resin (A)/the resin (B) is 5 to 80/95 to 20.

* * * * *